US005477984A

United States Patent [19]

Sayama et al.

[11] Patent Number: 5,477,984

[45] Date of Patent: Dec. 26, 1995

[54] LIQUID JETTING APPARATUS FOR JETTING LIQUID TOWARD A HAND FOR DISINFECTION THEREOF

[75] Inventors: Shigeharu Sayama; Masashi Aoi; Hiroaki Ito; Akira Abeta, all of Tagawa, Japan

[73] Assignee: Saraya Co., Ltd., Osaka, Japan

[21] Appl. No.: 230,858

[22] Filed: Apr. 21, 1994

[30] Foreign Application Priority Data

| | | | |
|---|---|---|---|
| Apr. 27, 1993 | [JP] | Japan | 5-022350 U |
| Apr. 27, 1993 | [JP] | Japan | 5-101533 |
| Jul. 16, 1993 | [JP] | Japan | 5-177036 |
| Jul. 26, 1993 | [JP] | Japan | 5-184114 |

[51] Int. Cl.[6] ..... B67D 5/08

[52] U.S. Cl. ..... 222/52; 222/66; 222/181.2; 4/623

[58] Field of Search ..... 222/52, 63, 64, 222/65, 66, 51, 23, 181; 141/98, 351; 4/623

[56] References Cited

U.S. PATENT DOCUMENTS

| | | | |
|---|---|---|---|
| 3,273,752 | 9/1966 | Horeczky . | |
| 3,327,901 | 6/1967 | Yerkovich . | |
| 3,419,188 | 12/1968 | Matchett . | |
| 3,434,628 | 3/1969 | Ceraldi . | |
| 3,531,021 | 9/1970 | Bassett . | |
| 3,650,435 | 3/1972 | Kleefeld . | |
| 4,036,406 | 7/1977 | Jespersen et al. . | |
| 4,135,647 | 1/1979 | Mascia et al. . | |
| 4,402,331 | 9/1983 | Taldo et al. . | |
| 4,406,247 | 9/1983 | Baughman et al. | 222/66 X |
| 4,489,857 | 12/1984 | Batlas . | |
| 4,670,010 | 6/1987 | Dragone . | |
| 4,722,372 | 2/1988 | Hoffman et al. | 141/351 X |
| 4,921,150 | 1/1990 | Lagergren et al. . | |
| 4,938,384 | 7/1990 | Pilolla et al. | 222/63 X |
| 4,946,070 | 8/1990 | Albert et al. | 222/52 |
| 4,967,935 | 11/1990 | Celeste | 222/52 X |
| 4,989,755 | 2/1991 | Shiau . | |
| 5,074,322 | 12/1991 | Jaw . | |
| 5,105,992 | 4/1992 | Fender et al. | 222/52 X |
| 5,305,916 | 4/1994 | Suzuki et al. | 222/181 X |
| 5,344,047 | 9/1994 | Chen | 222/63 |

FOREIGN PATENT DOCUMENTS

| | | |
|---|---|---|
| 30-1632 | 4/1252 | Japan . |
| 27-3367 | 2/1955 | Japan . |
| 48-20010 | 3/1973 | Japan . |
| 48-18710 | 3/1973 | Japan . |
| 48-20115 | 3/1973 | Japan . |
| 48-31506 | 4/1973 | Japan . |
| 50-86318 | 7/1975 | Japan . |
| 50-86317 | 7/1975 | Japan . |
| 50-35366 | 10/1975 | Japan . |
| 52-29610 | 3/1977 | Japan . |
| 52-31913 | 3/1977 | Japan . |
| 52-31912 | 3/1977 | Japan . |
| 53-4642 | 2/1978 | Japan . |
| 53-4921 | 2/1978 | Japan . |
| 54-35682 | 11/1979 | Japan . |
| 58-17644 | 4/1983 | Japan . |
| 58-21563 | 5/1983 | Japan . |
| 59-26351 | 6/1984 | Japan . |
| 60-74758 | 5/1985 | Japan . |
| 61-19464 | 2/1986 | Japan . |
| 63-65386 | 12/1988 | Japan . |
| 2-980 | 1/1990 | Japan . |
| 3-32758 | 2/1991 | Japan . |

*Primary Examiner*—Gregory L. Huson
*Attorney, Agent, or Firm*—Wenderoth, Lind & Ponack

[57] ABSTRACT

A disinfector accommodates a jetting nozzle and a hand detecting sensor disposed alongside of the jetting nozzle in a main body thereof. The jetting direction of the jetting nozzle coincides with the light emission direction of the hand detecting sensor. The jetting nozzle and the hand detecting sensor can be pivotally moved in unison. A malfunction which may occur due to the difference in the configurations of the bowl of the washstand and the kind of the material thereof can be solved by merely altering the light emission direction of the hand detecting sensor. Because the jetting direction of the jetting nozzle and the light emission direction of the hand detecting sensor are always coincident with each other, a user can use the jetting apparatus conveniently without feeling discomfort.

13 Claims, 41 Drawing Sheets

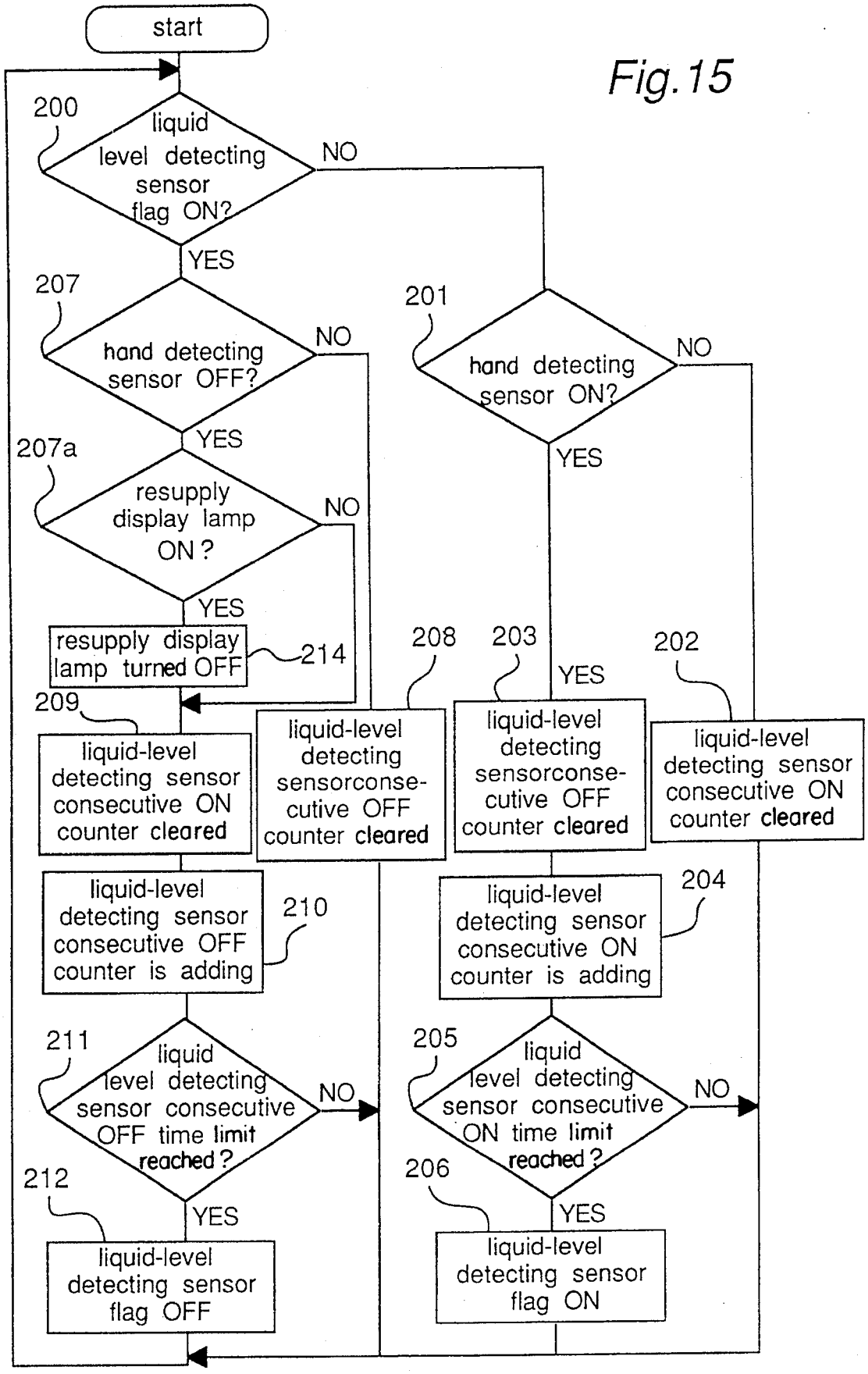
start
Fig.15
200
liquid level detecting sensor flag ON?
NO
YES
207
hand detecting sensor OFF?
NO
YES
207a
resupply display lamp ON ?
NO
YES
resupply display lamp turned OFF
214
209
liquid-level detecting sensor consecutive ON counter cleared
liquid-level detecting sensor consecutive OFF counter is adding
210
211
liquid level detecting sensor consecutive OFF time limit reached ?
NO
YES
212
liquid-level detecting sensor flag OFF
208
liquid-level detecting sensorconse-cutive OFF counter cleared
201
hand detecting sensor ON?
NO
YES
203
liquid-level detecting sensorconse-cutive OFF counter cleared
202
liquid-level detecting sensor consecutive ON counter cleared
204
liquid-level detecting sensor consecutive ON counter is adding
205
liquid level detecting sensor consecutive ON time limit reached ?
NO
YES
206
liquid-level detecting sensor flag ON Fig. 29
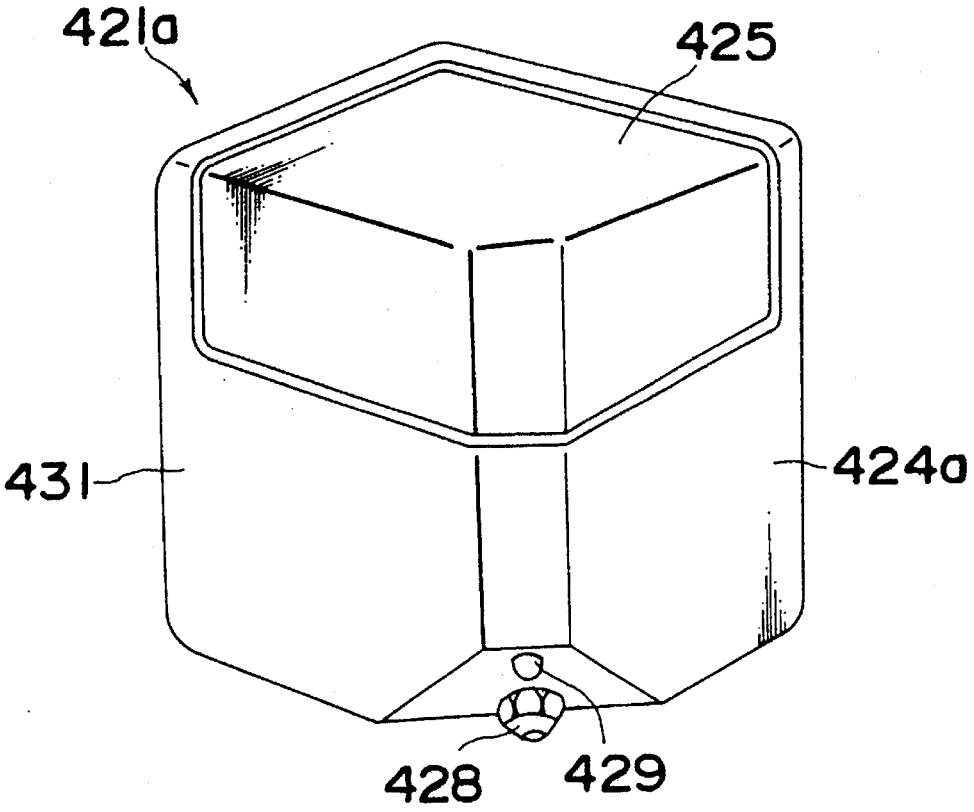
Fig. 30
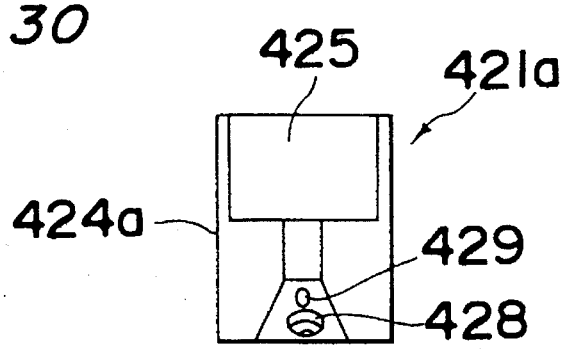
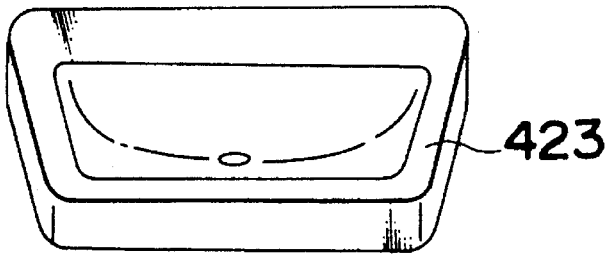

LIQUID JETTING APPARATUS FOR JETTING LIQUID TOWARD A HAND FOR DISINFECTION THEREOF

BACKGROUND OF THE INVENTION

1. Field of the Invention

The present invention relates to a jetting apparatus for jetting liquid and more particularly, to the jetting apparatus installed on a wall surface at a position above a washstand mounted thereon so that the jetting apparatus jets liquid such as disinfectant, soapsuds or the like.

2. Description of the Related Arts

Disinfectors are used in medical facilities to wash hands. An example of a conventional hand disinfector is described below with reference to FIG. 49 showing a first disinfector 601. The disinfector 601 comprises an accommodating casing 602 and a hand-inserting casing 603 disposed above the accommodating casing 602. The accommodating casing 602 accommodates a tank 604, accommodating disinfectant, an electromagnetic pump 605 for feeding the disinfectant under pressure from the tank 604, and a control device 606 for controlling the electromagnetic pump 605. A tray 607 is disposed on the open upper surface of the accommodating casing 602. A nozzle 608 for jetting the disinfectant fed from the electromagnetic pump 605 is installed on the inner surface of the ceiling of the hand-inserting casing 603.

Based on a signal outputted from a sensor 609 which has detected hands inserted into the hand-inserting casing 603, the control device 606 controls the electromagnetic pump 605 so that the electromagnetic pump 605 is operated for a certain period of time, thus jetting the disinfectant from the nozzle 608.

In the above-described first conventional hand disinfector, the hand-inserting casing 603 and the tray 607 for receiving the disinfectant are required. The provision of the hand-inserting casing 603 and the tray 607 make the construction of the hand disinfector large and it is necessary to provide the hand disinfector with many component parts.

A second conventional hand disinfector is described below with reference to FIG. 50. The hand disinfector 610 has been devised to solve the above-described problem. Portions corresponding to the portions constituting the disinfector 601 are denoted by the same reference numerals. The hand disinfector 610 comprises a main body 611 and a tank 604, for containing disinfectant, installed on the main body 611. The main body 611 has a casing 603 accommodating a holding section 612 for holding the tank 604 at an opening thereof, an electromagnetic pump 605 for sucking up the disinfectant from the tank 604 via the holding section 612, a nozzle 608 jetting the disinfectant downward, a sensor 609 for detecting hands disposed below the nozzle 608, and a control device 606 for controlling the operation of the electromagnetic pump 605 for a predetermined period of time in response to a signal outputted from the sensor 609 which has detected the hands.

The casing 603 of the second hand disinfector 610 is smaller than the casing 603 of the first hand disinfector. In the second hand disinfector 610, it is necessary to provide a hand-placing space below the nozzle 608 and prevent the disinfectant, which has been jetted from the nozzle 608, from adhering to the tank 604 so as to prevent the tank 604 from being polluted, because the nozzle 608 is disposed above the tank 604. To this end, it is necessary to dispose the nozzle 608 forward of the tank 604. That is, it is necessary to place the nozzle 608 on the right side in FIG. 50 so that the nozzle 608 is spaced a certain interval from the tank 604 with respect to the tank 604. As a result, a large horizontal area is taken up by the hand disinfector 610.

As described above, the first and second hand disinfectors are both large and complicated in the constructions thereof and a large space is required to install them on a wall or the like.

SUMMARY OF THE INVENTION

It is accordingly an object of the present invention to provide a hand disinfector which is compact and simple in construction so that the hand disinfector occupies a small area and space.

In carrying out the present invention in a preferred mode, there is provided a jetting apparatus, for jetting liquid toward a washstand to be installed on a wall surface at a position above the washstand mounted on the wall surface, comprising: a liquid storing tank storing liquid; and a nozzle, connected with the liquid storing tank, for jetting the liquid stored in the liquid storing tank toward the washstand.

A hand detecting sensor is disposed alongside of the nozzle in the main body thereof. In this construction, the liquid jetting direction of the nozzle and the light emission direction of the hand detecting sensor coincide with each other, and the nozzle and the hand detecting sensor can be moved pivotally in unison.

A pump is provided to feed the liquid under pressure from the liquid storing tank to the nozzle. Control means is provided to control the drive of the pump.

The jetting apparatus further comprises liquid level detecting means for detecting that the level of the liquid stored in the liquid storing tank has dropped to a reference level.

The jetting apparatus further comprises a supply display lamp actuated based on an ON signal outputted from the liquid level detecting means and makes a display that a liquid-replacing time has approached.

The jetting apparatus further comprises accumulated flow-out amount detecting means actuated based on the ON signal outputted from the liquid level detecting means, thus detecting an accumulated flow-out amount of the liquid after the level thereof drops below the reference level; and accumulated flow-out amount calculating means for calculating the accumulated flow-out amount of the liquid based on a value detected by the accumulated flow-out amount detecting means, wherein the operation of the pump is stopped when a value calculated by the accumulated flow-out amount calculating means has reached a predetermined tolerance flow-out amount.

The accumulated flow-out amount detecting means consists of means for detecting the number of rotations of a motor for driving the pump, a flow meter for measuring the amount of the liquid fed from the liquid storing tank to the nozzle, drive time measuring means for detecting the drive time period of the pump.

The pump is disposed in the main body with the shaft thereof extending horizontally.

An elastic member is installed on a drum portion of the pump and fixedly connected with an internal portion of a casing.

The hand detecting sensor consists of a reflection type photoelectric sensor comprising a light receiving section and a light emitting section. In this construction, the light emitting direction of the light emitting section is substantially coincident with the light receiving direction of the light receiving section, and the light emitting section is provided with a diffuser, disposed at a light emitting opening thereof, for diffusing light emitted thereby.

The jetting apparatus is installed on the washstand provided with a liquid receiving container.

The liquid jetting apparatus according to the present invention is installed on a wall surface at a position above the washstand mounted thereon. Liquid stored in the liquid storing tank is jetted from the nozzle connected with the liquid storing tank. The nozzle is disposed below the liquid storing tank and jets the liquid toward the washstand.

It is unnecessary to provide a liquid-receiving component such as a receiving plate because the liquid is jetted toward the washstand. Thus, the jetting apparatus is compact and simple in its construction. Further, it is unnecessary to place the nozzle at a position distant from the liquid storing tank in order to prevent the liquid storing tank from being polluted by the liquid, because the liquid storing tank is disposed above the nozzle. Thus, the jetting apparatus can be installed on the wall surface or the like in a small space.

Supporting portions for supporting the liquid storing tank is formed on the main body of the jetting apparatus. That is the main body is formed in a square pole configuration. In this manner, the jetting apparatus can be installed on the right side or the left side of the washstand even though the a cock and/or a soap container have been mounted on the wall surface and/or the washstand.

In addition, the jetting apparatus is installed on the wall surface via an installing member to be fixed to the wall surface at a position above the washstand and via a supporting member, supporting the jetting apparatus, to be fixed to the installing member. A plurality of supporting portions is formed on the supporting member along the circumferential direction thereof. Accordingly, the jetting apparatus can be installed on the left side, the right side, and the center of the washstand.

Furthermore, in the jetting apparatus there provides a photo-electric sensor of reflecting type provided with a light projecting portion and light receiving portion both directing to the same direction as well as with a light diffuser at the light-projecting opening of the light-projecting portion so as to diffuse the projected light.

BRIEF DESCRIPTION OF THE DRAWINGS

These and other objects and features of the present invention will become clear from the following description taken in conjunction with the preferred embodiments thereof with reference to the accompanying drawings, in which:

FIG. 15 is a flowchart showing the operation of the liquid level detecting sensor;

FIG. 29 is a perspective view showing the disinfector shown in FIG. 28;

FIG. 30 is a front view showing the disinfector shown in FIG. 29.

FIG. 39 is a front view showing a fixture for installing the disinfector, shown in FIG. 38, on a wall or the like;

DETAILED DESCRIPTION OF THE INVENTION

Figure 1:
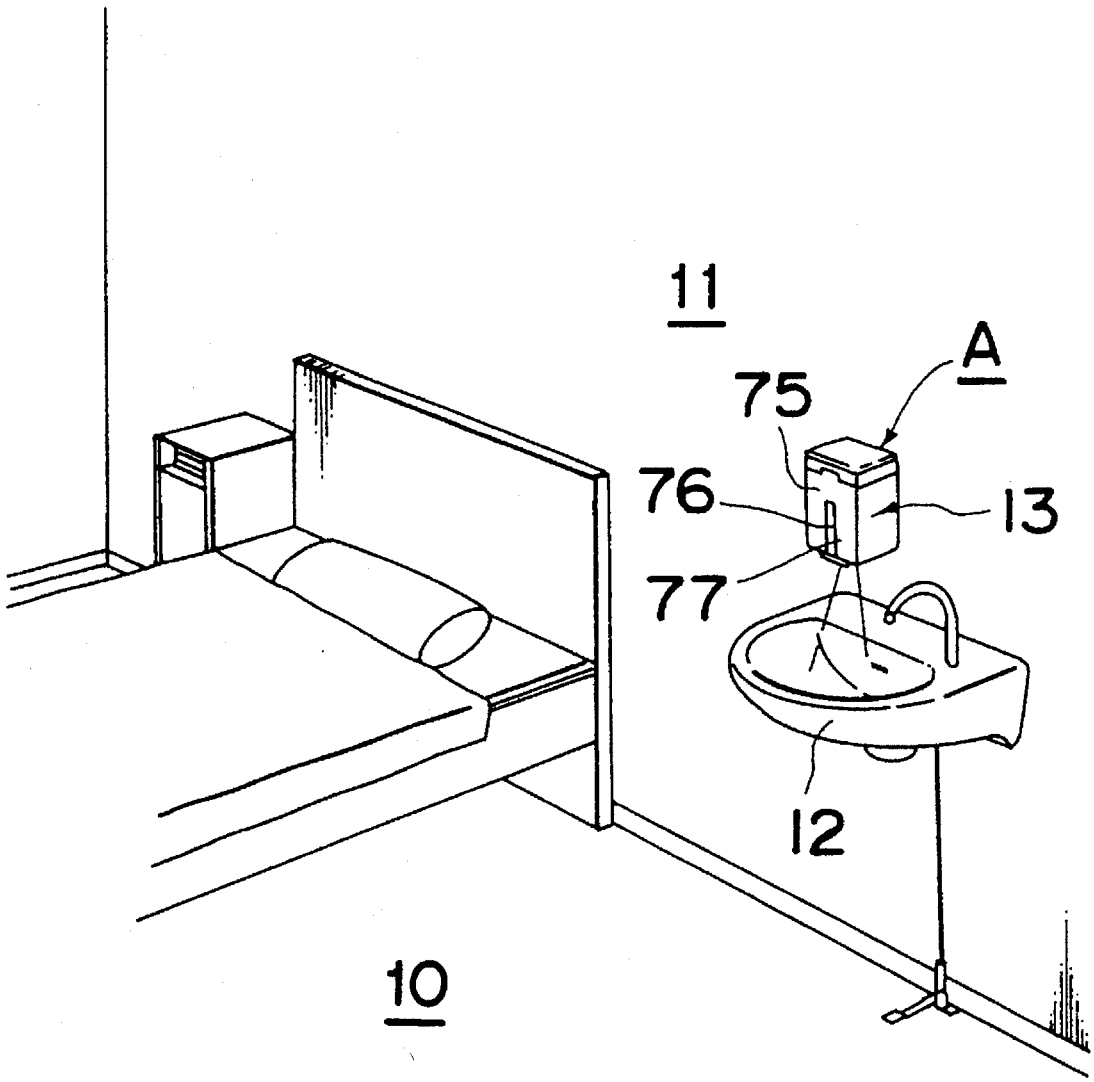
FIG. 1 is a perspective view showing a jetting apparatus, used as a hand disinfector installed on a wall of a hospital room, according to a first embodiment of the present invention.

Before the description of the present invention proceeds, it is to be noted that like parts are designated by like reference numerals throughout the accompanying drawings.

There is shown in FIGS. 1 through 16 a jetting apparatus according to a first embodiment of the present invention.

The construction of the jetting apparatus is described below with reference to FIGS. 1 through 6. The jetting apparatus according to the first embodiment serves as a hand disinfector (A).

FIG. 1 shows a state in which the hand disinfector (A) is installed on a wall surface 11 of a hospital room 10 at a position above a washstand 12 mounted thereon.

FIGS. 2 through 6 show the detailed construction of the hand disinfector (A). First, the fundamental construction of the hand disinfector (A) is described below.

Figure 3:
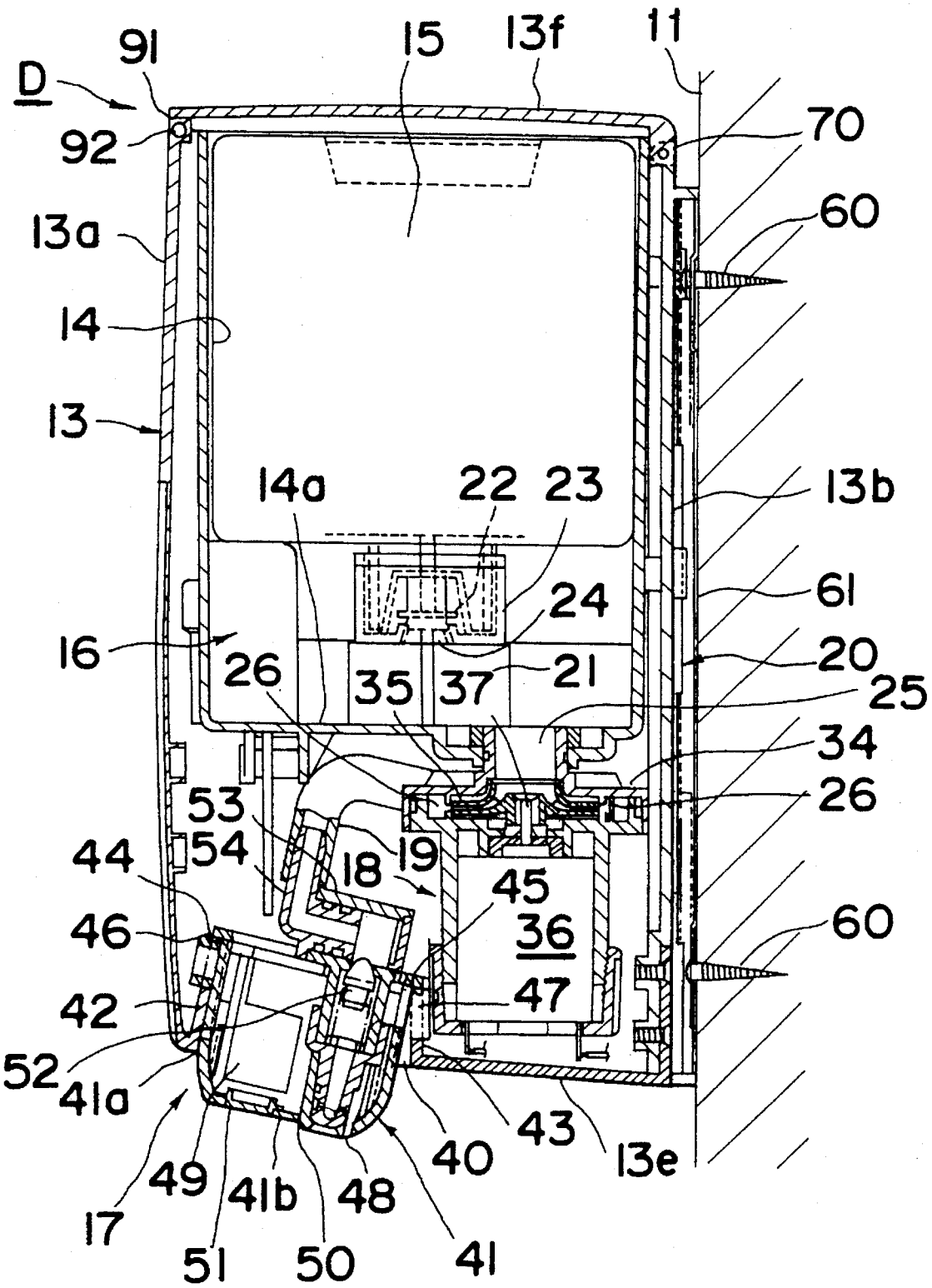
FIG. 3 is a right sectional side view showing the hand disinfector.

As shown in FIG. 3, a rectangular casing 13 accommodating the hand disinfector (A) is removably installed on the wall surface 11 by an installing means 20 which will be described later.

Figure 2:
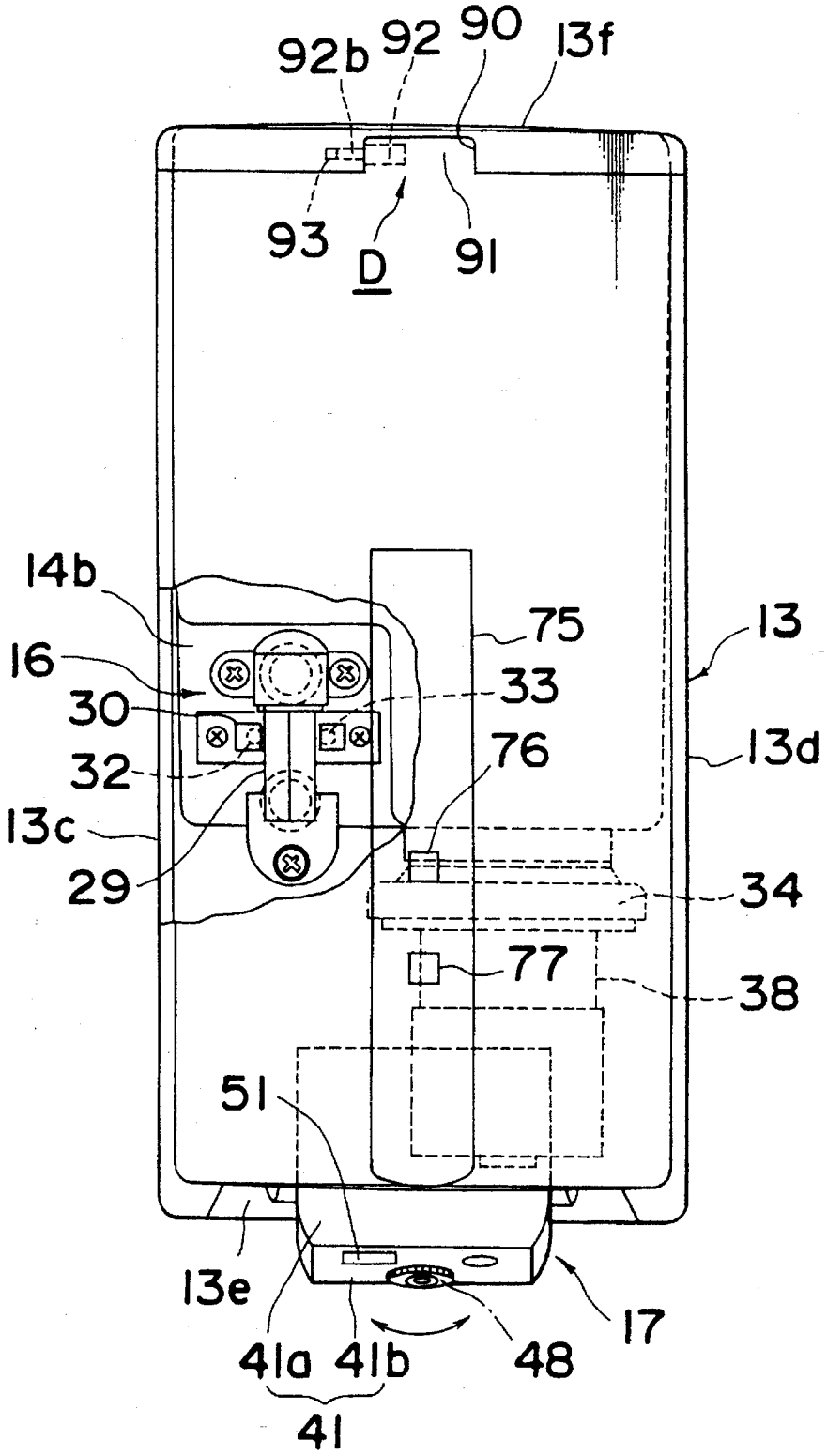
FIG. 2 is a partial cut-away front view showing the hand disinfector.
Figure 4:
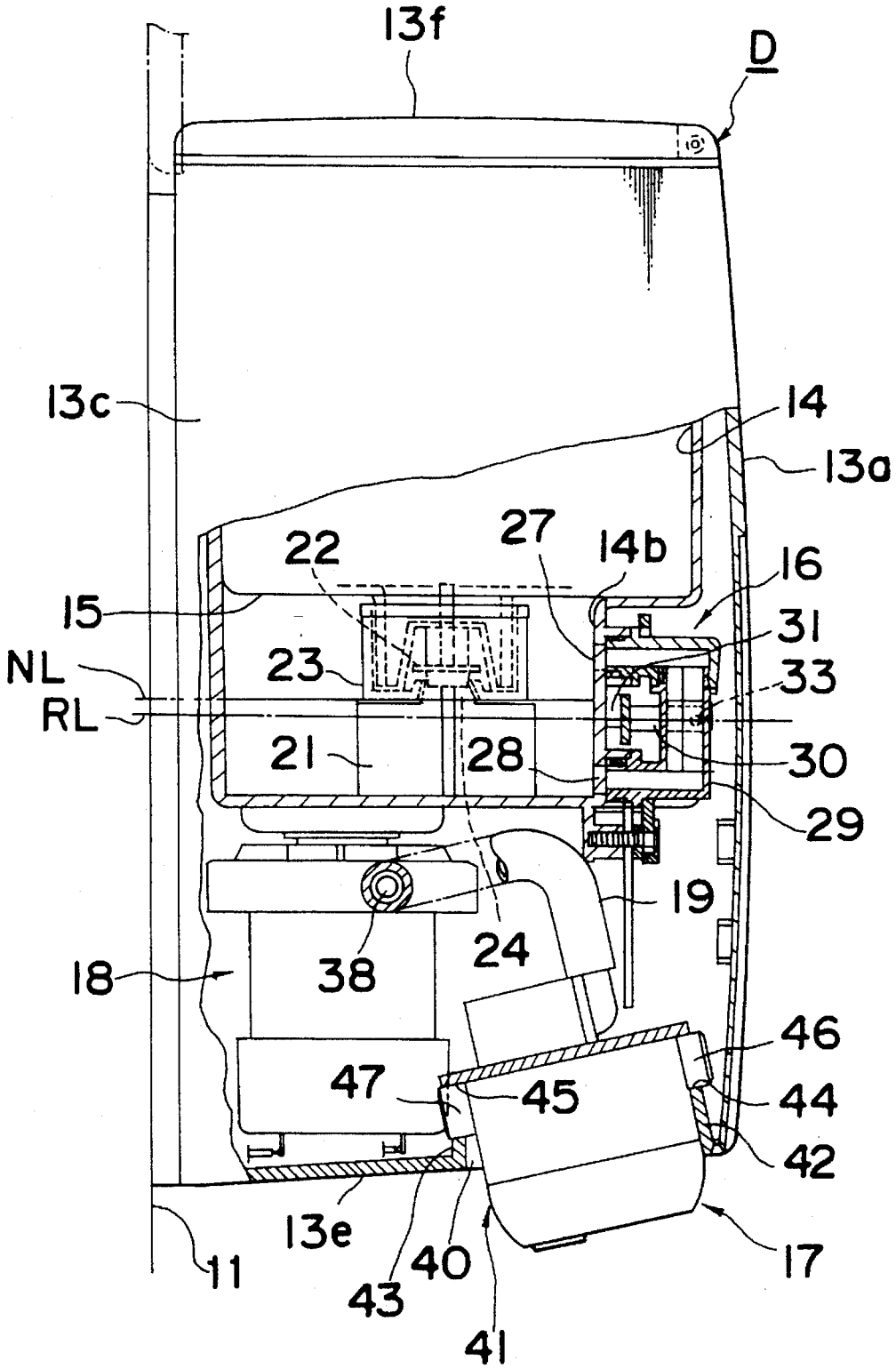
FIG. 4 is a left partial cut-away side view showing the hand disinfector.
Figure 5:
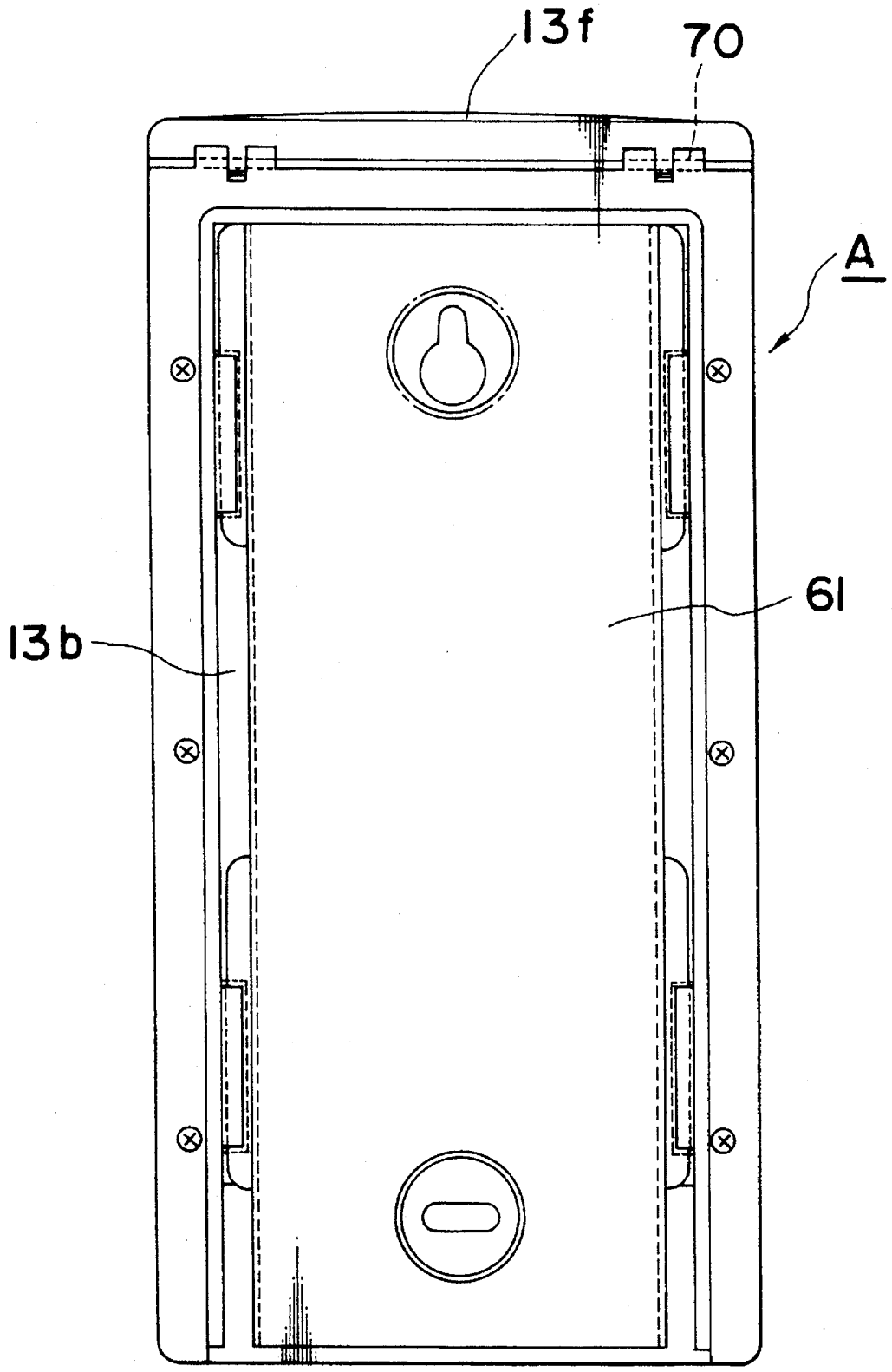
FIG. 5 is a rear view showing the hand disinfector.

As shown in FIGS. 2 through 4, the casing (or main body) 13 comprises a front wall 13*a*, a rear wall 13*b*, left and right walls 13*c* and 13*d*, a bottom wall 13*e*, and a cover 13*f* disposed on the upper end of the casing 13 and can be opened and closed.

As shown in FIGS. 3 and 4, a disinfectant storing tank 14, in a rectangular solid configuration, which is open in the upper end thereof is disposed in an upper space of the casing 13. The tank 14 accommodates a replaceable disinfectant cartridge 15 in a rectangular solid configuration.

As shown in FIGS. 2 and 3, a liquid level detecting portion 16 for detecting the remaining amount of the disinfectant in the tank 14 is installed at a corner of the lower portion of the tank 14.

As shown in FIGS. 2 through 4, the casing 13 accommodates, in a lower space thereof, a disinfectant jetting portion 17 capable of jetting the disinfectant fed from the tank 14 toward hands held out over the bowl of the washstand 12 and a pump 18 for feeding the disinfectant under pressure from the tank 15 to the disinfectant jetting portion 17 via a disinfectant feeding pipe 19.

The pump 18 is disposed above the disinfectant jetting portion 17.

In the above construction, the actuation of the pump 18 allows the disinfectant contained in the tank 14 to be fed to the disinfectant jetting portion 17 via the disinfectant feeding pipe 19. The disinfectant is jetted from the disinfectant jetting portion 17 toward hands held out over the bowl of the washstand 12, thus sterilizing the hands effectively.

Because the tank 14, the pump 18, and the disinfectant jetting portion 17 are disposed in the order of the tank 14, the pump 18, and the disinfectant jetting portion 17 in the casing 13 from top to bottom thereof without depending greatly on the disinfectant feeding pipe 19 for the feeding of the disinfectant, the resistance of the disinfectant feeding pipe 19 to the disinfectant can be reduced and hence the compact casing 13, namely, the compact hand disinfector (A) can be provided.

Even though the remaining amount of the disinfectant in the tank 14 decreases, the hand disinfector (A) is stable on the wall surface 11 because the lower portion of the casing 13 is heavy.

The detailed description of each construction of the hand disinfector (A) is described below.

Construction of Disinfectant Storing Tank 14 and Disinfectant Cartridge 15

There is provided, in the center of a bottom plate 14*a* of the tank 14, a cartridge supporting member 21 which is cross-shaped in a plan view. A cap 23 of the cartridge 15 accommodating an opening/closing valve 22 is disposed on the cartridge supporting member 21.

In this state, the valve 22 inside the cap 23 is opened by a projection 24 formed in the center portion of the cartridge supporting member 21. Thus, the disinfectant flows from the cartridge 15 into the tank 14 via the valve 22. The liquid level of the disinfectant which has flowed into the tank 14 is maintained at a normal liquid level NL by atmospheric pressure.

The normal liquid level NL starts to drop after the disinfectant inside the cartridge 15 is exhausted. A disinfectant flow-out opening 25 formed in the periphery of the bottom plate 14*a* of the tank 14 communicates with an impeller chamber 26 of the pump 18 which will be described later.

Liquid Level Detecting Section 16

As shown in FIGS. 2 through 4, the liquid level detecting section 16 is disposed in a concave space formed in a corner of a lower portion of the tank 14.

As shown in FIG. 4, upper and lower liquid communication openings 27 and 28 are formed on a lower side wall 14*b* of the tank 14 with a certain interval provided vertically therebetween. Each end of a transparent communication pipe 29 U-shaped in a side view communicates with the upper and lower communication openings 27 and 28.

Figure 6:
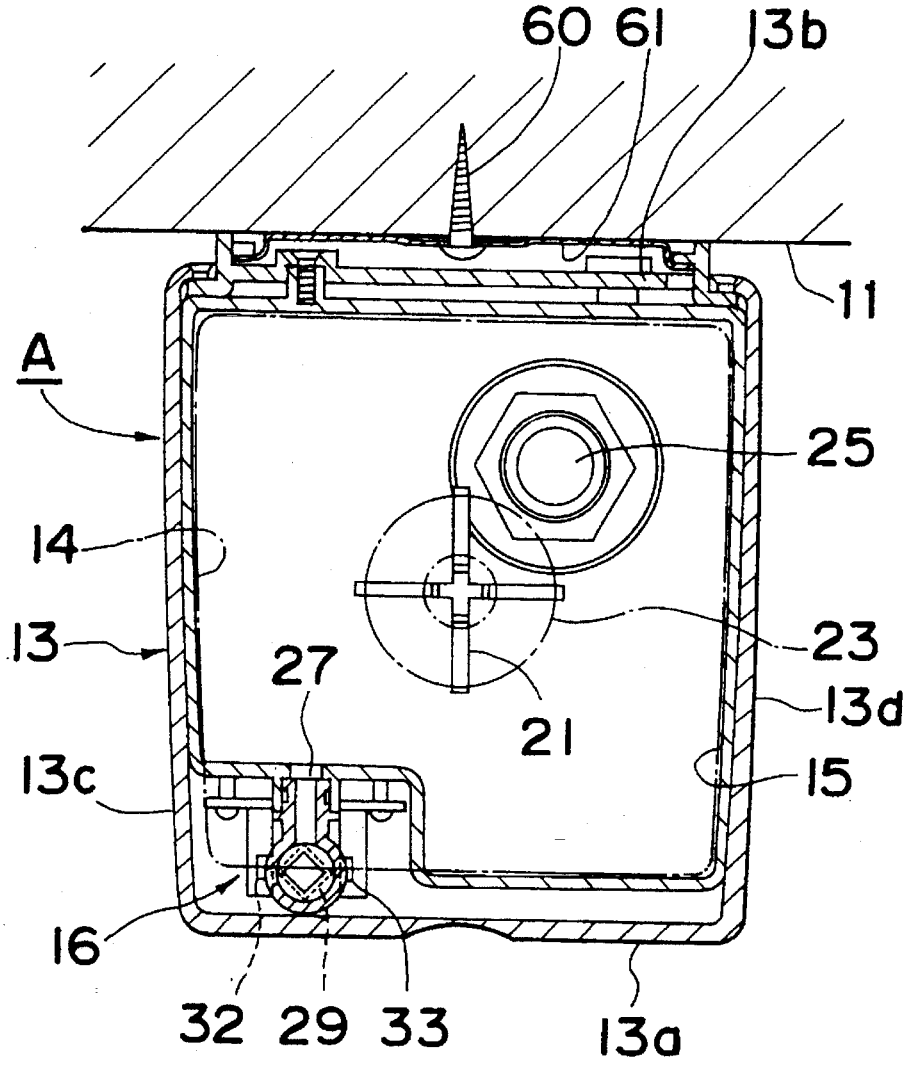
FIG. 6 is a sectional plan view showing the hand disinfector.

As shown in FIGS. 4 and 6, a liquid level detecting sensor 30 U-shaped in a plan view is installed on the lower side wall 14*b* of the tank 14 via an installing bracket 31. A light emission element 32 and a light receiving element 33 embedded in each end of the liquid level detecting sensor 30 are opposed to each other with the transparent communication pipe 29 interposed therebetween.

Figure 7:
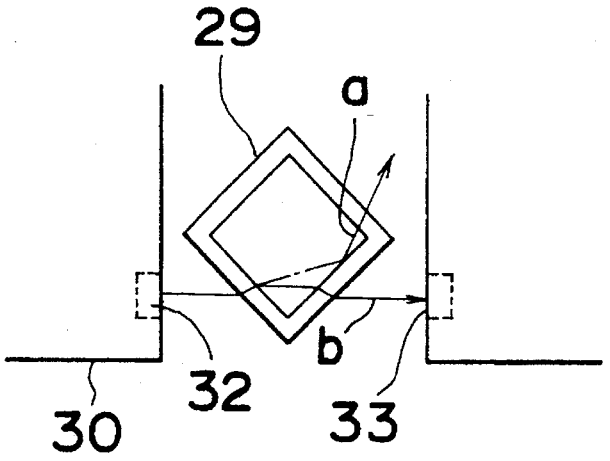
FIG. 7 is view showing in detail principal portions of a hand detecting sensor of the hand disinfector.
Figure 8:
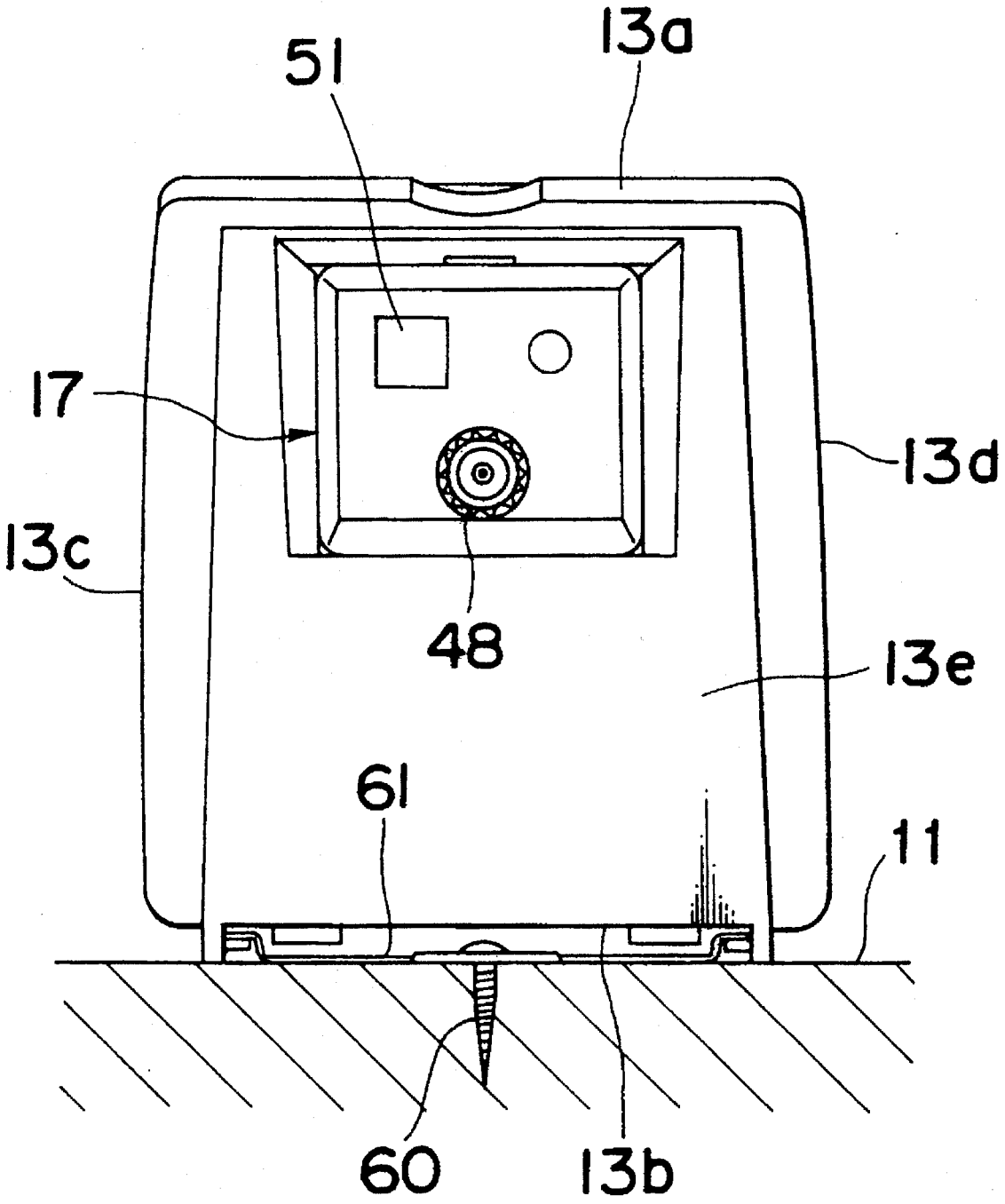
FIG. 8 is a bottom view showing the hand disinfector.

The portion, of the transparent communication pipe 29, sandwiched between the light emission element 32 and the light receiving element 33 is sectionally rhombic as shown in FIG. 7.

Accordingly, when the liquid level in the tank 14 is at the normal liquid level NL in a normal, state, the liquid level of the disinfectant in the transparent communication pipe 29 is the same as that of the disinfectant in the tank 14.

Referring to FIG. 7, light emitted by the light emission element 32 is refracted in accordance with the refractive index of water, thus passing through the transparent communication pipe 29 and being discharged to the outside as shown by a dotted line (a) of FIG. 7. Therefore, the light receiving element 33 does not receive the light, thus outputting an OFF signal.

When the liquid level of the disinfectant has dropped to a reference liquid level RL, namely, a warning liquid level, the liquid level in the transparent communication pipe 29 is disposed below the line connecting the light emission element 32 and the light receiving element 33. Therefore, the light emitted by the light emission element 32 is refracted in accordance with the refractive index of air, thus passing through the transparent communication pipe 29 and being received by the light receiving element 33 as shown by a solid line (b) of FIG. 7. As a result, the light receiving element 33 outputs an ON signal.

The transparent communication pipe 29 may be circular or channel in its sectional configuration.

Pump 18

The pump 18 comprises an impeller casing 34 accommodating an impeller chamber 26, an impeller 35 rotatably installed inside the impeller casing 34, and a rotary motor 36 integral with the impeller casing 34. The impeller 35 is fixed to the leading end of the output shaft 37 of the motor. 36.

The pump 18 communicates with the tank 14 via the disinfectant flow-out opening 25 formed in the center of the impeller chamber 26.

As shown in FIGS. 3 and 4, a disinfectant flow-out opening 38 formed on the periphery of the impeller chamber 26 communicates with the base portion of the disinfectant feeding pipe 19.

In this construction, the impeller 35 is rotated by the motor 36 and as a result, the disinfectant in the tank 14 can be fed under pressure to the disinfectant jetting portion 17, which will be described later, via the pump 18 and the disinfectant feeding pipe 19.

Disinfectant Jetting Portion 17

Referring to FIGS. 2, 3, 4, and 8, a rectangular jetting portion-installing opening 40 is disposed in the center of the front of the bottom wall 13*e* of the casing 13 inclined upward from the wall surface 11 toward the front. The jetting portion-installing opening 40 has the same inclination as that of the bottom wall 13*e*. A casing 41, of the disinfectant jetting section 17, in a rectangular solid configuration is disposed in the opening 40. The axis of the casing 41 is directed toward the center of the bowl of the washstand 12 disposed below the casing 41.

Bearing brackets 42 and 43 integral with the bottom wall 13*e* of the casing 13 vertically extend in the front and rear of the opening 40, respectively. Bearings 44 and 45 are formed on an upper portion of each of the brackets 42 and 43.

Shafts 46 and 47 formed on an upper portion of the front and real walls of the casing 41 are rotatably installed on each of the bearings 44 and 45.

In this construction, the casing 41 pivots within a predetermined angle (for example, 15°) right-to-left or vice versa on the shafts 46 and 47, as shown in FIG. 2.

The internal construction of the casing 41 comprising a cylindrical main body 41*a* and a bottom plate 41*b* is described is described below.

As apparent from FIG. 3, the casing 41 accommodates a jetting nozzle 48 and a hand detecting sensor 49 disposed alongside of the jetting nozzle 48 in the same direction as that of the axis of the casing 41. The leading end of the nozzle 48 projects downward in penetration through a transparent opening 50 formed on the bottom plate 41*b*. A transparent window 51 made of transparent plastic is formed on the bottom plate 41*b* opposed to the hand detecting sensor 49.

That is, in the first embodiment, the jetting nozzle 48 and the hand detecting sensor 49 are integral with each other and installed inside the casing 41. The jetting direction of the jetting nozzle 48 and the light emission direction of the hand detecting sensor 49 are coincident with each other. The jetting direction of the jetting nozzle 48 and the light emission direction of the hand detecting sensor 49 can be simultaneously altered due to the pivotal motion of the casing 41.

Accordingly, a malfunction which may occur due to the difference in the configurations of the bowl of the washstand 12 and the kind of the material of the bowl can be solved by merely altering the light emission direction of the hand detecting sensor 49.

Because the jetting direction of the jetting nozzle 48 and the light emission direction of the hand detecting sensor 49 are always coincident with each other, a user can use the jetting apparatus conveniently without feeling discomfort.

As shown in FIG. 3, in the casing 41, a check valve 52 is formed on the upper end of the nozzle 48. The check valve 52 communicates with the leading end of the flexible disinfectant feeding pipe 19 via a pipe coupling 53 and an elbow 54 both integral with the check valve 52.

Installing Construction of Casing 13 on Wall Surface 11

As apparent from FIGS. 3 and 6, in the first embodiment, a rectangular installing plate 61 is installed on the wall surface 11 by means of a bolt 60 so that the rear wall 13*b* of the casing 13 is fixed to the installing plate 61. In this manner, the hand disinfector (A) can be easily installed on the wall surface 11.

Construction of Opening/Closing Cover 13*f*

As shown in FIG. 3, the cover 13*f* formed on an upper portion of the casing 13 pivots vertically on a shaft 70 comprising such as a spring pin installed on the rear end thereof. A cover-locking device (D) to be operated by ON/OFF outputs of the liquid level detecting sensor 30 is installed on the front end of the cover 13*f*.

Figure 9:
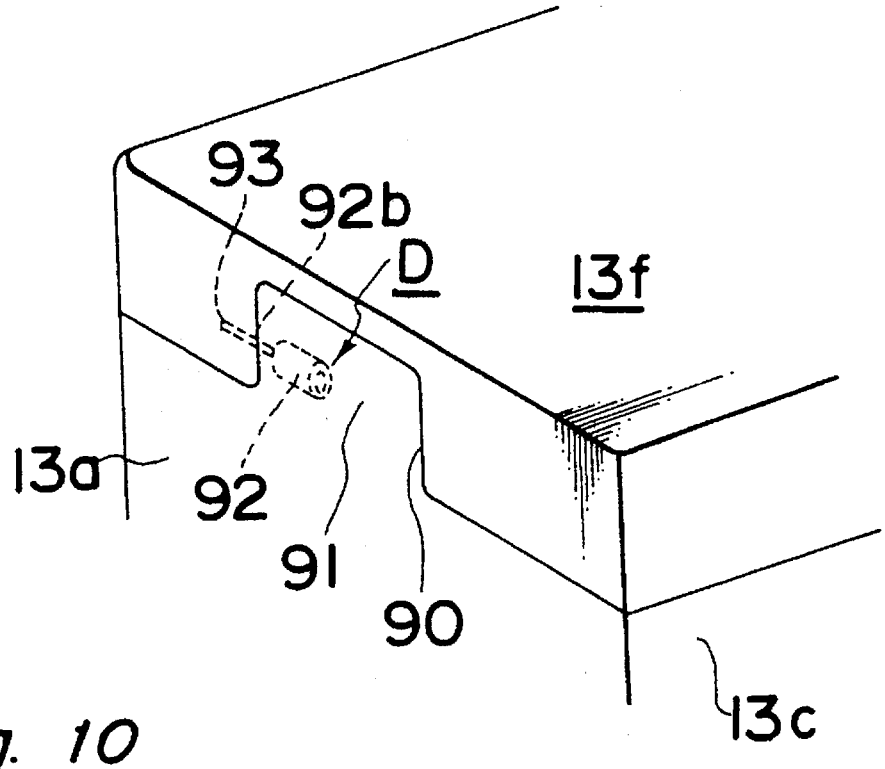
FIG. 9 is a perspective view showing in detail principal portions of a cover of the hand disinfector.
Figure 10:
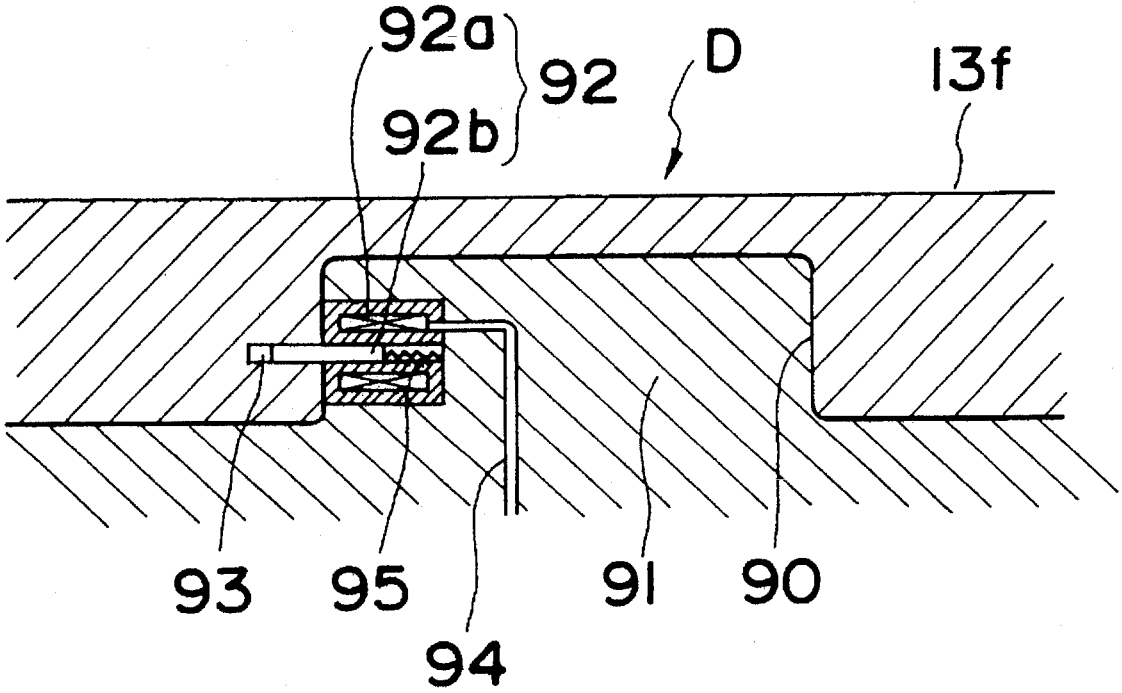
FIG. 10 is a sectional front view showing a device for locking the cover of the hand disinfector.

The construction of the cover-locking device (D) is described below with reference to FIGS. 9 and 10 mainly. An engaging concave 90 is formed in the center of the front wall of the cover 13*f*. An engaging projection 91 integral with the center portion of the upper edge of the front wall 13*a* of the casing 13 engages the engaging concave 90.

In the cover 13*f*, a cover locking solenoid 92 comprising an electromagnetic coil 92*a* and a plunger 92*b* is embedded in a side edge region of the engaging projection 91. An inserting opening 93 into which the plunger 92*b* of the solenoid 92 is removably inserted is formed at the center of the front wall, of the cover 13*f*, opposed to the side edge region of the engaging projection 91.

In this construction, the plunger 92*b* of the solenoid 92 is placed at a backward position, namely, a position disengaged from the opening 93 due to the tensile force of a tension spring 95 formed in the rear of the plunger 92*b*, when electric current is not supplied to the plunger 92*b* through a line 94.

When electric current is supplied to the plunger 92*b* through the line 94, the plunger 92*b* advances into the opening 93, thus locking the cover 13*f*.

The operation of the solenoid 92 is interlocked with an output signal of the liquid level detecting sensor 30. More specifically, until the liquid level detecting sensor 30 detects the reference liquid level RL, it keeps outputting ON-signals to the solenoid 92. Therefore, the plunger 92*b* keeps engaging the opening 93, thus keeping the cover 13*f* at the locking position.

When the liquid level detecting sensor 30 detects the reference liquid level RL, it outputs OFF-signals. As a result, the plunger 92*b* disengages from the opening 93, thus unlocking the cover 13*f*.

Cover-opening operation can be reliably prevented until the liquid level detecting sensor 30 detects the reference liquid level RL, i.e., until disinfectant-replacing time comes. Therefore, various disadvantages which are caused by frequent opening and closing of the cover 13*f* do not occur. That is, mixing of bacteria into the tank 14 or overflow of the disinfectant from the tank 14 caused by the removal of the cartridge 15 can be reliably prevented.

Display Construction of Casing 13

As shown in FIGS. 1 and 2, a state display portion 75 formed on the front wall 13*a* has a power source display lamp 76 and a supply (of disinfectant) display lamp 77.

As will be described later, the supply display lamp 77 is turned on and off when the liquid level in the tank 14 has reached the reference liquid level RL, thus informing a user of the fact that cartridge-replacing time is approaching.

It is possible to provide the following method for turning on the supply display lamp 77. That is, the drive time period of the motor 36 of the pump 18 may be replaced with flow rate, and a capacity ranging from the reference liquid level RL to a degree of the liquid level at which the pump 18 does not idle may be set. In this method, when the capacitance has reached an accumulated flow rate, the supply display lamp 77 is turned on.

Control Section

Figure 11:
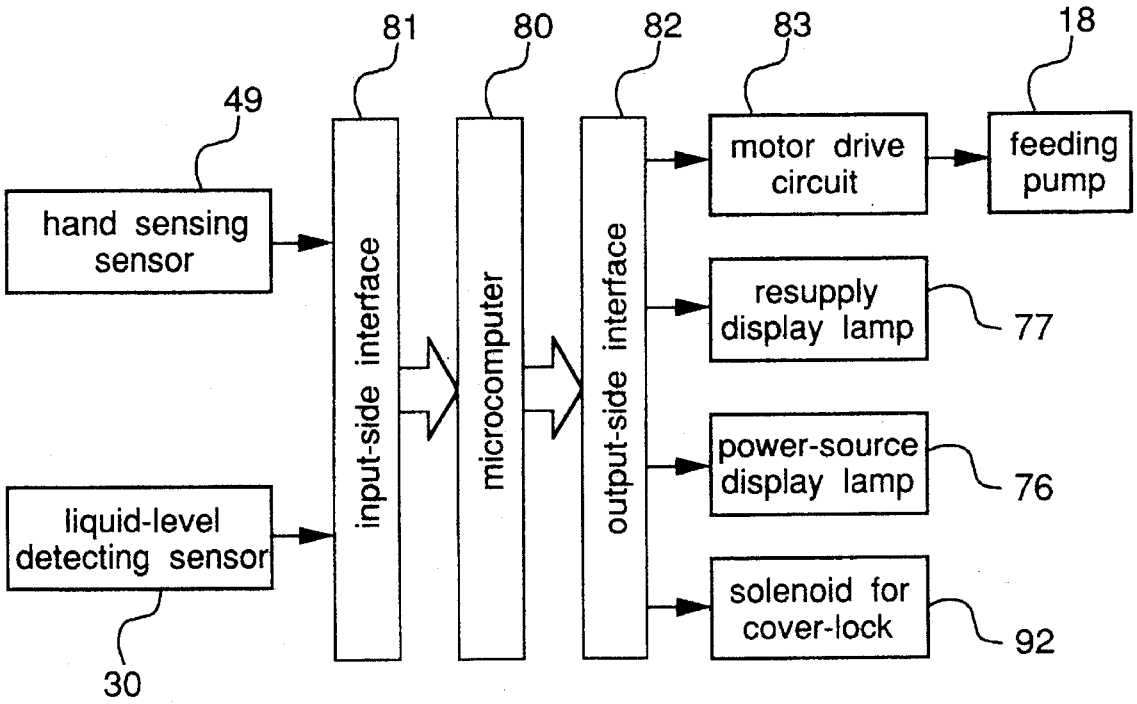
FIG. 11 is a block diagram showing the construction of a control section of the hand disinfector.

A control section (C) is provided inside the casing 13 of the hand disinfector (A). The construction of the control section (C) is shown in FIG. 11.

The control section (C) comprises a microcomputer 80. An input side interface 81 of the microcomputer 80 is connected with the liquid level detecting sensor 30 and the hand detecting sensor 49. An output side interface 82 of the microcomputer 80 is connected with a motor driving circuit 83 of the pump 18, the power source display lamp 76, the supply display lamp 77, and the cover locking solenoid 92.

Figure 12:
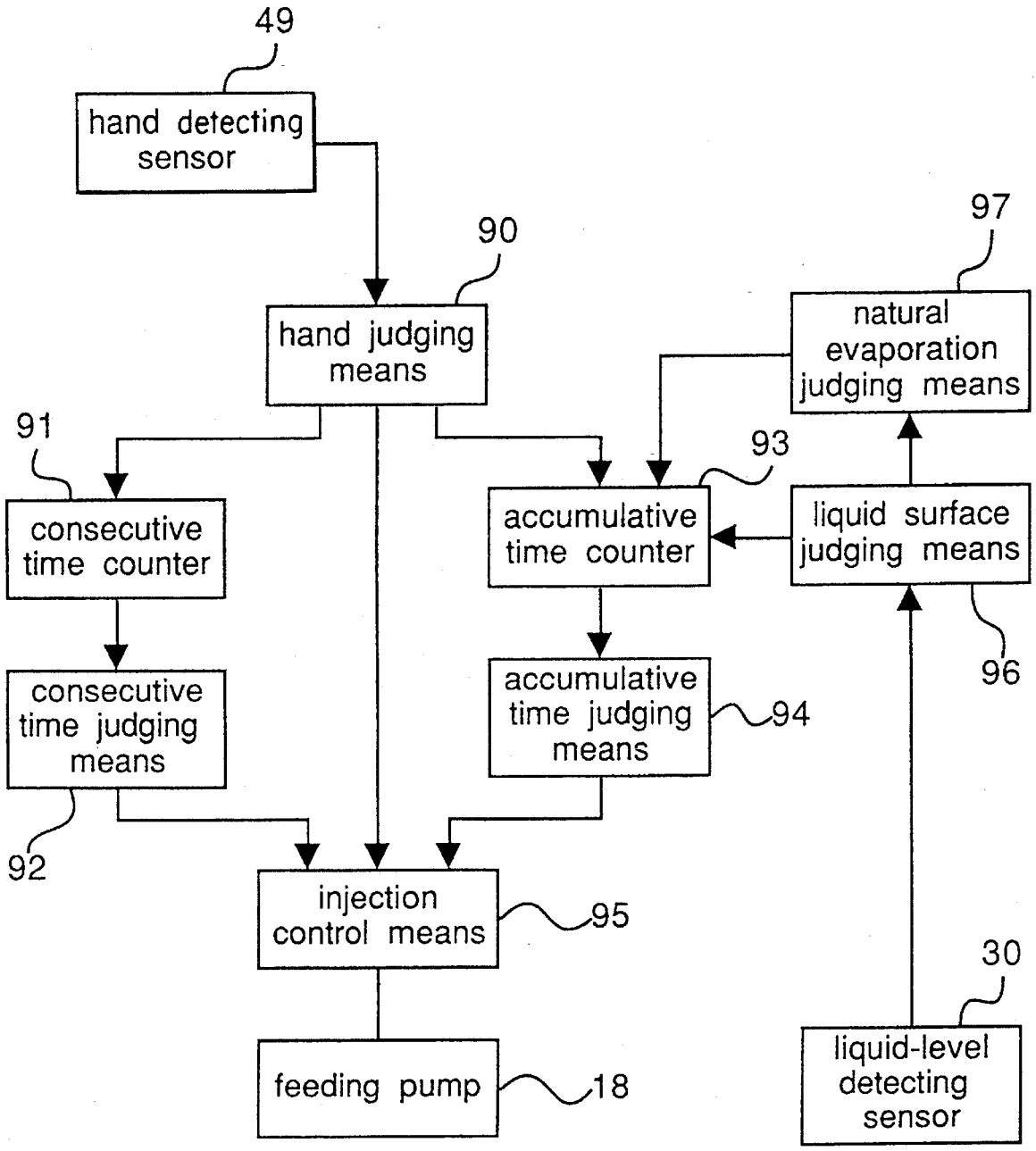
FIG. 12 is a block diagram showing the construction of the control section of the hand disinfector.

As shown in FIG. 12, the microcomputer 80 comprises a hand deciding (judging) means 90, a liquid level detecting sensor continuous (consecutive) time counter 91, a liquid level detecting sensor continuous time deciding (judging) means 92, an accumulated jetting time counter 93 serving as an accumulated flow-out rate detecting means, an accumulated operation time deciding means 94 serving as an accumulated flow amount calculating means, a jetting control means 95, a liquid level deciding (judging) means 96, and a natural evaporation deciding (judging) means 97. A signal outputted from the hand detecting sensor 49 is transmitted to the hand deciding means 90. A signal outputted from the liquid level detecting sensor 30 is transmitted to the liquid level deciding means 96. The operation of the pump 18 is controlled by an output signal of the jetting control means 95.

As will be described later, the liquid level detecting sensor continuous time counter 91 functions as both a liquid level detecting sensor continuous ON time counter and a liquid level detecting sensor continuous OFF time counter.

The process of using the hand disinfector (A) having the above-described construction is described below with reference to FIGS. 1 through 11.

Referring to FIG. 1, holding out a user's hand in a space between the hand disinfector (A) and the washstand 12, the hand detecting sensor 49 is turned on. Based on the output of the hand detecting sensor 49, the pump 19 is driven via the control section (C), and the disinfectant is jetted toward the hands from the nozzle 48, thus disinfecting the hands.

In the present invention, the nozzle 48 and the hand detecting sensor 49 are incorporated in integration with each other in the casing 41, and the jetting direction of the nozzle 48 and the light emission direction of the hand detecting sensor 49 are coincident with each other. The pivotal motion of the casing 41 allows the jetting direction of the nozzle 48 and the light emission direction of the hand detecting sensor 49 to be altered simultaneously.

Thus, even when the washstand 12 is lapped to a mirror-like surface finish, the light emission direction of the hand detecting sensor 49 can be differentiated from the direction of reflected light. Therefore, when hands are not over the washstand 12, the hand detecting sensor 49 does not operate and hence the nozzle 48 can be prevented from jetting the disinfectant by mistake.

Because the jetting direction of the nozzle 48 and the light emission direction of the hand detecting sensor are constant, the user can use the hand disinfector (A) conveniently without feeling discomfort.

Needless to say, the disinfectant in the tank 14 decreases each time the nozzle 48 is driven and thus the liquid level of the disinfectant gradually drops. As described above, the cover 13*b* can be prevented from being opened until the liquid level detecting sensor 30 detects the reference liquid level RL, i.e., until the disinfectant-replacing time comes.

Therefore, various disadvantages which may be brought about by frequent opening and closing of the cover 13*f* do not occur. That is, mixing of bacteria into the tank 14 or overflow of the disinfectant from the tank 14 which may be brought about by the removal of the cartridge 15 can be reliably prevented.

The method for using the hand disinfector (A) having the above-described construction is described below with reference to FIGS. 13 through 15.

The operation flow of the hand disinfector (A) is described below with reference to the flowchart shown in FIG. 13.

Supposing that a sufficient amount of disinfectant is contained in the cartridge 15, when the hand detecting sensor 49 detects hands held out over the washstand 12 (at step 100), the supply display lamp 77 is OFF (at step 102) because a liquid level sensor determining flag is not ON (No, at step 101). At step 103, based on turn-on of the hand detecting sensor 49, the nozzle 48 jets the disinfectant toward the hands for a period of time in which the hands are over the washstand 12 (in the range not exceeding a predetermined period of time, for example, five consecutive seconds). Because the accumulated jetting time counter 93 is cleared (step 104), the accumulated jetting time period of the nozzle 48 is not counted.

When the amount of the disinfectant in the cartridge 15 becomes small and thus the liquid level of the disinfectant in the tank 14 drops, thus reaching the reference liquid level RL, the hand detecting sensor 49 operates and as a result, the liquid level sensor determining flag is turned on (Yes, at step 101).

Based on the output of the ON signal, the accumulated jetting time counter 93 counts the subsequent accumulated operation time period of the nozzle 48, namely, the operation time period of the pump 18. Then, the supply display lamp 77 is turned on and off (at step 106) until the accumulated operation time deciding means 94 decides that a predetermined accumulated operation time period has elapsed, thus informing the user of the fact that the cartridge-replacing time is approaching.

Based on the output of the ON signal of the hand detecting sensor 49 (Yes, at step 100), the nozzle 48 is actuated, thus jetting the disinfectant (at step 107), and the accumulated jetting time period is counted (at step 108).

When it is decided by the accumulated operation time deciding means 94 (at step 105) that the predetermined accumulated operation time period has elapsed due to the use of the hand disinfector (A), the state of the supply display lamp 77 is changed to ON (at step 110) from the ON-OFF state. Even though the sensor outputs an ON signal (Yes, at step 100), the nozzle 48 does not operate (at step 111).

As described above, the operation of the nozzle 48 is continued or slopped based on the actual accumulated operation time period of the nozzle 48 after the reference liquid level RL has been attained. Therefore, the operation of the nozzle 48 can be controlled while the remaining amount of the disinfectant in the tank 14 is accurately detected and thus, the disinfector can be exhausted to the greatest degree without allowing air permeating into the pump 18.

Figure 14:
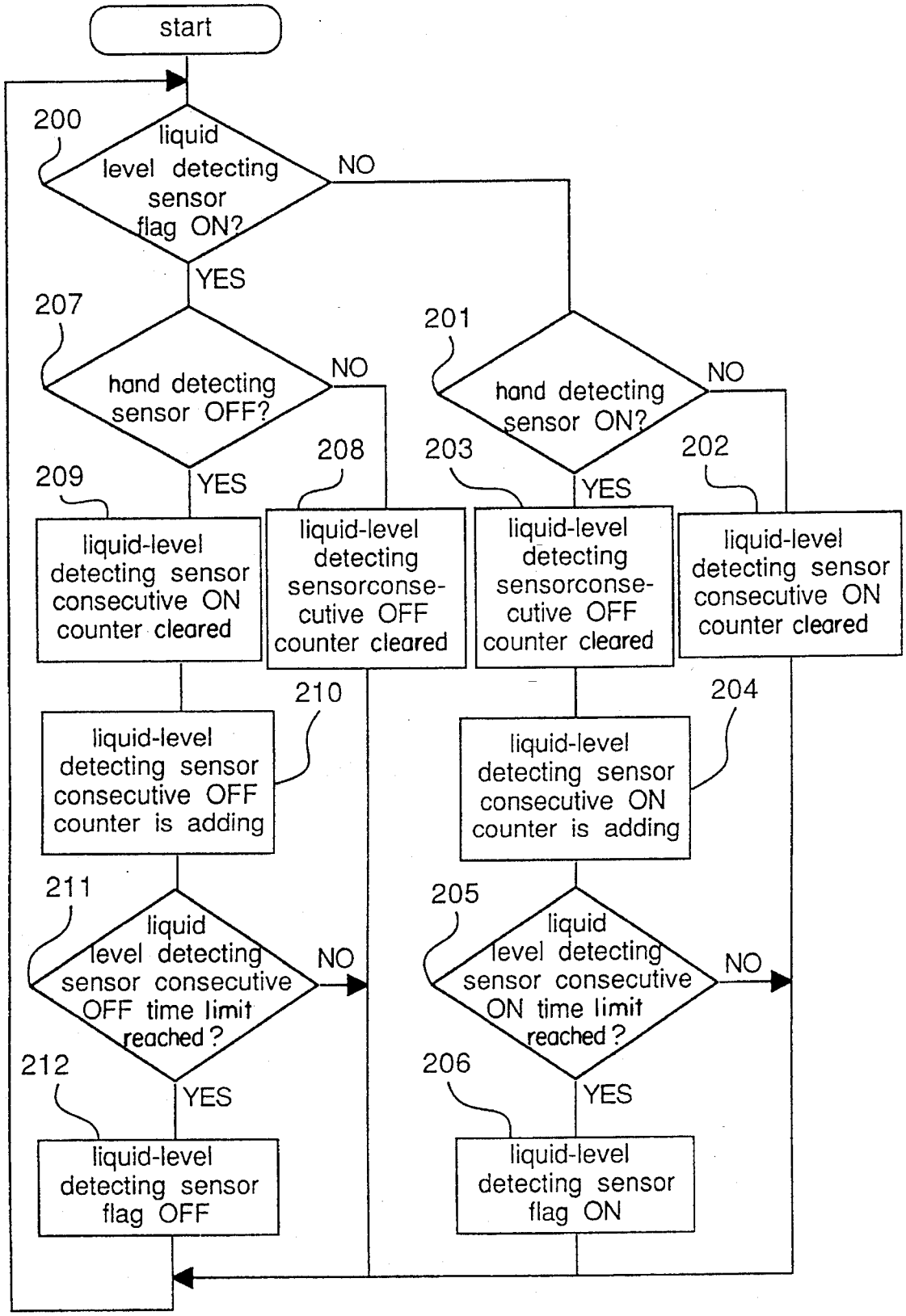
FIG. 14 is a flowchart showing the operation of a liquid level detecting sensor.

FIG. 14 shows the flow of the operation of the liquid detecting sensor.

Figure 13:
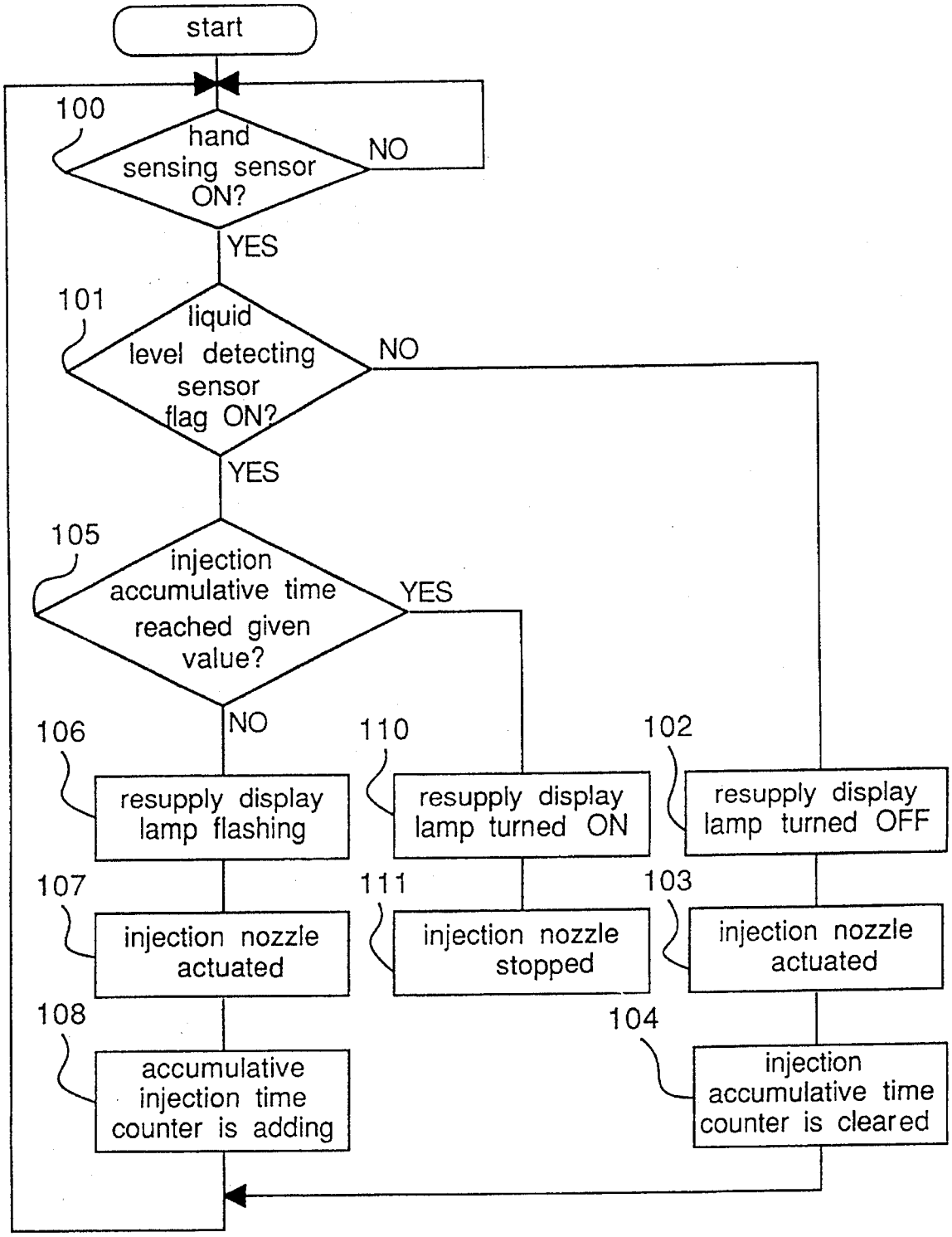
FIG. 13 is a flowchart showing a fundamental operation of a hand detecting sensor of the hand disinfector.

Similarly to the operation flow shown in FIG. 13, the liquid level sensor determining flag is not turned on (No, at step 200) in the flow of the normal operation state and thus the hand detecting sensor 49 does not operate (No, at step 202). Therefore, the liquid level detecting sensor continuous ON counter 91 is cleared (step 202) and thus the liquid level detecting sensor continuous ON counter 91 does not operate.

Then, when the hand detecting sensor 49 is turned on (Yes, at step 201), the liquid level detecting sensor continuous ON counter 91 starts to operate (at step 204), with the liquid level detecting sensor continuous OFF counter 91 cleared (at step 203). If the liquid level sensor continuous ON time period exceeds a predetermined time period, for example, two seconds (Yes, at step 205), the liquid level sensor determining flag is turned on (at step 206).

During the predetermined time period of two seconds, it is checked whether or not the liquid level in the tank 14 has reached the reference liquid level RL.

That is, during the time period of two seconds, the supply display lamp 77 is prevented from being turned on and off when the hand disinfector remains in the tank 14.

Then, when the liquid level sensor determining flag is turned on (Yes, at step 200) and the hand detecting sensor 49 is turned on (No, at step 207), the liquid level detecting sensor continuous OFF counter 91 is cleared.

When the hand detecting sensor 49 is OFF (Yes, at step 207), the liquid level detecting sensor continuous ON counter 91 is cleared (at step 209), while the operation of the liquid level detecting sensor continuous OFF counter 91 starts (at step 210).

When it is decided (Yes, at step 211) that the liquid level detecting sensor continuous OFF time period counted by the liquid level detecting sensor continuous OFF counter 91 exceeds a predetermined period of time, for example, three seconds, the liquid level sensor determining flag is turned on (at step 211).

During three seconds, it is checked whether or not the cartridge 15 has been replaced and the tank 14 has been supplied with the disinfectant.

That is, three seconds is set to prevent the accumulation of the flow rate of the hand disinfector from being prevented.

The reason three seconds are set at step 211 is as follows: That is, at step 205, as apparent from the flow of FIG. 14, an erroneous display continues for three seconds even though the liquid level detecting sensor continuous ON time is shorter than two seconds, whereas at step 211, the counter for counting accumulated time period is cleared. As a result, the pump 18 idles. For this reason, it is necessary to set the liquid level detecting sensor continuous OFF time period to a possible longer period of time.

FIG. 15 shows another operation flow of the liquid level detecting sensor 30.

In this operation flow, a function of detecting (at step **207*a*) whether or not the supply display lamp 77 is ON and a function of turning off the supply display lamp 77 (at step 214) are added to the operation of FIG. 12**.

That is, in this operation flow, when the cartridge-replacing operation is performed, it is checked (at step **207*a*) whether the supply display lamp 77 is ON or OFF. If the supply display lamp 77 is ON, the supply display lamp 77 is turned off (at step 214**) immediately.

If the supply display lamp 77 is not ON, the program goes to step 209.

Preferably, in the operation flow of FIG. 14, the liquid level detecting sensor continuous OFF time period (at step 207) is set to a possible longest time period. But if the liquid level detecting sensor continuous OFF time period is set to a very long time period, a time period in which the supply display lamp 77 is not turned off becomes long. This problem can be solved by adding steps **207*a* and 214 to the operation flow of FIG. 14**.

Figure 16:
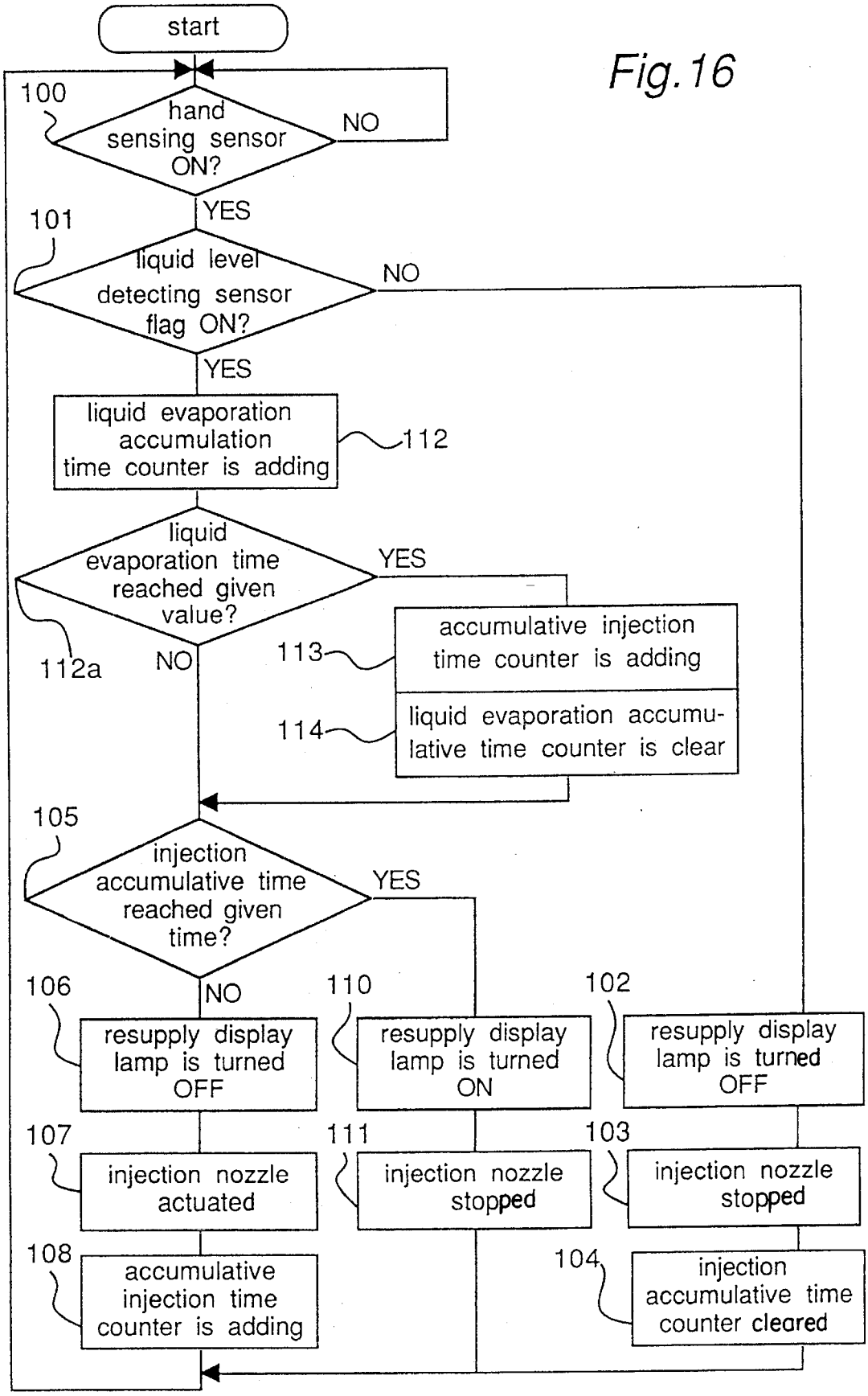
FIG. 16 is a flowchart showing the fundamental operation of the hand detecting sensor having an evaporation amount correcting function.

In the operation flow shown in FIG. 16, a function of correcting the evaporation amount of the disinfectant from the tank 14 to the outside is added to the fundamental operation of the hand disinfector (A) shown in FIG. 13 added to.

That is, in the fundamental operation flow of the hand disinfector (A) shown in FIG. 13, when the liquid level of the disinfectant in the tank 14 has reached the reference liquid level RL, the hand detecting sensor 49 operates and the liquid level sensor determining flag is turned on (No, at step 101). Based on the ON signal outputted from the hand detecting sensor 49, the accumulated jetting time counter 93 counts the accumulated operation time period of the nozzle 48, and the deciding means 94 decides (at step 105) whether or not the accumulated operation time period has reached the predetermined accumulated operation time period.

In the first embodiment, in order to correct the evaporation amount of the disinfectant from the tank 14, the following flow is provided. That is, when the liquid level sensor determining flag is turned on (No, at step 101), a liquid evaporation accumulated time period counter counts a liquid evaporation accumulated time period (at step 112). If the liquid evaporation accumulated time period does not become a predetermined value, the deciding means 94 decides (at step 105) whether or not a time period counted by the counter has reached the predetermined accumulated operation time period, as performed in the fundamental flow shown in FIG. 13. When it is decided that the liquid evaporation accumulated time period has reached the predetermined value, the liquid evaporation accumulated time period is converted into a jetting time period and then, the obtained jetting time period is added to an accumulated jetting time period (at step 113). Then, the liquid evaporation accumulated time period counter is cleared (at step 114). Then, it is decided (at step 105) by the deciding means 94 whether or not the accumulated jetting time period has reached the predetermined accumulated operation time period.

The function of correcting the evaporation amount of the disinfectant from the tank 14 to the outside is added to the fundamental operation flow of the hand disinfector (A). Therefore, the remaining amount of the disinfectant in the tank 14 can be detected more accurately and thus the disinfectant can be used without loss.

Accordingly, the disinfectant can be exhausted to the maximum and the pump 18 can be prevented from idling and air can be prevented from penetrating into the pump 18.

In the first embodiment, the counter for counting the accumulated jetting time period of the nozzle 48, namely, the accumulated drive time period of the pump 18 is employed as a means for detecting the accumulated flow-out rate. But not only the means for detecting accumulated flow-out amount, but also a means for detecting the number of rotations of the motor 36 of the pump 18 or a flow meter for measuring the flow rate of the disinfectant from the tank 14 to the nozzle 48 may be used.

In the first embodiment, the drive time period of the motor 36 of the pump 18 is regarded as the flow-out rate of the disinfectant. If the motor 36 is driven in a short time repeatedly, errors are liable to occur in the flow rate of the disinfectant from the tank 14 to the nozzle 48. For example, the flow-out rate of the disinfectant in driving the pump 18 for consecutive five seconds may be different from that in driving the pump 18 for the same time period (five seconds) by driving it for one second per drive.

Therefore, it is possible to provide the hand disinfector (A) with a means for correcting errors which may occur depending on the drive time period of the pump 18 so that corrected values are accumulated with each other. In this manner, the accumulated drive time period of the pump 18 can be regarded as an accurate accumulated flow rate of the disinfectant.

In the first embodiment, the following effects can be obtained: The main body accommodates the jetting nozzle and the hand detecting sensor installed alongside of the jetting nozzle in the main body of the disinfector. The jetting direction of the jetting nozzle and the light emission direction of the hand detecting sensor are coincident with each other, and the jetting nozzle and the hand detecting sensor can be pivotally moved in unison. Accordingly, a malfunction which may occur due to the difference in the configurations of receiving container such as a receiving plate or a washstand and the kind of the material of the receiving container can be solved by merely altering the light emission direction of the hand detecting sensor.

Further, because the jetting direction of the jetting nozzle and the light emission direction of the hand detecting sensor are always coincident with each other, a user can use the jetting apparatus conveniently without feeling discomfort.

In addition, in the jetting apparatus according to the first embodiment, liquid is fed under pressure from the liquid storing tank having the cover, which can be opened, to the jetting nozzle via the pump. In this construction, when it is detected by the liquid level detecting sensor that the liquid level of the disinfectant has reached the predetermined disinfectant-replacing level, the cover-locking device unlocks the cover. As a result, the cover can be opened.

Therefore, various disadvantages which may be brought about by frequent opening and closing of the cover do not occur. That is, mixing of bacteria into the tank or overflow of the disinfectant from the tank which may be brought about by the removal of the cartridge can be reliably prevented.

Furthermore, the hand disinfector comprises the liquid level detecting means for detecting that the level of the liquid stored in the liquid storing tank has dropped to a reference level; the supply display lamp actuated based on an ON signal outputted from the liquid level detecting means and makes a display that a liquid-replacing time has approached; accumulated flow-out amount detecting means actuated based on the ON signal outputted from the liquid level detecting means, thus detecting an accumulated flow-out amount of the liquid after the level thereof drops below the reference level; and accumulated flow-out amount calculating means for calculating the accumulated flow-out amount of the liquid based on a value detected by the accumulated flow-out amount detecting means. The operation of the pump is stopped when a value calculated by the accumulated flow-out amount calculating means has reached a predetermined tolerance flow-out amount. Therefore, the operation of the jetting nozzle can be controlled by accurately detecting the remaining quantity of the disinfectant in the disinfectant storing tank. Thus, the disinfector can be exhausted to the greatest degree, with air prevented from penetrating into the pump.

Second Embodiment

A hand disinfector according to a second embodiment of the present invention is described below with reference to FIGS. 17 through 27.

The construction of the hand disinfector (A) is described below with reference to FIGS. 17 through 27.

FIG. 1 shows a state in which the hand disinfector (A) is installed on a wall surface 11 of a hospital room 10 at a position above a washstand 12 mounted thereon.

FIGS. 17 through 22 show the detailed construction of the hand disinfector (A). First, the fundamental construction of the hand disinfector (A) is described below.

Figure 18:
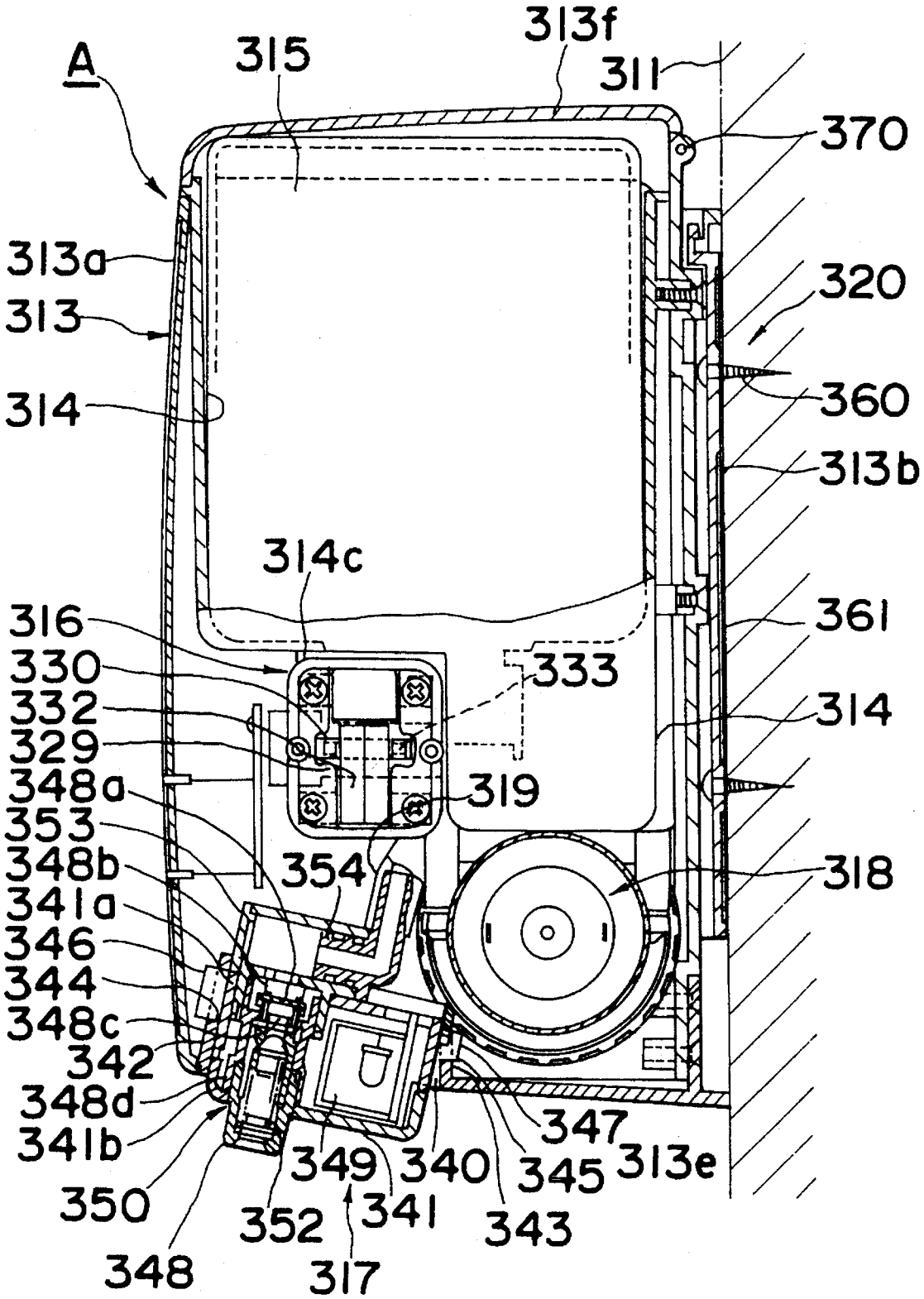
FIG. 18 is a right sectional side view showing the hand disinfector shown in FIG. 17.

As shown in FIG. 18, a rectangular casing 313 accommodating the hand disinfector (A) is removably installed on the wall surface 311 by an installing means 320 which will be described later.

Figure 17:
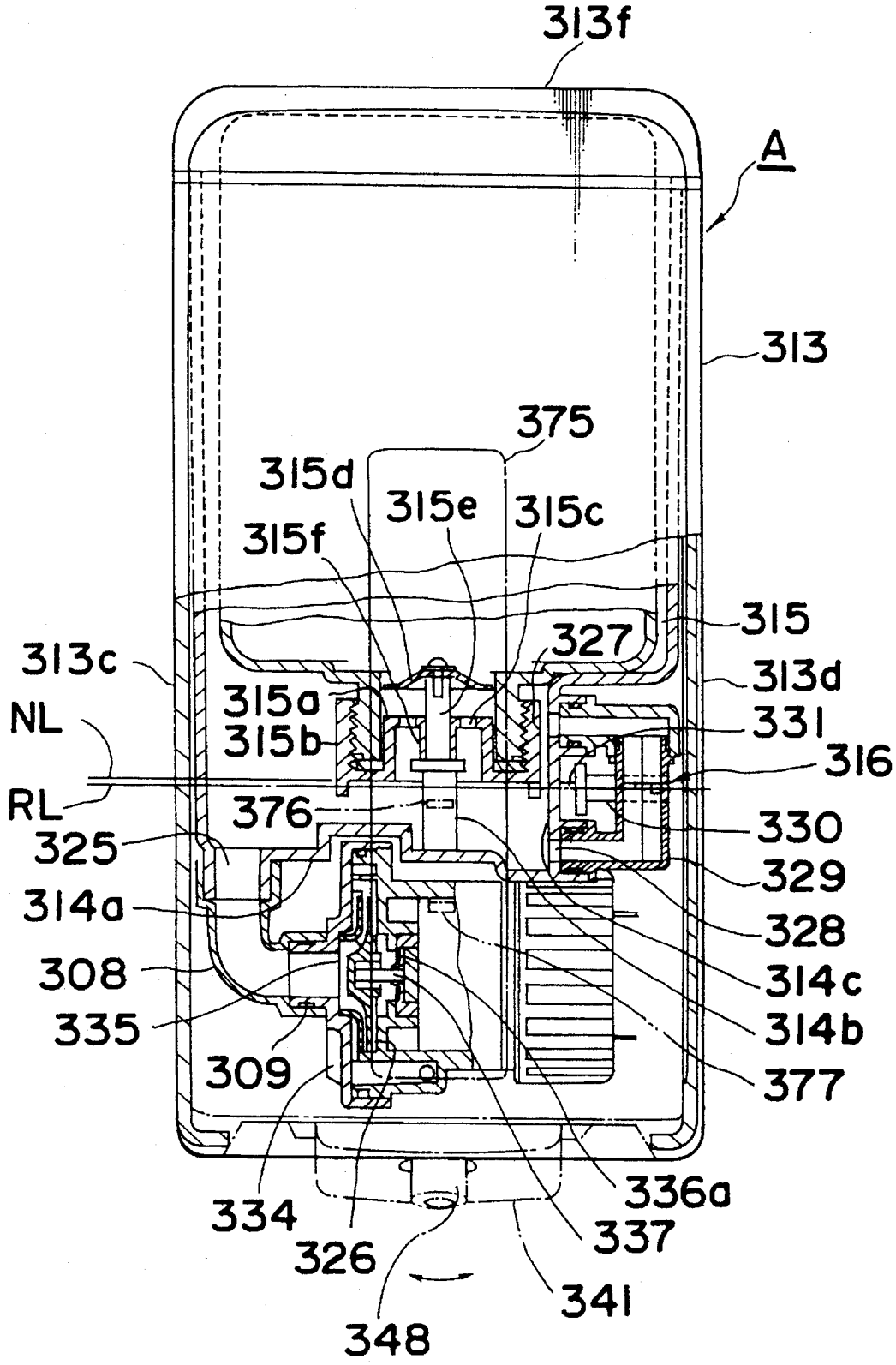
FIG. 17 is a partial cut-away front view showing a hand disinfector according to a second embodiment of the present invention.
Figure 19:
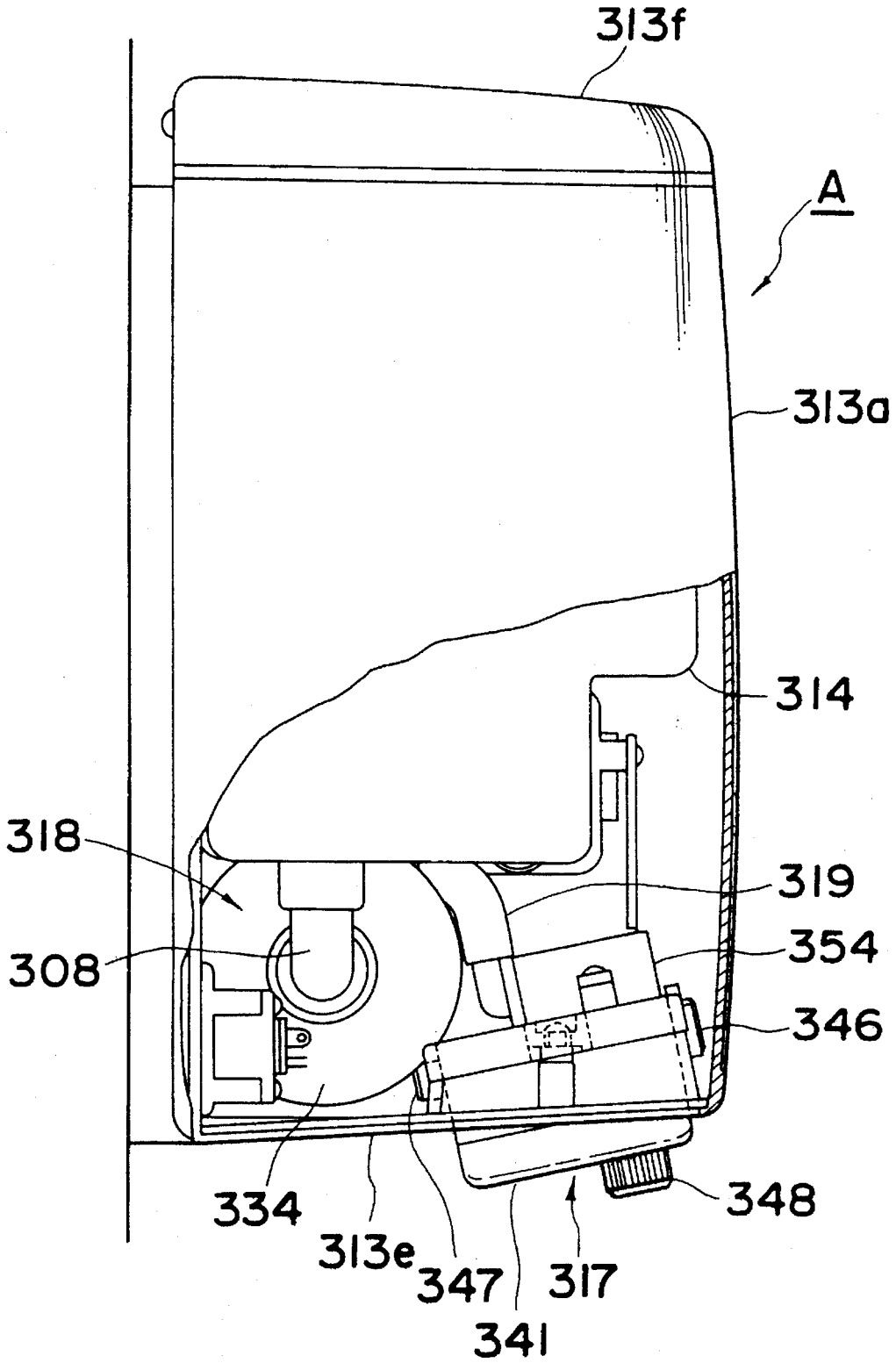
FIG. 19 is a left partial cut-away side view showing the hand disinfector.
Figure 20:
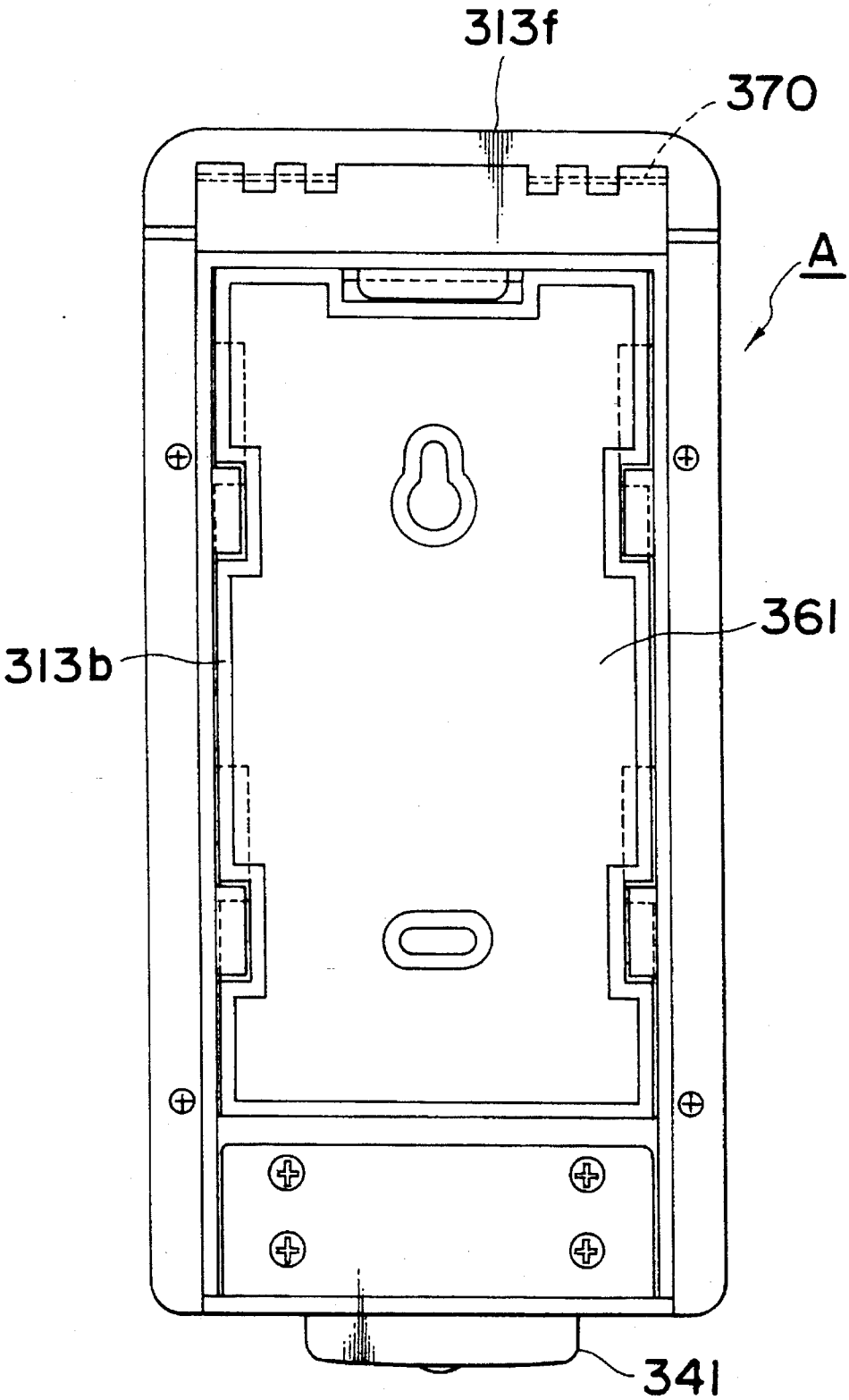
FIG. 20 is a rear view showing the hand disinfector.

As shown in FIGS. 17 through 19, the casing 313 comprises a front wall 313*a*, a rear wall 313*b*, left and right walls 313*c* and 313*d*, a bottom wall 313*e*, and an airtight cover 313*f* disposed on the upper end of the casing 313 and can be opened and closed.

As shown in FIGS. 15 and 16, a disinfectant storing tank 314, in a rectangular solid configuration, which is open in the upper end thereof is disposed in an upper space of the casing 313. The tank 314 accommodates a replaceable disinfectant cartridge 315 in a rectangular solid configuration.

As shown in FIGS. 2 and 3, a liquid level detecting portion 316 for detecting the remaining amount of the disinfectant in the tank 314 is installed at a corner of the lower portion of the tank 314.

As shown in FIGS. 17 through 18, the casing 313 accommodates, in a lower space thereof, a disinfectant jetting portion 317 capable of jetting the disinfectant fed from the tank 314 toward hands held out over the bowl of the washstand 312 and a pump 318 for feeding the disinfectant under pressure from the tank 315 to the disinfectant jetting portion 317 via a disinfectant feeding pipe 319.

The pump 318 is disposed above the disinfectant jetting portion 317.

In the above construction, the actuation of the pump 318 allows the disinfectant contained in the tank 314 to be fed to the disinfectant jetting portion 317 via the disinfectant feeding pipe 319. The disinfectant is jetted from the disinfectant jetting portion 317 toward hands held out over the bowl of the washstand 312, thus sterilizing the hands effectively.

Because the tank 314, the pump 318, and the disinfectant jetting portion 317 are disposed in the order of the tank 314—the pump 318—the disinfectant jetting portion 317 in the casing 313 from top to bottom thereof without depending greatly on the disinfectant feeding pipe 319 for the feeding of the disinfectant. Therefore, the resistance of the disinfectant feeding pipe 319 to the disinfectant can be reduced and hence the compact casing 313, namely, the compact hand disinfector (A) can be provided.

Even though the remaining amount of the disinfectant in the tank 314 decreases, the hand disinfector (A) is stable on the wall surface 311 because the lower portion of the casing 313 is heavy.

The detailed description of each construction of the hand disinfector (A) is described below.

Construction of Disinfectant Storing Tank 314 and Disinfectant Cartridge 315

A shaft 314*b* which is brought into contact with a valve lever is formed in the center of a bottom plate 314*a* of the tank 314.

A disinfectant storing cartridge 315 accommodated in the tank 314 has a valve construction on the upper end thereof. The valve construction comprises a removable cap 315*b*, the center portion 315*a* of which is concaved; a plurality of valve openings 315*c* formed in the center portion 315*a*; an umbrella-shaped valve 315*d* opening and closing the valve openings 315*c* from the inside of the cartridge 315; a valve lever 315*e* which penetrates through the center portion 315*a* and one end of which is installed on the umbrella-shaped valve 315*d* and other end of which can contact the upper end surface of a contact shaft 314*b* of the tank 314; and a spring 315*f* urging the valve lever 315*e* toward the outside.

In this construction, when the valve lever 315*e* is not installed on the tank 314, the valve lever 315*e* of the cartridge 315 is urged toward the outside by the spring 315*f* as described above. Therefore, the umbrella-shaped valve 315*d* reliably closes the valve opening 315*c*, thus preventing the disinfectant from flowing out from the cartridge 315.

When the valve lever 315*e* has been installed on the tank 314, the valve lever 315*e* is brought into contact with the contact shaft 314*b*, thus pressing the umbrella-shaped valve 315*d* into the cartridge 315 against the urging force of the spring 315*f*. As a result, the umbrella-shaped valve 315*d* moves away from the center 315*a*, thus opening the valve opening 315*c*. Accordingly, the disinfectant can be flowed out from the cartridge 315.

The liquid level of the disinfectant which has flowed into the tank 314 is maintained at a normal liquid level NL by atmospheric pressure.

The normal liquid level NL starts to drop after the disinfectant inside the cartridge 315 is exhausted.

A disinfectant flow-out opening 325 formed in the front periphery of the bottom plate 314*a* of the tank 314 communicates with the center inflow port 309 of an impeller chamber 326 of the pump 318, which will be described later, via a flexible L-shaped rubber pipe 308.

Liquid Level Detecting Section 316

As shown in FIGS. 17 through 19, the liquid level detecting section 316 is disposed in a concave space formed in a corner of a lower portion of the tank 314.

As shown in FIG. 17, upper and lower liquid communication openings 327 and 328 are formed on a lower side wall 314*b* of the tank 314 with a certain interval provided vertically therebetween. Each end of a transparent communication pipe 329 U-shaped in a side view communicates with the upper and lower communication openings 327 and 328.

Figure 21:
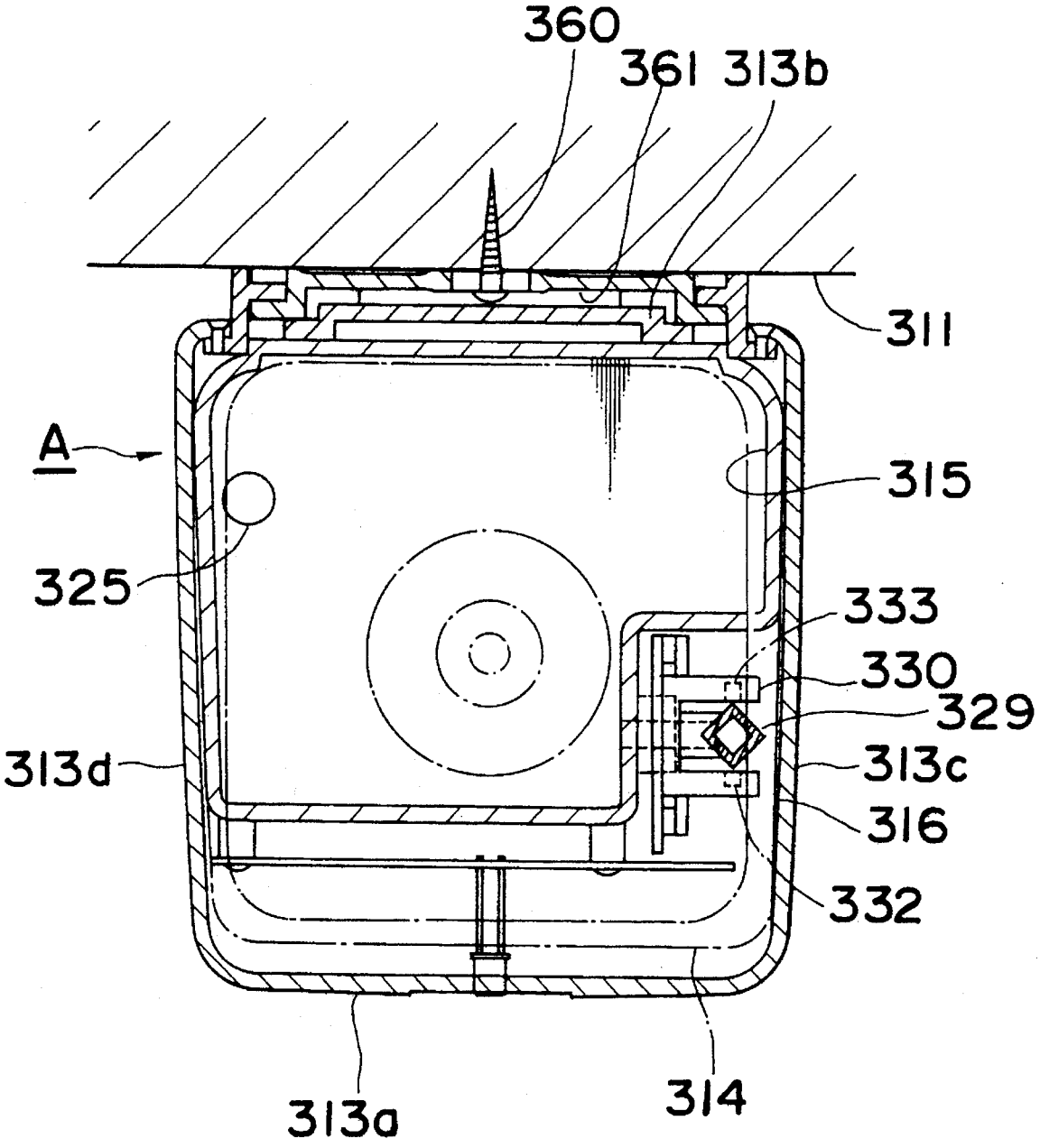
FIG. 21 is a sectional plan view showing the hand disinfector.
Figure 22:
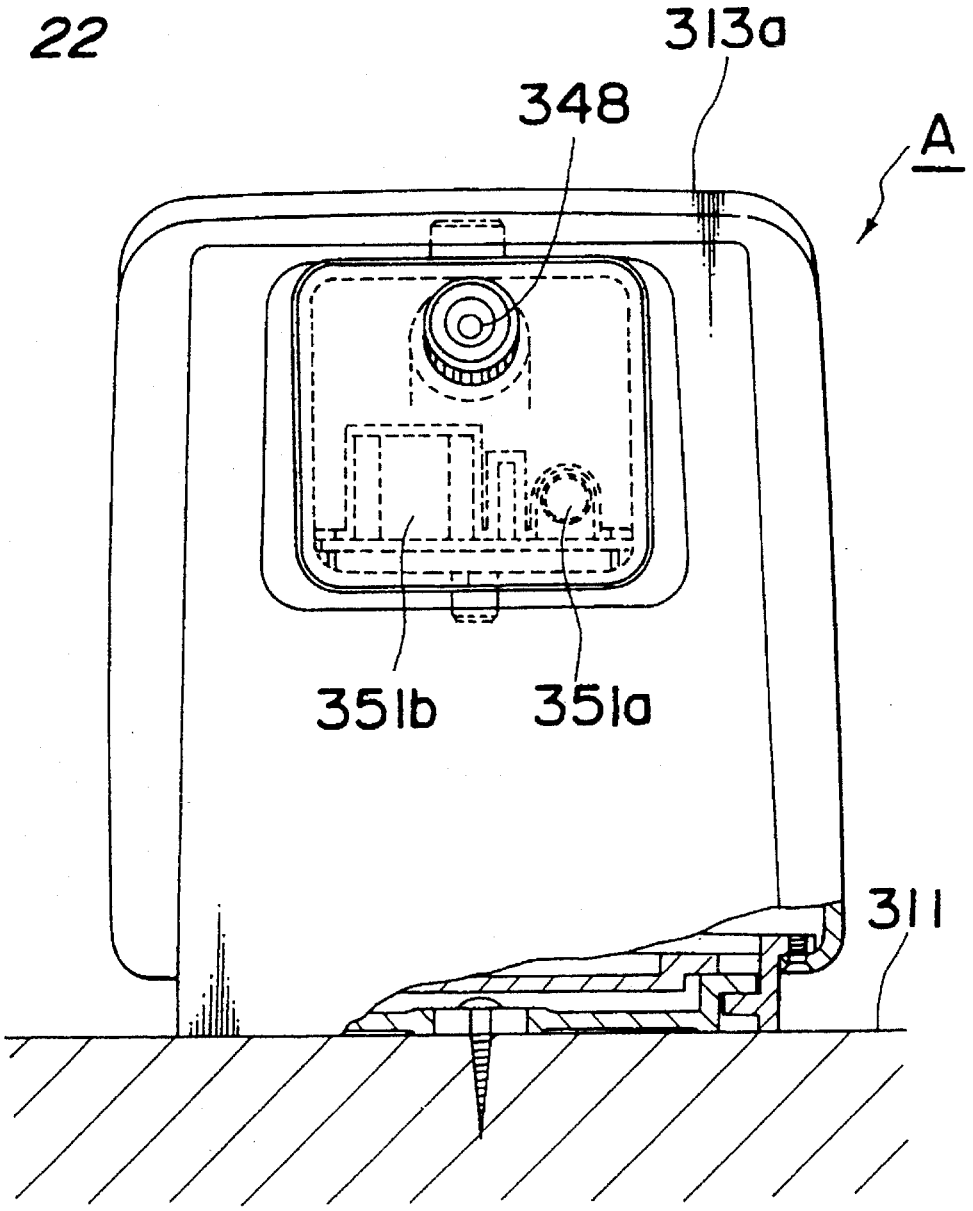
FIG. 22 is a bottom view showing the hand disinfector.

As shown in FIGS. 17 and 21, a liquid level detecting sensor 330 U-shaped in a plan view is installed on the lower side wall 314*b* of the tank 314 via an installing bracket 331. A light emission element 332 and a light receiving element 333 embedded in each end of the liquid level detecting sensor 330 are opposed to each other with the transparent communication pipe 329 interposed therebetween.

The portion, of the transparent communication pipe 329, sandwiched between the light emission element 332 and the light receiving element 333 is sectionally rhombic as shown in FIG. 7 used to described the first embodiment.

Accordingly, when the liquid level in the tank 314 is at the normal liquid level NL in a normal state, the liquid level of the disinfectant in the transparent communication pipe 329 is the same as that of the disinfectant in the tank 314.

Referring to FIG. 7, light emitted by the light emission element 332 is refracted in accordance with the refractive index of water, thus passing through the transparent communication pipe 329 and being discharged to the outside as shown by a dotted line (a) of FIG. 7. Therefore, the light receiving element 333 does not receive the light, thus outputting an OFF Signal.

When the liquid level of the disinfectant has dropped to a reference liquid level RL, namely, a warning liquid level, the liquid level in the transparent communication pipe 329 is disposed below the line connecting the light emission element 332 and the light receiving element 333. Therefore, the light emitted by the light emission element 332 is refracted in accordance with the refractive index of air, thus passing through the transparent communication pipe 329 and being received by the light receiving element 333 as shown by a solid line (b) of FIG. 7. As a result, the light receiving element 333 outputs an ON signal.

The transparent communication pipe 329 may be circular or channel in its sectional configuration.

Pump 318

Referring to FIG. 17, the pump 318 disposed with its shaft extending horizontally comprises an impeller casing 334 vertically extending and accommodating an impeller chamber 326; an impeller 335 rotatable and vertically extending in the impeller casing 334; and a motor 336 horizontally extending and integral with the rear portion of the impeller casing 334. The impeller 335 is fixed to the leading end of an output shaft 337 of the motor 336.

In the pump 318, the center inflow port 309 of the impeller casing 334 communicates with an outflow port 325 of the tank 314 by means of the flexible L-shaped rubber pipe 308.

Because the pump 318 is disposed with its shaft extending horizontally, the disinfectant flowing from the outflow port 325 of the tank 314 into the impeller casing 334 of the pump 318 can be effectively prevented from penetrating into the motor 336 through a water-proof seal 336*a* thereof. In this manner, the motor 336 can be reliably prevented from being burned.

Figure 24:
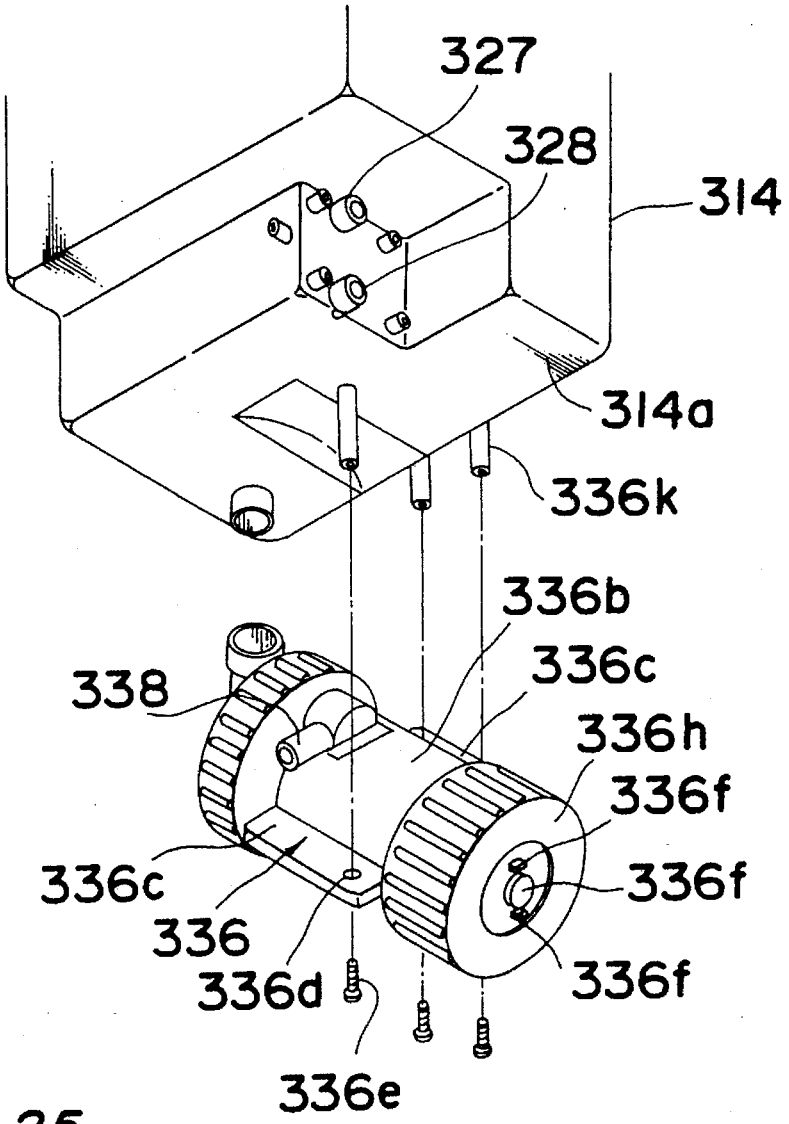
FIG. 24 is an exploded perspective view showing the lower portion of the hand disinfector.

As shown in FIG. 24, a disinfectant flow-out opening 338 formed on the periphery of the impeller chamber 326 communicates with the base portion of the disinfectant feeding pipe 319.

In this construction, the impeller 335 is rotated by the motor 336 and as a result, the disinfectant in the tank 314 can be fed under pressure to the disinfectant jetting portion 317, which will be described later, via the pump 318 and the disinfectant feeding pipe 319.

Further, the motor 336 is connected with the tank 314 via an elastic means, as will be described below.

Figure 23:
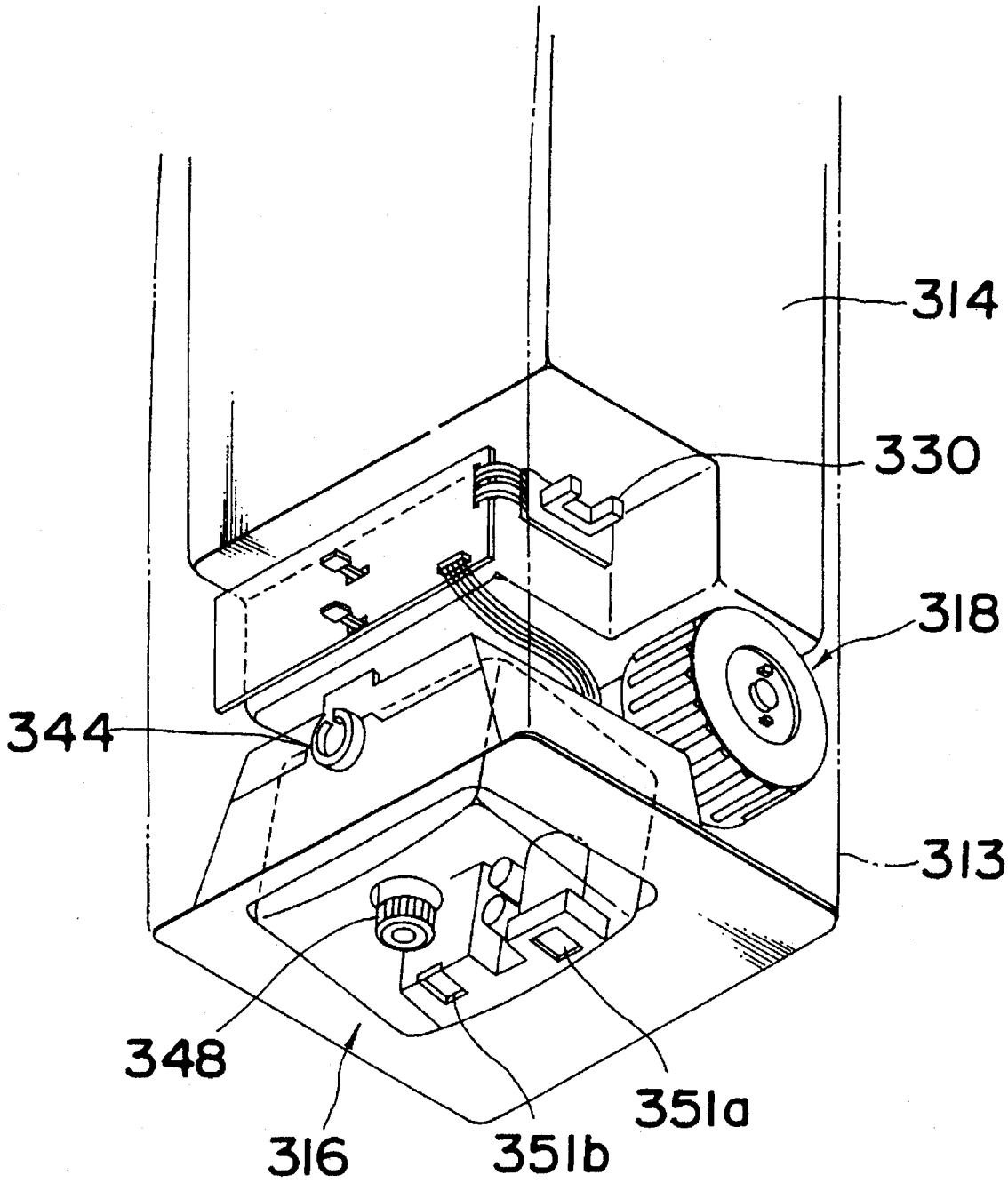
FIG. 23 is a perspective view showing a lower portion of the hand disinfector.
Figure 25:
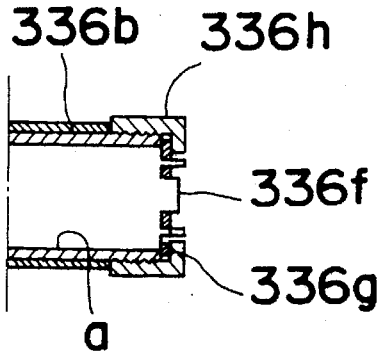
FIG. 25 is a partial sectional view showing the construction of a motor for driving a pump of the hand disinfector.

Referring to FIGS. 23 through 25, a thick elastic cylindrical member 336*b* made of an elastic material such as rubber is mounted on the peripheral surface of a drum portion 336*a* of the motor 336. A pair of flanges 336*c* having a certain width and extending axially is formed in integration with the elastic cylindrical member 336*b* at both sides thereof. A bolt inserting opening 336*d* is formed on each flange 336*c*.

A plurality of bolt screwing shafts 314*d* is formed on the rear surface of the bottom plate 314*a* of the tank 314.

In order to support the pump 318, after a connecting bolt 336*e* is inserted into each opening 336*d* formed on the flange 336*c* of the cylindrical member 336*b*, each connecting bolt 336*e* is screwed on each of the bolt inserting shafts 314*d* formed on the bottom plate 314*a* of the tank 314.

Because the cylindrical member 336*b* having a sufficient vibration-absorbing capability is interposed between the pump 318 and the opening 336*d*, vibrations generated by the driven pump 318 are absorbed by the cylindrical member 336*b* and thus prevented from being transmitted to the tank 314. Thus, the generation of unpleasant sounds can be prevented during the operation of the pump 318. That is, the hand disinfector (A) can be used without generating noises.

The cylindrical member 336*b* can be reliably mounted on the drum portion 336*a* of the motor 336 by forming a guide projection 336*f* on the end surface of the rear portion of the drum portion 336*a*, installing a water-proof sheet 336*g* made of a water-proof material such as rubber on the cylindrical member 336*b* via the guide projection 336*f*, screwing a cap 336*h* on a rear portion of the drum portion 336*a*, and pressing the leading end of the cap 336*h* on the rear end of the cylindrical member 336*b*.

The water-proof sheet 336*g* is used to prevent liquid from penetrating into the motor 336.

Disinfectant-Jetting Portion 317

As shown in FIGS. 17 through 19 and 22, a rectangular jetting section-installing opening 340 is mounted on the center of the front portion of the bottom wall 313*e* of the casing 313 inclined upward from the wall surface 311 to the front. The inclination of the installing opening 340 is equal to that of the bottom wall 313*a*. A casing 341 of a rectangular solid jetting section is provided in the opening 40. The axis of the casing 341 is directed toward the center of the bowl of the washstand 312 disposed below the casing 341.

Bearing brackets 342 and 343 integral with the bottom wall 313*a* of the casing 313 vertically extend at the front and rear portions of the opening 340, respectively. Bearings 344 and 345 are formed on an upper portion of each of the brackets 342 and 343.

Shafts 346 and 347 installed on the upper portion of each of the front and rear walls of the casing 341 are rotatably mounted on the bearings 344 and 345, respectively.

Referring to FIG. 17, in this construction, the casing 341 pivots within a predetermined angle (for example, 15°) right-to-left or vice versa on the shafts 346 and 347.

Figure 26:
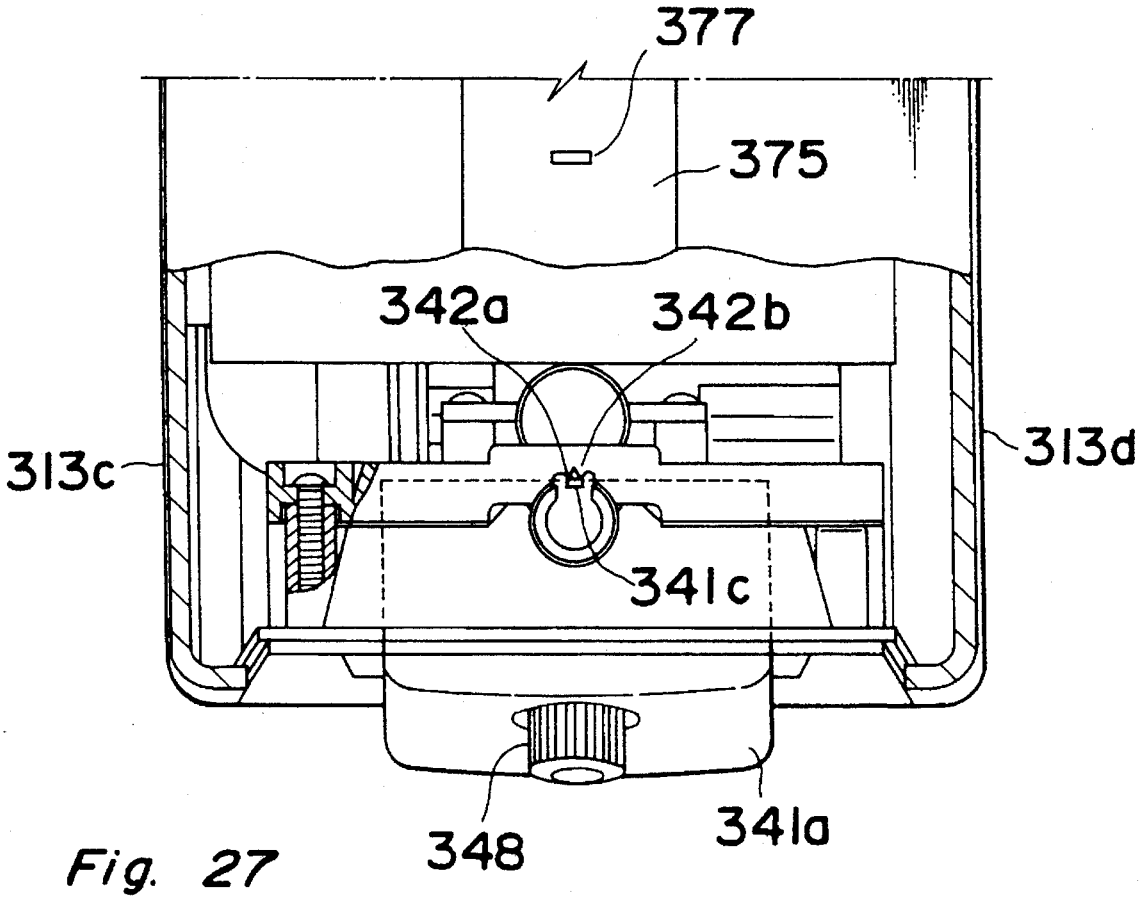
FIG. 26 is an enlarged explanatory view showing the construction of the lower portion of the hand disinfector.

Referring to FIG. 26, a pair of ribs 342*a* and 342*b* is formed in the center of the bracket 342. In the center of the casing 341, a rib 341*c* is formed in correspondence to the ribs 342*a* and 342*b*.

The rib 341*c* passes over the ribs 342*a* and 342*b* in the pivotal motion of the casing 341 in the pivotal motion of the casing 341. In this manner, the casing 341 can pivot in the above-described angle.

The internal construction of the casing 341 comprising the cylindrical main body 341*a* and a bottom plate 341*b* is described below.

As apparent from FIGS. 18 and 23, the casing 341 accommodates a jetting nozzle 348 disposed alongside a hand detecting sensor 349 in the same direction as that of the axis of the casing 341. The leading end of the nozzle 348 projects downward in penetration through a transparent opening 350 formed on the bottom plate 341*b*. A white color light emission filter 351*a* and a black color light-receiving filter 351*b* are formed on a portion, of the bottom plate 341*b*, opposed to a light-receiving portion 349*a* of the hand detecting sensor 349 and a portion, of the bottom plate 341*b*, opposed to a light emission portion 349*b* thereof, respectively.

In the first embodiment, the casing 341 accommodates the jetting nozzle 348 and the hand detecting sensor 349 integral with each other and installed inside. The jetting direction of the jetting nozzle 348 and the light emission direction of the hand detecting sensor 349 are coincident with each other.

The jetting direction of the jetting nozzle 348 and the light emission direction of the hand detecting sensor. 349 can be simultaneously altered due to the pivotal motion of the casing 341.

Accordingly, a malfunction which may occur due to the difference in the configurations of the bowl of the washstand 312 and the difference in the materials thereof can be solved by merely altering the light emission direction of the hand detecting sensor 349.

Because the jetting direction of the jetting nozzle 348 and the light emission direction of the hand detecting sensor 349 are always coincident with each other, a user can use the jetting apparatus conveniently without feeling discomfort.

Figure 27:
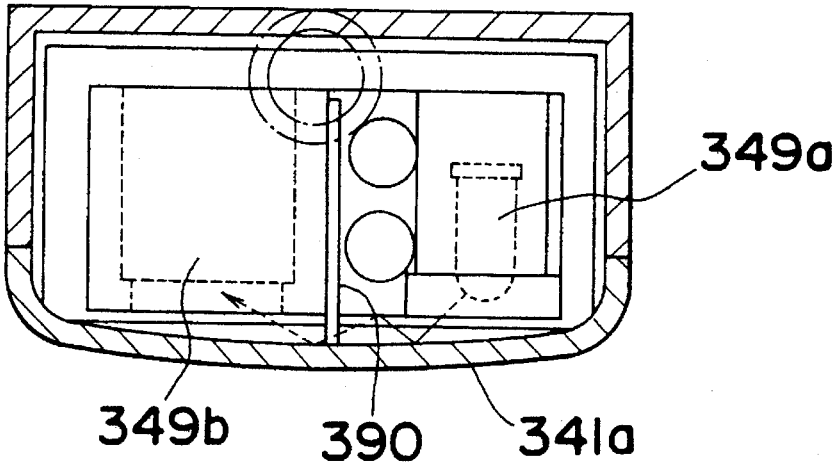
FIG. 27 is an explanatory view showing the construction of a hand detecting sensor of the hand disinfector.

Referring to FIG. 27, because the bottom plate 341*b*, of the casing 341, made of a colored transparent material has a curved surface, there is a possibility that a part of light emitted by the light emission portion 349*a* is reflected on the inner portion of the colored transparent material, thus leaking to the light-receiving portion 349*b*. In order to overcome this problem, a light-shielding plate 390 is formed between the light emission portion 349*a* and the light-receiving portion 349*b*.

Referring to FIG. 18, in the casing 341, a check valve 352 is formed on the upper end of the nozzle 348. The check valve 352 communicates with the leading end of the flexible disinfectant feeding pipe 319 via a pipe coupling 353 and an elbow 354 both integral with the check valve 352.

Referring to FIG. 18, a sealing plate 348*a* provided with an O ring is disposed in an upper space of a communicating opening 348*c* disposed on the base portion of the nozzle 348, with the sealing plate 348*a* urged by a spring 348*b* toward the communicating opening 348*c*.

Referring to FIG. 18, the sealing plate 348*a* opens the communicating opening 348*c* when the nozzle 348 is mounted on a nozzle casing 348*d*, whereas the sealing plate 348*a* closes the opening 348*c* by means of the urging force of the spring 348*b* when the nozzle 348 is removed from the nozzle casing 348*d* for maintenance, thus reliably preventing leakage of liquid.

Installing Construction of Casing 313 on Wall Surface 311

As apparent from FIGS. 18 and 21, in the second embodiment, a rectangular installing plate 361 is installed on the wall surface 11 by means of a bolt 360 so that the rear wall 313*b* of the casing 313 is fixed to the installing plate 361. In this manner, the hand disinfector (A) can be easily installed on the wall surface 311.

Construction of Opening/Closing Cover 313*f*

As shown in FIG. 18, the airtight cover 313*f* formed on an upper portion of the casing 313 pivots vertically on a shaft 370 comprising such as a spring pin installed on the base portion thereof.

Display Construction of Casing 313

As shown in FIG. 1, a state display portion 75 formed on the front wall 313*a* has a power source display lamp 76 and a supply (of disinfectant) display lamp 77.

As will be described later, the supply display lamp 77 is turned on and off when the liquid level in the tank 314 has reached the reference liquid level RL, thus informing a user of the fact that cartridge-replacing time is approaching.

It is possible to provide the following method for turning on the supply display lamp 77. That is, the drive time period of the motor 336 of the pump 318 may be replaced with flow rate, and a capacity ranging from the reference liquid level RL to a degree of the liquid level at which the pump 318 does not idle may be set. In this method, when the capacitance has reached an accumulated flow rate, the supply display lamp 77 is turned on.

Control Section

A control section (C) is provided inside the casing 313 of the hand disinfector (A). The construction of the control section (C) is as shown in FIGS. 11 and 12 used to describe the first embodiment. The reference numbers in the following discussion of control section (C) have been increased by 300 to denote the second embodiment.

As shown in FIG. 11, the control section (C) comprises a microcomputer 380. An input side interface 381 of the microcomputer 380 is connected with the liquid level detecting sensor 330 and the hand detecting sensor 349. An output side interface 382 of the microcomputer 380 is connected with a motor driving circuit 383 of the pump 318, the power source display lamp 376, and the supply display lamp 377.

As shown in FIG. 12, the microcomputer 380 comprises a hand deciding means 390, a liquid level detecting sensor continuous time counter 391, a liquid level detecting sensor continuous time deciding means 392, an accumulated jetting time counter 393 serving as an accumulated flow-out rate detecting means, an accumulated operation time deciding means 394 serving as an accumulated flow amount calculating means, a jetting control means 395, a liquid level deciding means 396, and a natural evaporation deciding means 397. A signal outputted from the hand detecting sensor 349 is transmitted to the hand deciding means 390. A signal outputted from the liquid level detecting sensor 330 is transmitted to the liquid level deciding means 396. The operation of the pump 318 is controlled by an output signal of the jetting control means 395.

As will be described later, the liquid level detecting sensor continuous time counter 391 functions as both a liquid level detecting sensor continuous ON time counter and a liquid level detecting sensor continuous OFF time counter.

The hand disinfector comprises the liquid storing tank; the nozzle for jetting the liquid stored in the liquid storing tank toward the washstand; the pump for feeding the liquid under pressure from the liquid storing tank to the nozzle; and the control means for controlling the drive of the pump. Further, the pump is disposed in the casing with the shaft thereof extending horizontally, and an elastic member is installed on the drum portion of the pump and fixedly connected with an internal portion of the casing.

In this construction, the disinfectant flowing downward from the disinfectant storing tank into the pump can be effectively prevented from penetrating into the motor through a waterproof seal thereof. Thus, the motor can be reliably prevented from being burnt.

The elastic member is interposed between the pump and the disinfectant storing tank. Thus, vibrations generated by the pump can be absorbed to a great degree by the elastic member and effectively prevented from being transmitted to the disinfectant storing tank. Therefore, a user can use the hand disinfector without feeling discomfort.

Third Embodiment

A disinfector according to a third embodiment will be described below with reference to FIGS. 28 through 38.

Figure 28:
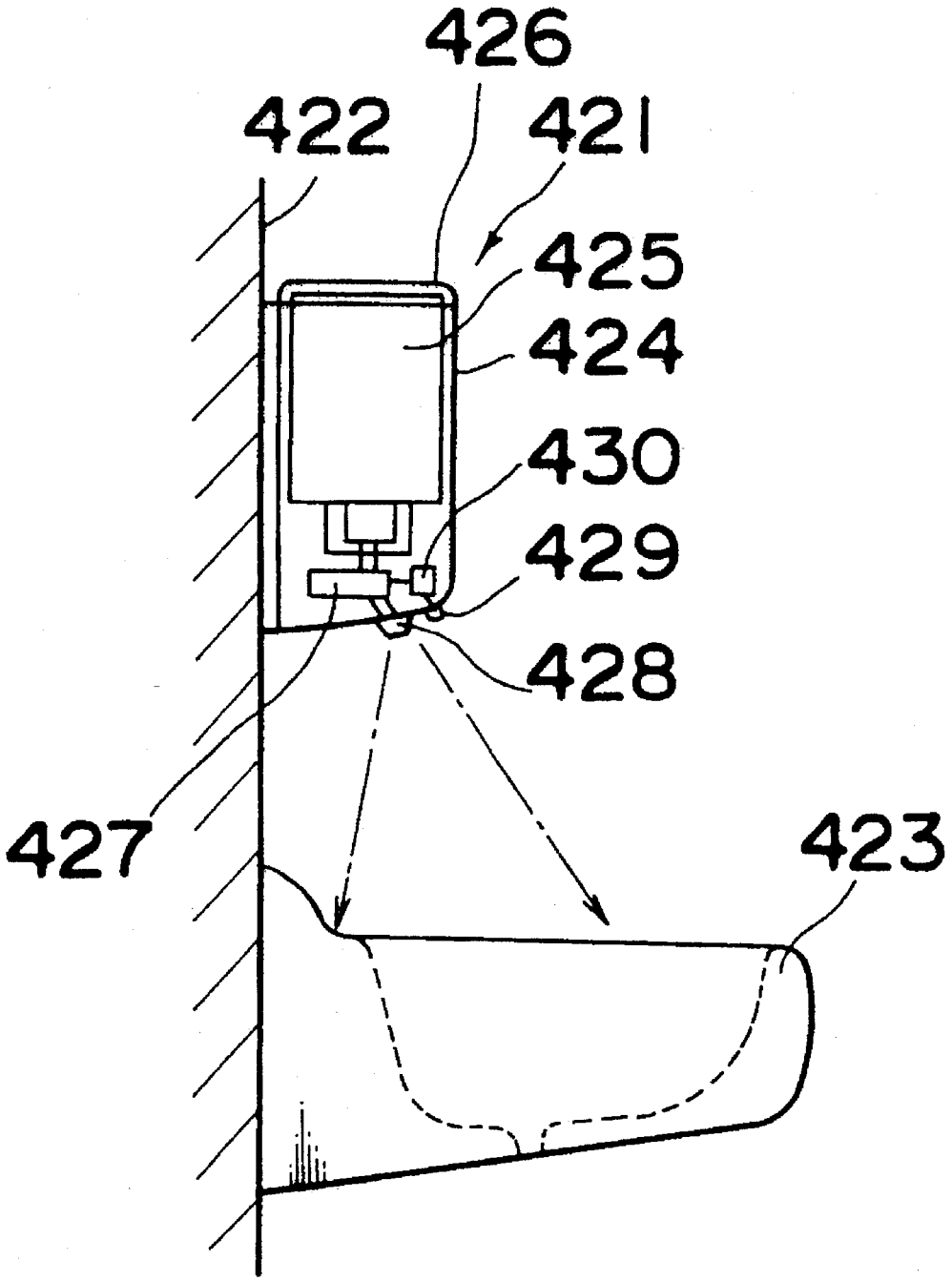
FIG. 28 is a sectional view showing a disinfector according to a third, embodiment of the present invention.

FIG. 28 is a sectional view showing the disinfector 421 according to the third embodiment. The disinfector 421 is installed on a wall surface 422 at a position above a washstand 423 mounted thereon. The disinfector 421 comprises a casing 424 to be installed on the wall surface 422. The casing 424 accommodates a cartridge type tank 425 containing disinfectant. The ceiling of the casing 424 is opened to removably install a cover 426 of the tank 425 thereon.

The casing 424 accommodates, below the tank 425, a pump 427 sucking the disinfectant in the tank 425 and feeding it under pressure and a nozzle 428 jetting the disinfectant fed out from the pump 427. The nozzle 428 is mounted on the bottom of the casing 424 so that the jetting direction of the disinfectant is directed toward the washstand 423. An optical sensor 429 is disposed on the bottom of the casing 424 so that the optical sensor 429 detects hands held out below the nozzle 428. There is provided in the casing 424 a control device 430 for controlling the drive of the pump 427 for a predetermined time period based on a hand detection signal outputted from the sensor 429.

When the sensor 429 detects the hands held out over the washstand 12, the sensor 429 outputs the detection signal. The control device 430 issues an instruction to drive the pump 427 for the predetermined time period based on the detection signal. In this manner, the disinfectant jetted from the nozzle 428 disinfects the hands.

The disinfector 421 is installed on the wall surface 422 at the position above the washstand 423 mounted on the wall surface 422. Because the nozzle 428 is disposed below the tank 425 and jets the disinfectant in the tank 425 toward the washstand 423, it is unnecessary to provide the disinfector 421 with a receiving plate or the like for receiving the disinfectant. Accordingly, the disinfector 421 has a compact and simple construction. In order to prevent the tank 425 from being polluted by the disinfectant jetted by the nozzle 428, it is unnecessary to dispose the nozzle 428 forward of the tank 425, namely, to dispose the nozzle 428 on the right side with respect to the tank 425 in FIG. 28 because the tank 425 is disposed above the nozzle 428, unlike a conventional disinfector in which the nozzle is disposed above the tank. In this manner, the disinfector 421 can be installed in a small area of the wall surface 422.

Figure 31:
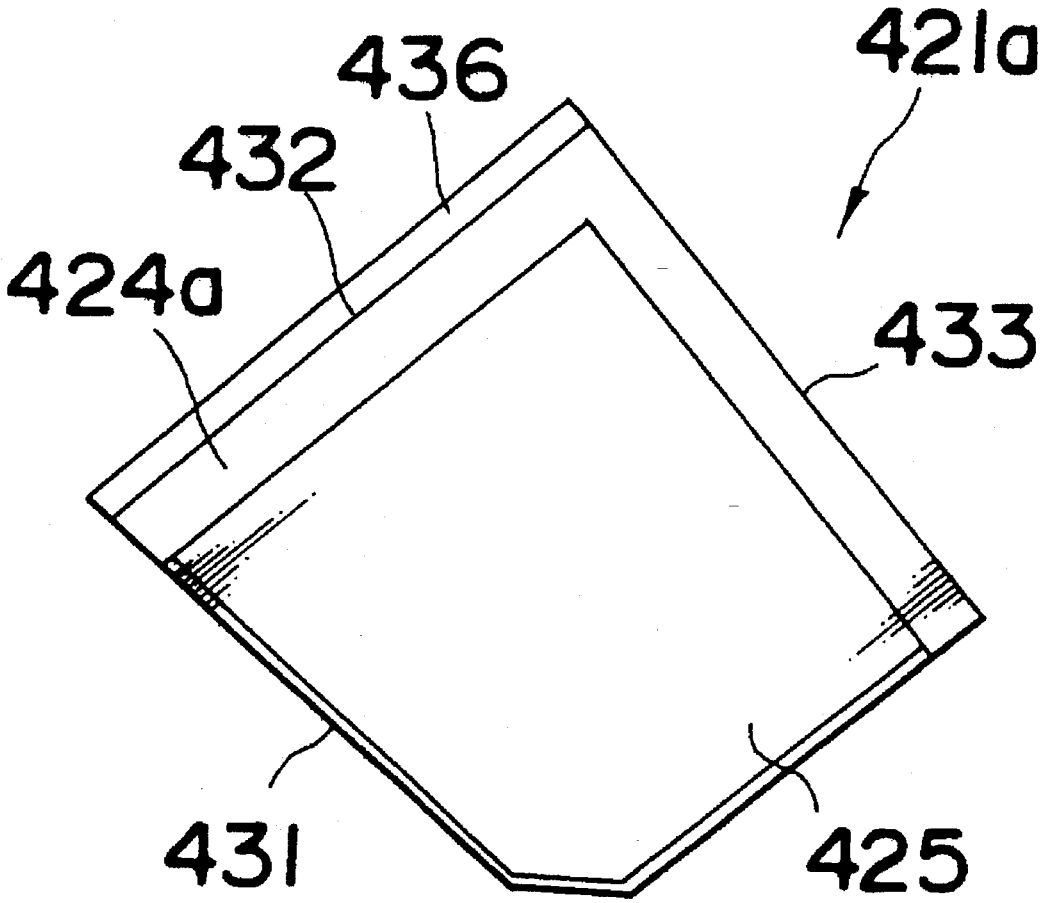
FIG. 31 is a plan view showing the disinfector shown in FIG. 29.
Figure 32:
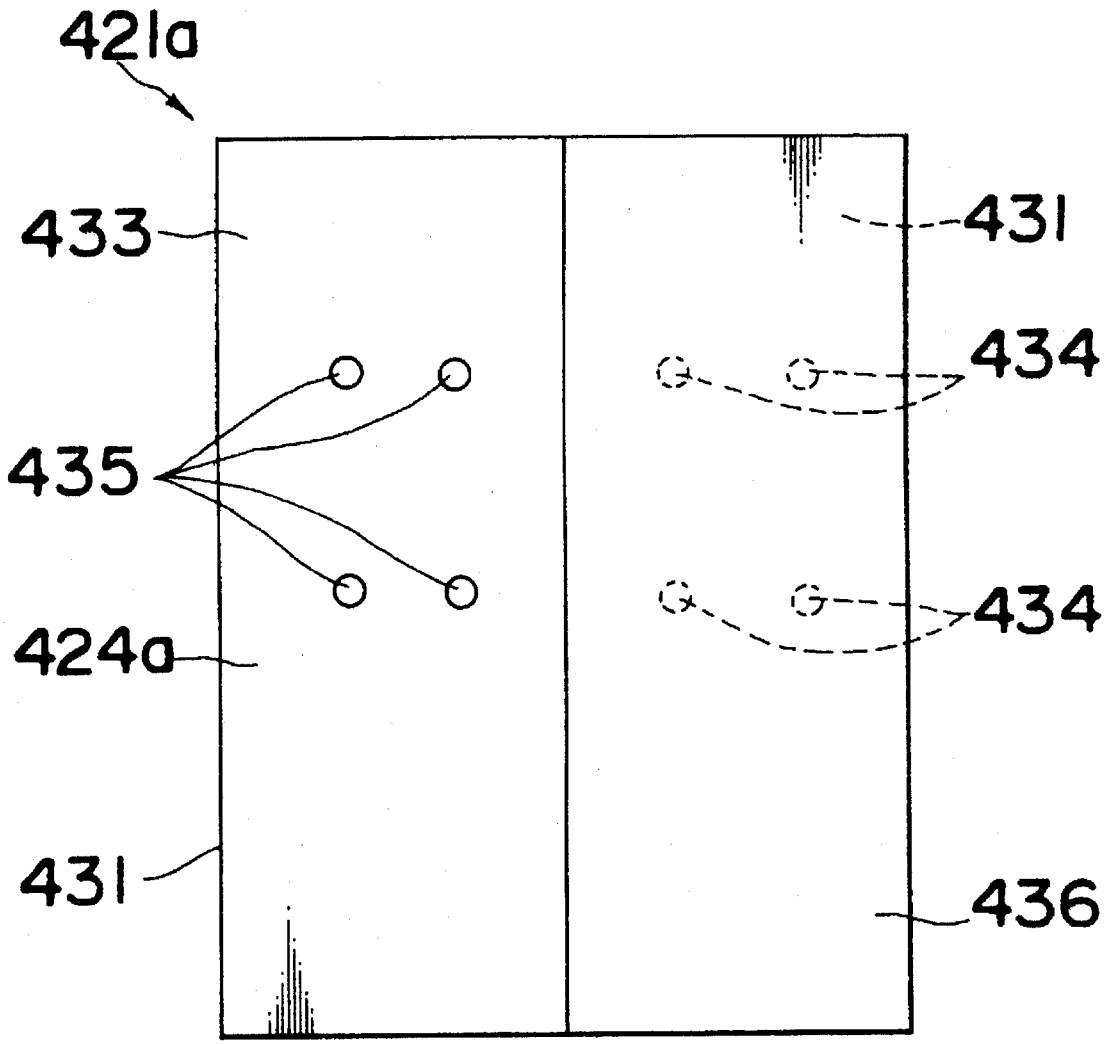
FIG. 32 is a rear view showing the disinfector shown in FIG. 29.
Figure 33:
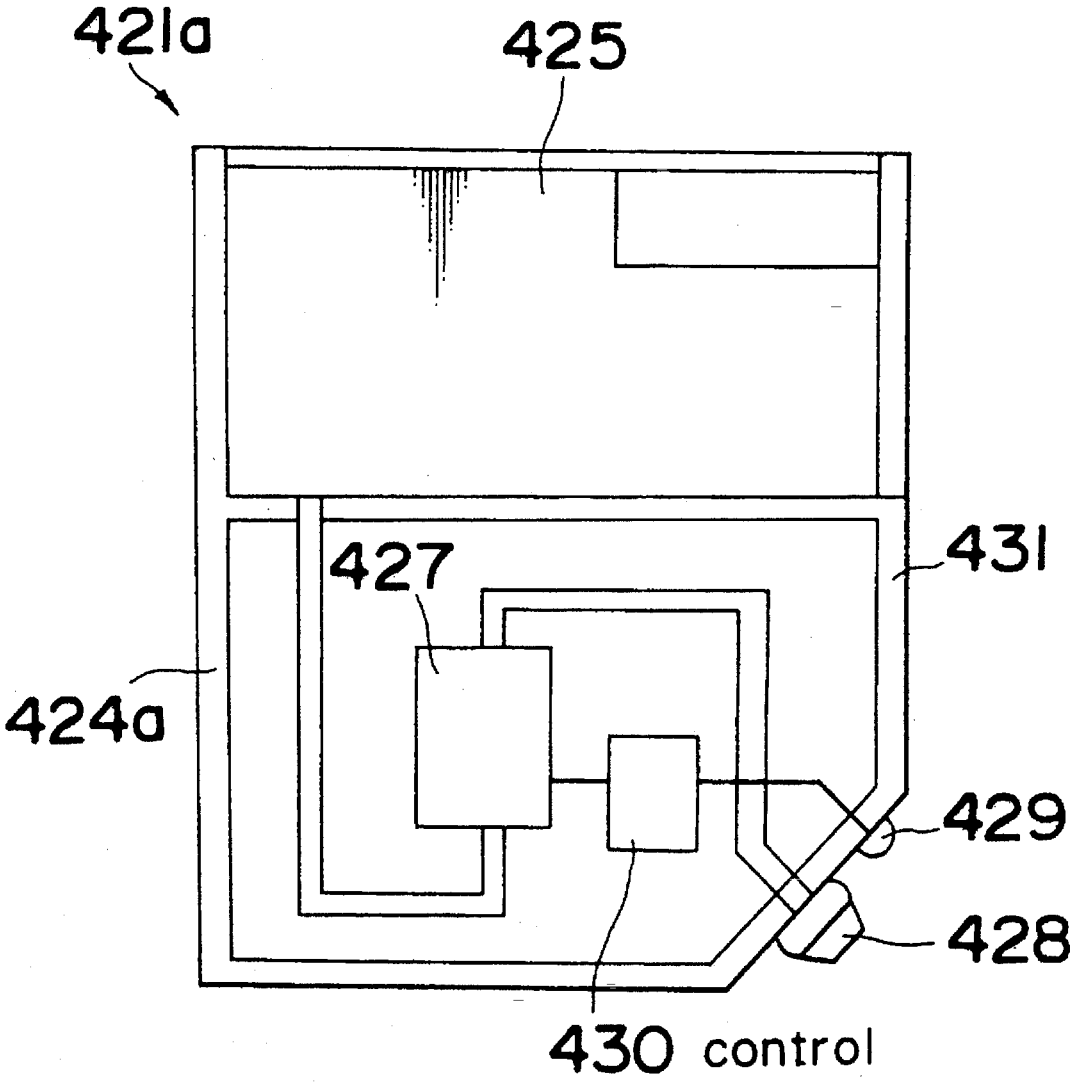
FIG. 33 is a sectional view showing the disinfector shown in FIG. 29.

FIG. 29 is a perspective view showing a disinfector 421*a* according to a modification of the third embodiment. FIG. 30 is a front view showing the disinfector 421*a*. FIG. 31 is a plan view showing the disinfector 421*a*. FIG. 32 is a rear view showing the disinfector 421*a*. FIG. 33 is a sectional view showing the disinfector 421*a*. The disinfector 421*a* is installed on a wall surface 422 at a position above a washstand 423 mounted thereon.

The disinfector 421*a* comprises the tank 425 and a disinfector main body 431 supporting the tank 425 by a lower portion thereof and by a portion thereof fixed to the wall. The main body 431 has a casing 424*a* formed by cutting an upper corner away from approximately a square pole. The tank 425 is mounted on the cut-away portion of the casing 424*a*. As shown in FIG. 31, the casing 424*a* has rear surfaces 432 and 433, intersecting with each other, to be installed on the wall surface 422. A nozzle 428 and a sensor 429 are disposed on a front lower portion of the casing 424*a*. Thread openings 434 and 435 are formed on each of the rear surfaces 432 and 433 so as to fix the casing 424*a* to the wall surface 422 by means of screws. A cover 436 is removably mounted on the rear surfaces 432 and 433.

The internal construction of the disinfector 421*a* is similar to that of the disinfector 421 shown in FIG. 1.

Figure 34:
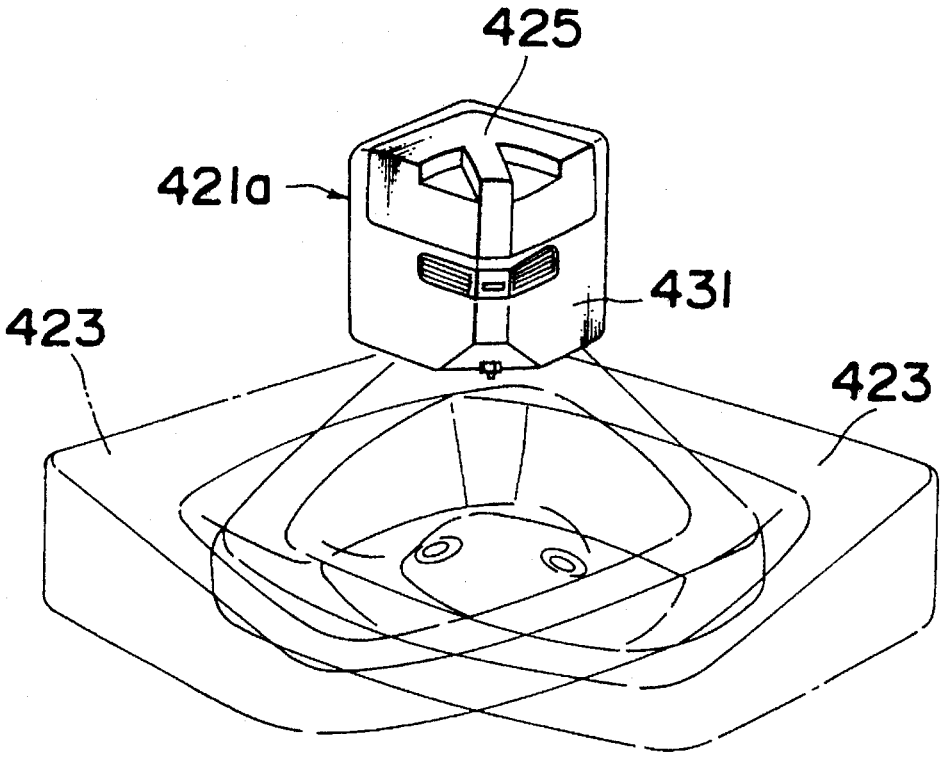
FIG. 34 a perspective view showing the use state of the disinfector shown in FIG. 29.
Figure 35:
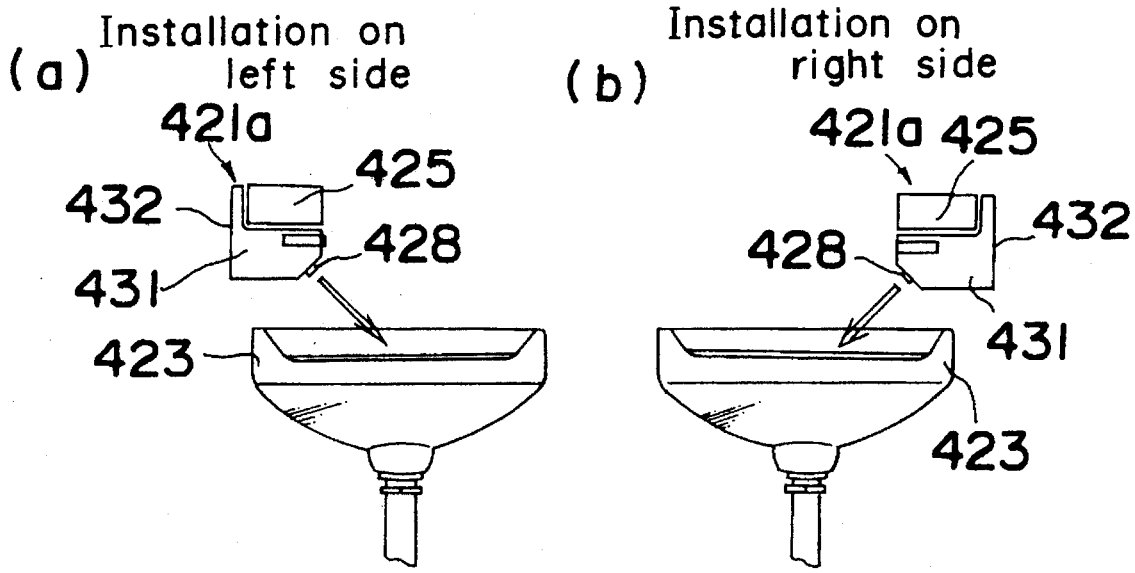
FIGS. 35(*a*) and 35(*b*) are perspective views showing the use state of the disinfector shown in FIG. 29.

As the use state of the disinfector 421*a* is shown in FIGS. 34, 35(*a*) and 35(*b*), the disinfector 421*a* can be installed on the right and left sides of the washstand 423, in addition to the effect similar to that of the disinfector 421 according to the third embodiment. That is, in installing the disinfector 421*a* on the left side of the washstand 423 as shown in FIG. 35*a*, the rear surface 433 of the casing 424*a* is fixed to the wall surface 422 by means of screws and the thread opening 435. The cover 436 may be mounted on the rear surface 432 not used. In installing the disinfector 421*a* on the right side of the washstand 423 as shown in FIG. 35*b*, the rear surface 432 of the casing 424*a* is fixed to the wall surface 422 by means of screws and the thread opening 434. The cover 436 may be mounted on the rear surface 433 not used.

Figure 36:
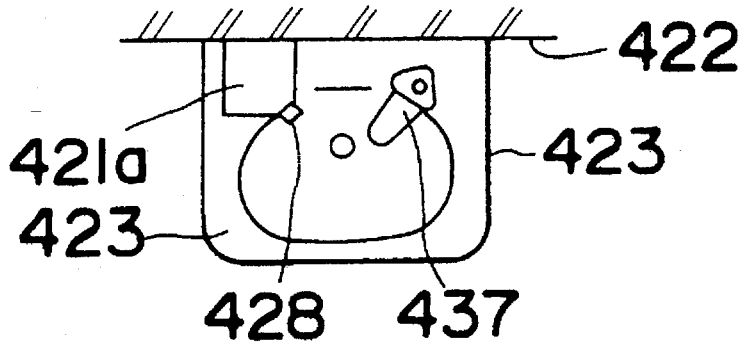
FIG. 36 is a plan view showing the use state of the disinfector shown in FIG. 29.
Figure 37:
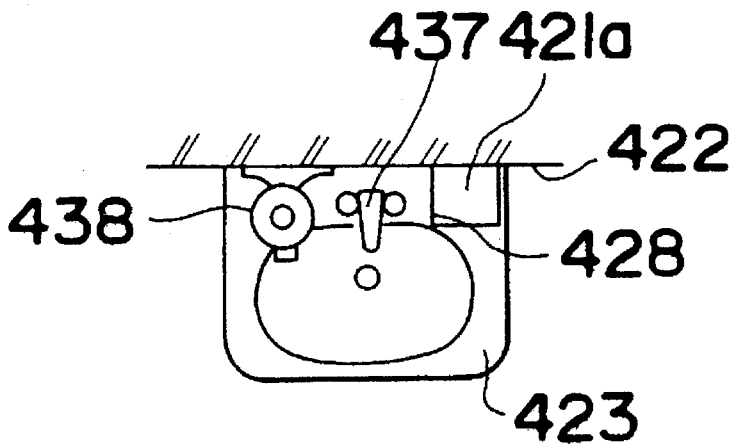
FIG. 37 is a plan view showing the use state of the disinfector shown in FIG. 29.

As described above, in addition to the effect similar to that of the third embodiment, the disinfector 421*a* can be installed on both the right and left sides of the washstand 423. There are cases in which a cock 437 and a soap container 438 have been installed on the wall surface 422 in the vicinity of the washstand 423 or the washstand 423 as shown in FIGS. 36 and 37. In these cases, a conventional disinfector cannot be installed on a predetermined installing position, whereas the disinfector 421*a* can be installed on the wall surface 422, depending on the position of the cock 437 and that of the soap container 438. Thus, it is unnecessary to prepare the disinfectors 421*a* to be installed on the left side of the washstand 423 and the right side thereof. Therefore, a smaller number of component parts suffices for manufacturing the disinfector 421*a*.

Fourth Embodiment

Figure 38:
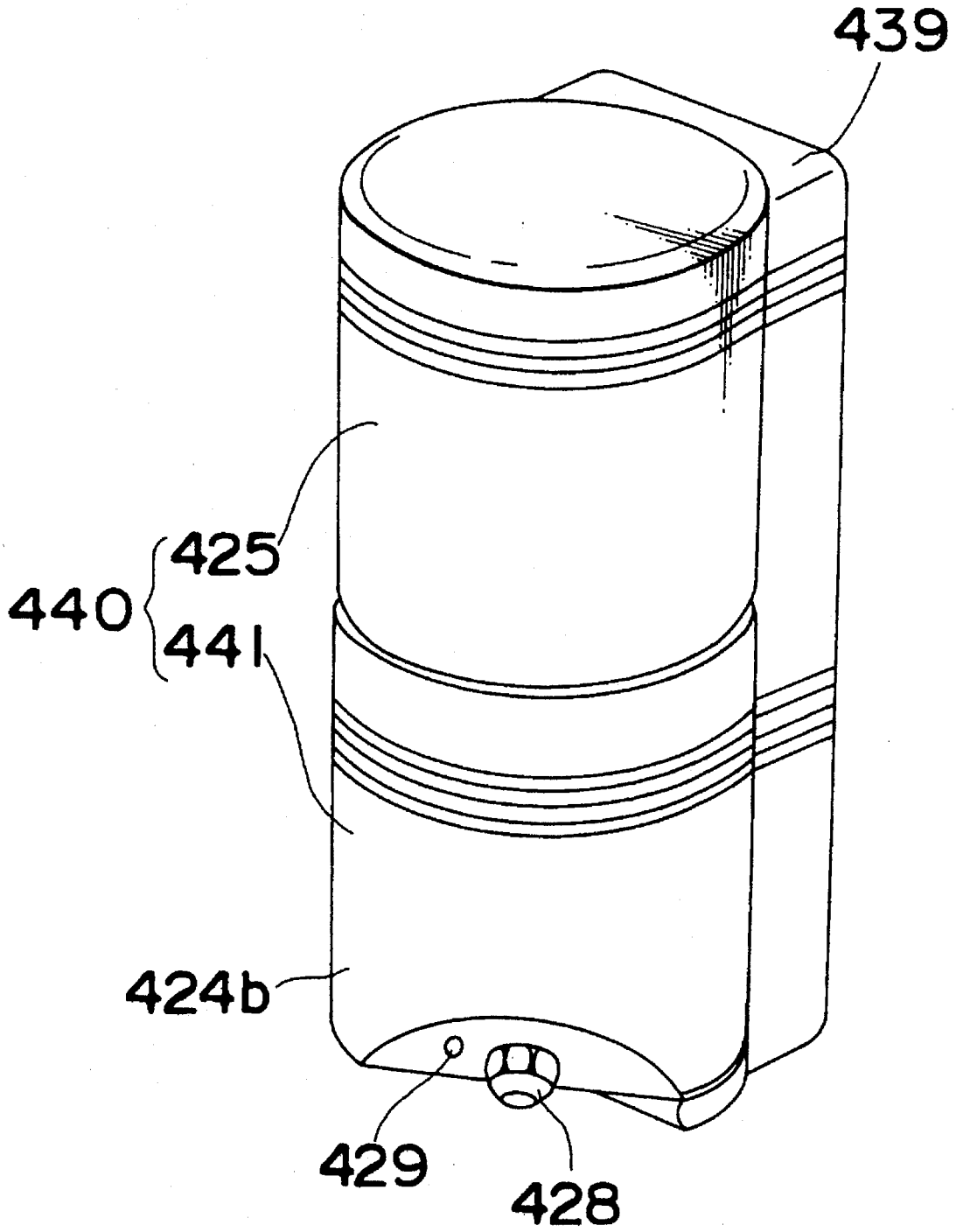
FIG. 38 is a perspective view showing a disinfector according to a fourth embodiment of the present invention.
Figure 39:
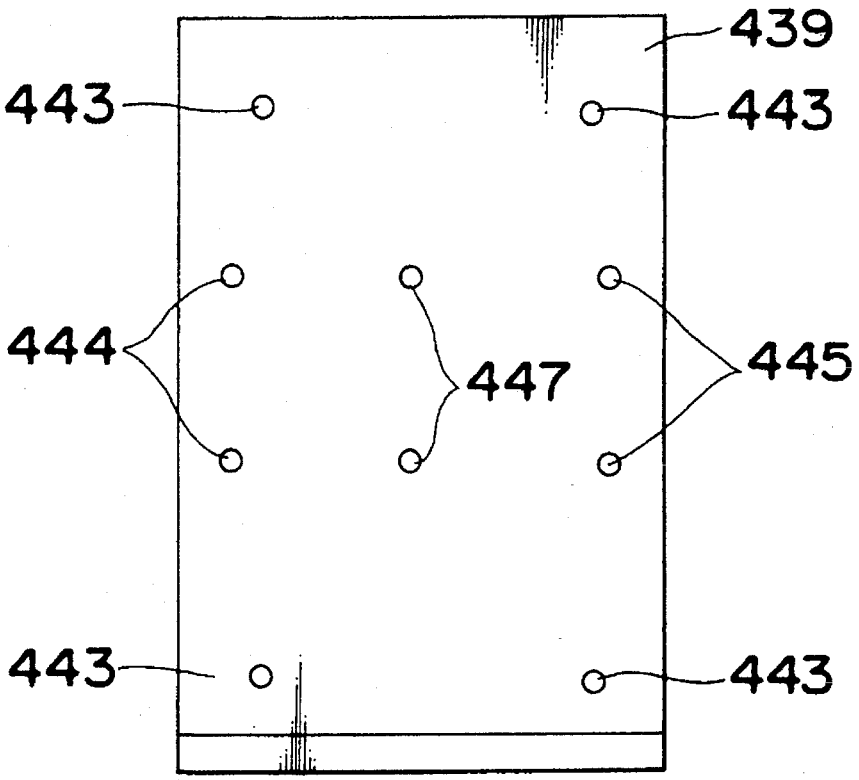
Figure 40:
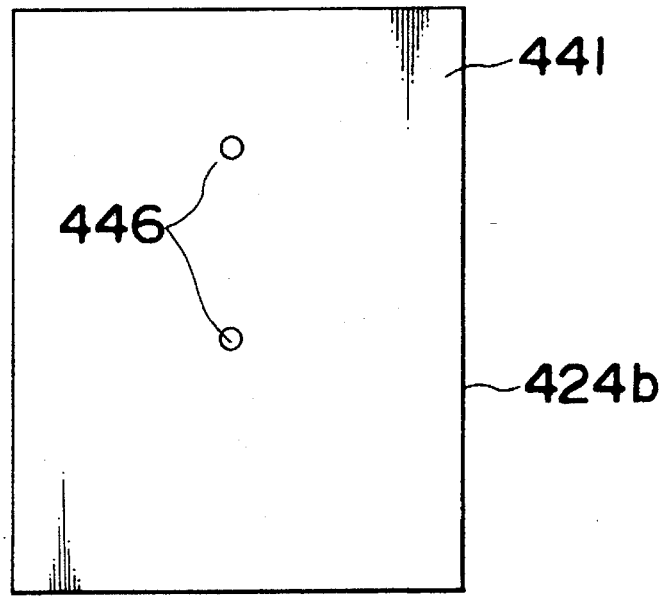
FIG. 40 is a rear view showing the disinfector shown in FIG. 38.
Figure 41:
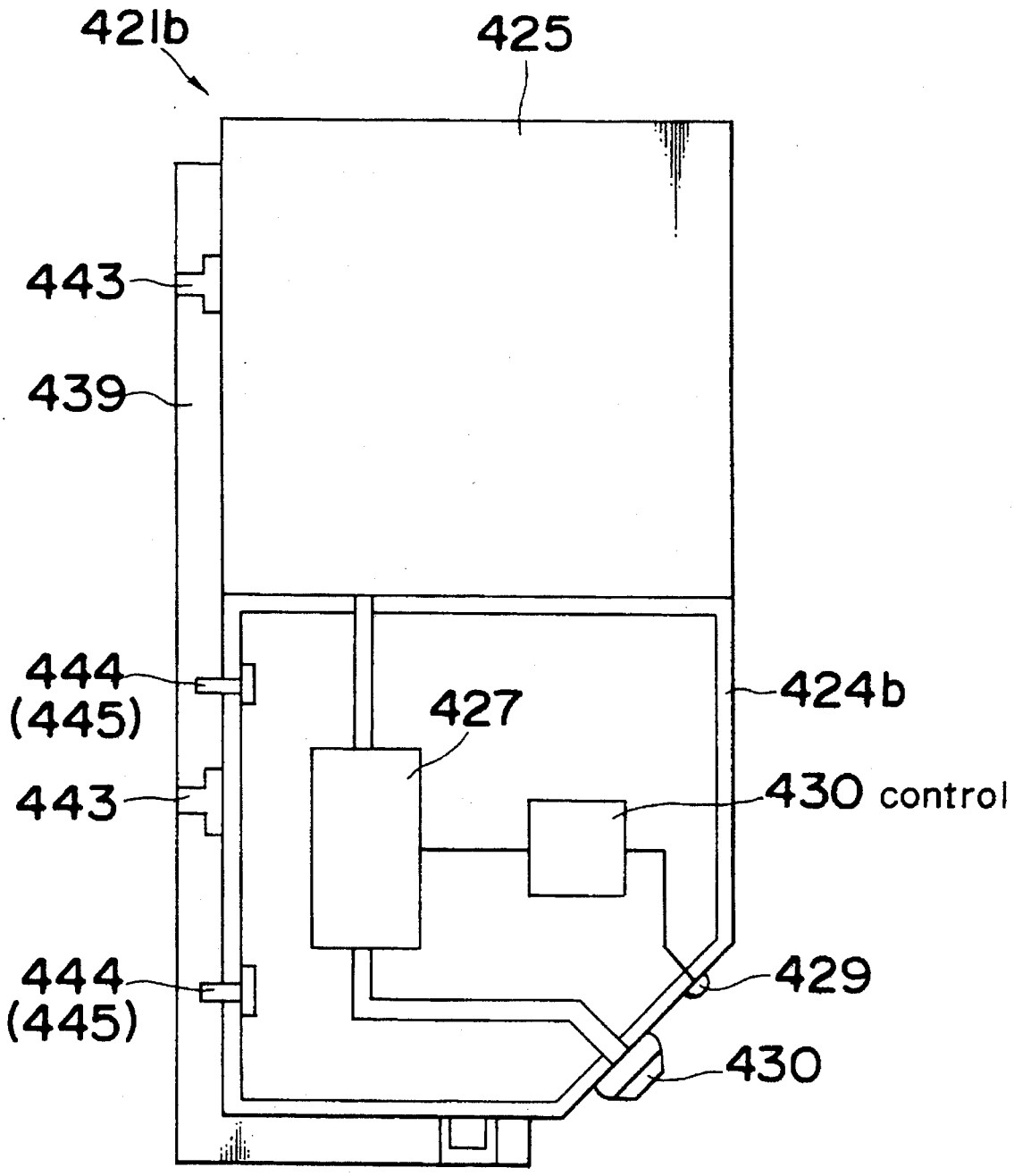
FIG. 41 is a sectional view showing the disinfector shown in FIG. 38.

A hand disinfector according to a fourth embodiment of the present invention is described below with reference to FIGS. 38 through 44. FIG. 38 is a perspective view showing the disinfector 421*b* according to the fourth embodiment. FIG. 39 is a front view showing a fixture 439, of the disinfector 421*b*, for installing the disinfector 421*b* on a wall surface 422. FIG. 40 is a rear view showing a disinfector main body 440. FIG. 41 is a sectional view showing the disinfector 421*b*. The disinfector 421*b* is similar to that of the third embodiment. The disinfector 421*b* is installed on the wall surface 422 at a position above a washstand 423 mounted thereon.

The disinfector 421*b* comprises the fixture 439 and the main body 440. The fixture 439 is fixed to the wall surface 422 by means of screws and has a cylindrical inner surface. There are formed, on the cylindrical inner surface, a thread opening 443 for fixing the fixture 439 to the wall surface 422 and a plurality of thread openings 444, 447, and 445 for installing the main body 440 on the fixture 439 at different positions thereof along the circumferential direction of the fixture 439. As will be described later, each of the thread openings 444, 447, and 445 is used to install the main body 440 on the fixture 439 at a left side installing position, a central installing position, and a right side installing position thereof. After the fixture 439 is fixed to the wall surface 422, the main body 440 is mounted on the fixture 439 so that a nozzle 428 of the main body 440 confronts the washstand 423.

The main body 440 comprises a cylindrical tank 425 and a cylindrical mechanism portion 441. The former is set on the latter. The mechanism portion 441 comprises a cylindrical casing 424*b*. The casing 424*b* has a cylindrical peripheral surface. There is formed, on the wall surface side of the peripheral surface of the casing 424*b*, a thread opening 446 opposed to the thread openings 444 of the fixture 439 or 445 thereof and used to fix the main body 440 to the fixture 439 by means of screws. A nozzle 428 and a sensor 429 are disposed on a front lower portion of the casing 424*b*.

The internal construction of the disinfector 421*a* is similar to that of the disinfector 421 according to the third embodiment.

Figure 42:
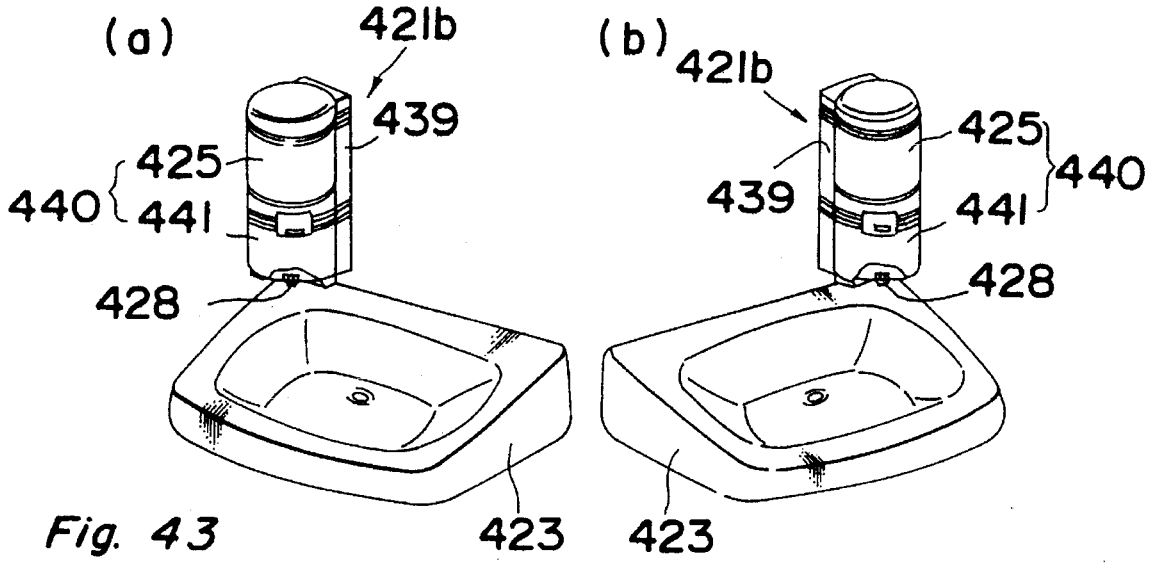
FIGS. 42(*a*) and 42(*b*) are perspective views showing the use state of the disinfector shown in FIG. 38.
Figure 43:
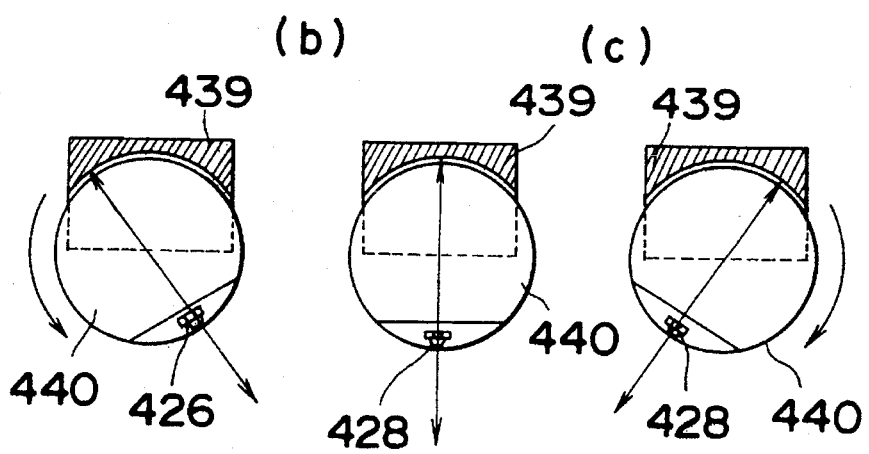
FIGS. 43(*a*), 43(*b*) and 43(*c*) are top plan views showing the use state of the disinfector shown in FIG. 38.

As shown in FIGS. 42(*a*), 42(*b*) and 43(*a*), 43(*b*) and 43(*c*), in addition to the effect similar to that of the disinfector 421 according to the third embodiment, the disinfector 421*b* can be installed on the left side, right side, and center of the washstand 423. That is, in installing the disinfector 421*b* on the left side of the washstand 423 as shown in FIGS. 42*a* and 43*a*, the fixture 439 is fixed to the wall surface 422 on the left side thereof and then, the main body 440 is fixed to the fixture 439. At this time, the main body 440 is installed on the left installing position of the fixture 439 so that the nozzle 428 confronts the washstand 423. More specifically, the main body 440 and the fixture 439 are fixed to each other by means of screws and the thread openings 446 and 444 opposed to each other.

In installing the disinfector 421*b* on the right side of the washstand 423 as shown in FIGS. 42*b* and 43*b*, the fixture 439 is fixed to the wall surface 422 on the right side thereof and then, the main body 440 is fixed to the fixture 439. At this time, the main body 440 is installed on the right installing position of the fixture 439 so that the nozzle 428 confronts the washstand 423. More specifically, the main body 440 and the fixture 439 are fixed to each other by means of screws and the thread openings 446 and 445 opposed to each other.

In installing the disinfector 421*b* at the center of the washstand 423 as shown in FIGS. 42*b*, the fixture 439 is fixed to the wall surface 422 at the center thereof and then, the main body 440 is fixed to the fixture 439. At this time, the main body 440 is installed on the central installing position of the fixture 439 so that the nozzle 428 confronts the washstand 423. More specifically, the main body 440 and the fixture 439 are fixed to each other by means of screws and the thread openings 446 and 447 opposed to each other.

Figure 44:
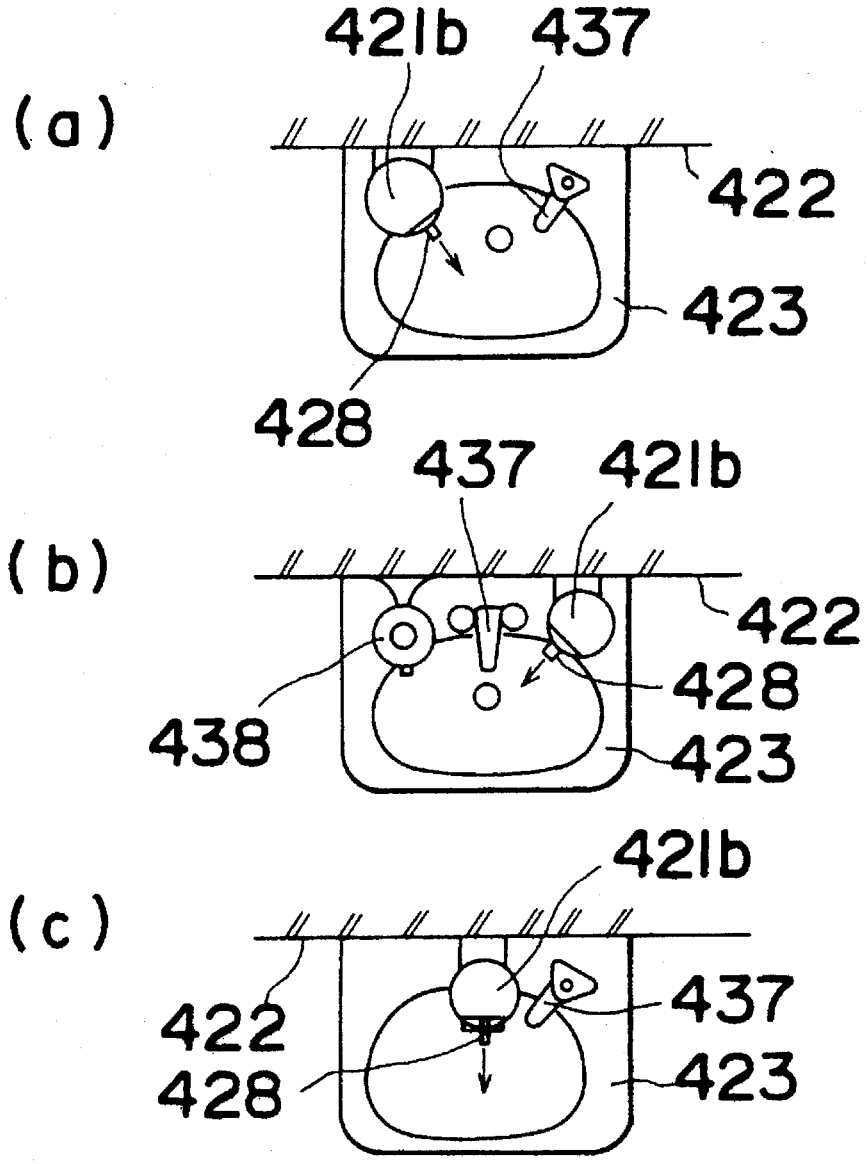
FIGS. 44(*a*), 44(*b*) and 44(*c*) are top plan views showing the use state of the disinfector shown in FIG. 38.

In addition to the effect similar to that of the disinfector 421 according to the third embodiment, the disinfector 421*b* can be installed on the left side, the right side, and the center of the washstand 423. There are cases in which a cock 437 or a soap container 438 have been installed on the wall surface 422 in the vicinity of the right side of the washstand 423 as shown in FIG. 44(*a*), on the left side and center of the washstand 423 as shown in FIG. 44(*b*) or the right or left side of the washstand 423 as shown in FIG. 44(*c*). In these cases, a conventional disinfector cannot be installed at a predetermined installing position, whereas the disinfector 421*b* can be installed on the wall surface 422 even though the cock 437 and/or the soap container 438 have been installed on the wall surface 422 and/or the washstand 423. Thus, it is unnecessary to prepare the disinfectors 421*b* to be installed on the left side of the washstand 423, the right side thereof, and the center thereof. Therefore, a smaller number of component parts suffices for manufacturing the disinfector 421*b*.

As described above, the nozzle 428 is disposed below the tank 425 to make the disinfectors 421, 421*a*, and 421*b* compact and simple, and the nozzle 428 pivots right-to-left or vice versa. The construction for fixing the disinfectors 421, 421*a*, and 421*b* to the wall surface 422, the construction for fixing the main body 431 to the wall surface 422 in a predetermined direction or the construction for fixing the mechanism portion 441 to the fixture 439 in a predetermined direction are not limited to the above-described construction.

The jetting apparatus according to the present invention is not limited to the disinfectors 421, 421*a*, and 421*b* according to the embodiments but soapsuds or other liquid may be jetted from the jetting apparatus.

Fifth Embodiment

In connection with a fifth embodiment of the present invention shown with FIG. 45 wherein a photoelectric sensor 549 is employed as a part element of the finger judging means 590, the arrangement of the photoelectric sensor 549 will be explained herein-after.

Figure 45:
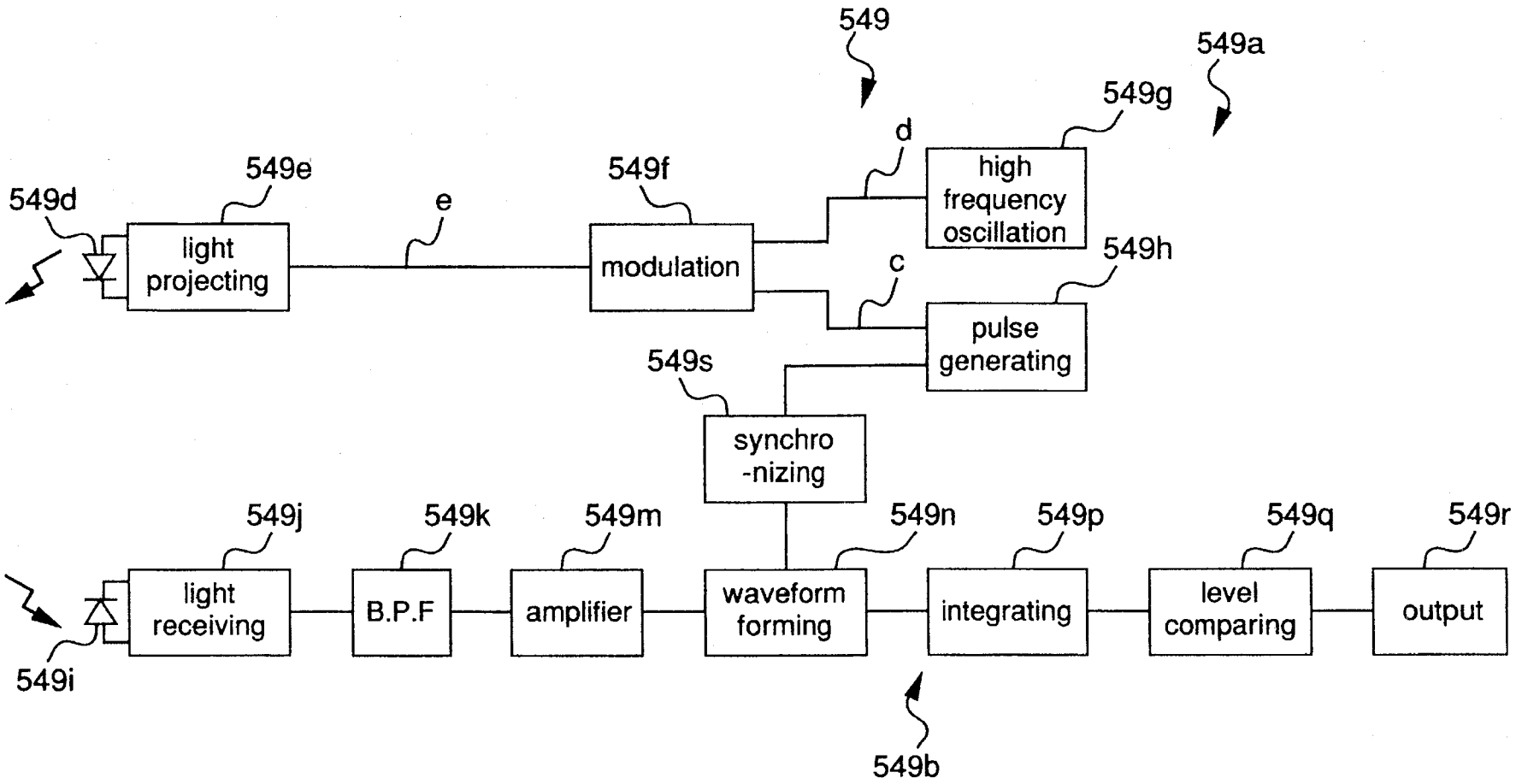
FIG. 45 is a circuit block diagram showing a control circuit of photoelectric sensor according to a fifth embodiment of the present invention.

As shown in FIG. 45, the photoelectric sensor 549 is consisted of a light projecting portion 549*a* and a light receiving portion 549*b*, the projecting portion 549*a* being constructed in that a light projecting circuit 549*a* provided with a light projecting element 549*d* for generating infrared light beams of a constant wavelength is connected to the output side of a modulation circuit 549*f* of which the input side is connected with a high frequency oscillation circuit 549*g* and a pulse generating circuit 549*h*.

With the above arrangement, the projecting light element 549*d* is inputted a high frequency wave which is outputted from the high frequency oscillation circuit 549 and modulated by a pulse wave outputted by the pulse generating circuit 549*h*. Accordingly, the projecting light element 549*d* is projected downwardly infrared light beams of a constant wavelength as a carrier which is modulated doubly with high frequency wave and pulse wave.

Figure 46:
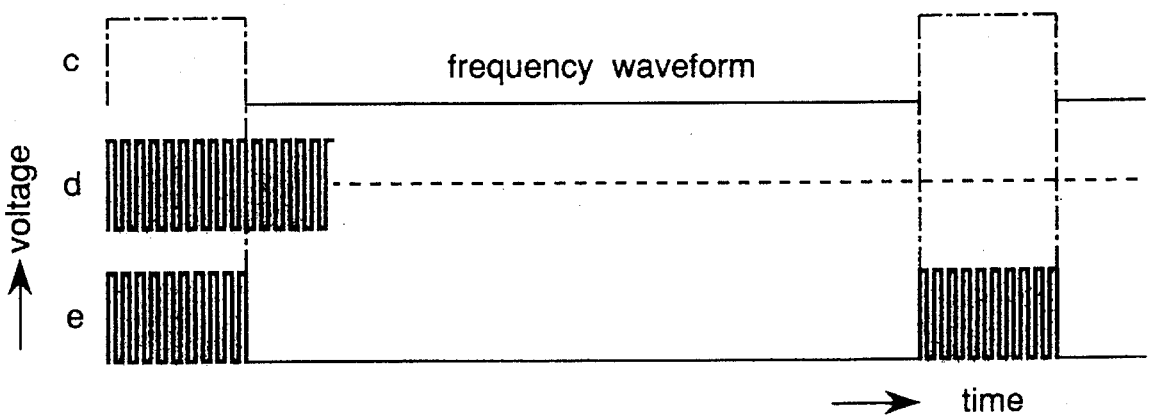
FIG. 46 is a waveform of high frequency generated for the circuit of FIG. 45.

Further, signals c, d, e of FIG. 46 respectively show the wave forms at the points c, d, e of FIG. 45.

The light receiving portion 549*a* is constructed in that the light receiving circuit provided with the light receiving element 549*i* is connected in series with a bond pass filter 549*k* for passing selectively through the same frequency component to that outputted from the high frequency oscillation circuit 549*g*, an amplifying circuit 549*m*, a waveform forming circuit 549*n*, an integrating circuit 549*p*, a level comparing circuit 549*q* and an output circuit 549*r*. In addition, the pulse generating circuit 549*h* is connected with the waveform forming circuit 549*n* through a synchronizing circuit 549*s*.

The light receiving portion 549*a* is outputted infrared light beams which is an incidence to the light receiving portion 549*b* through a light receiving side filter 551 and a bottom plate 541*b* and is converted to a voltage by the light receiving element 549*i*, and the band pass filter 549*k* is passed selectively the same frequency component to that of high frequency, which is then amplified by the amplifying circuit 549*m*, and is formed to the pulse wave by the waveform forming circuit 549*n*, and only the component synchronizing to the pulse wave through the output from the synchronizing circuit 549 is outputted to the integrating circuit 549*p*. The integrating circuit 549*p* is integrated the input from the waveform circuit 549*n* inputted at a certain time, of which output is compared with a predetermined reference level to output a signal to a micro-computer 580 of a control portion C through the output circuit 549*r* upon judging that there is assumed to exist a finger below the photoelectric sensor 549 in the case of input level being larger than that of the reference level.

With the above, by passing the output of light receiving element **549*i* through the band pass filter 549*k* and waveform forming circuit 549*n*, the light, that is, disturbance light with nothing of the same component to the infrared light beams of a constant wave length projected from the projecting light element 549*d* after modulating by the modulating circuit 549*f* is cut so as to be able to prevent miss operation from generating the disturbance light, since only the reflection light of infrared light projected from the projecting element 549*d*** is objected to compare in level with the reference level.

Figure 47:
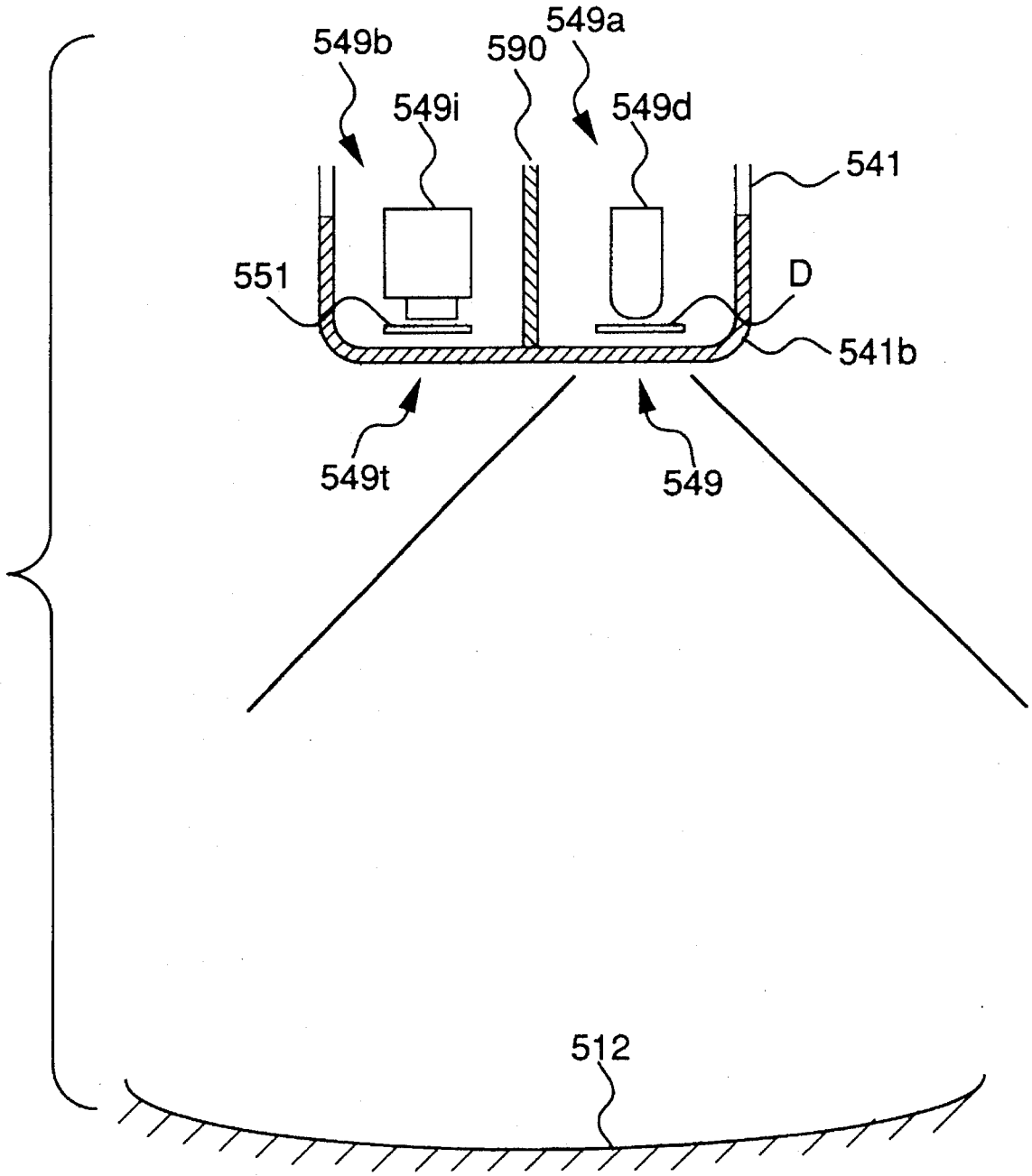
FIG. 47 is a cross-sectional view showing the sensor of FIG. 45.
Figure 48:
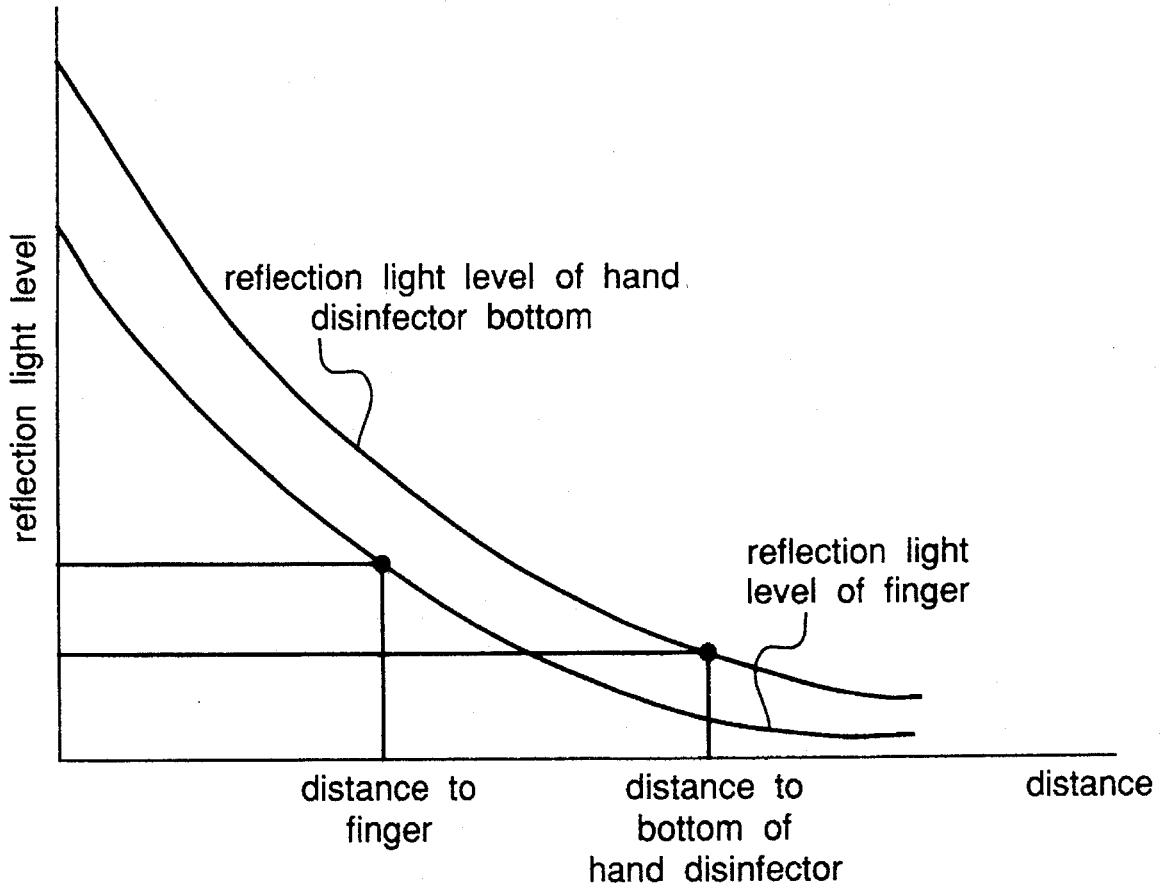
FIG. 48 is graph showing reflection light levels to be detected by the sensor of FIG. 45.
Figure 49:
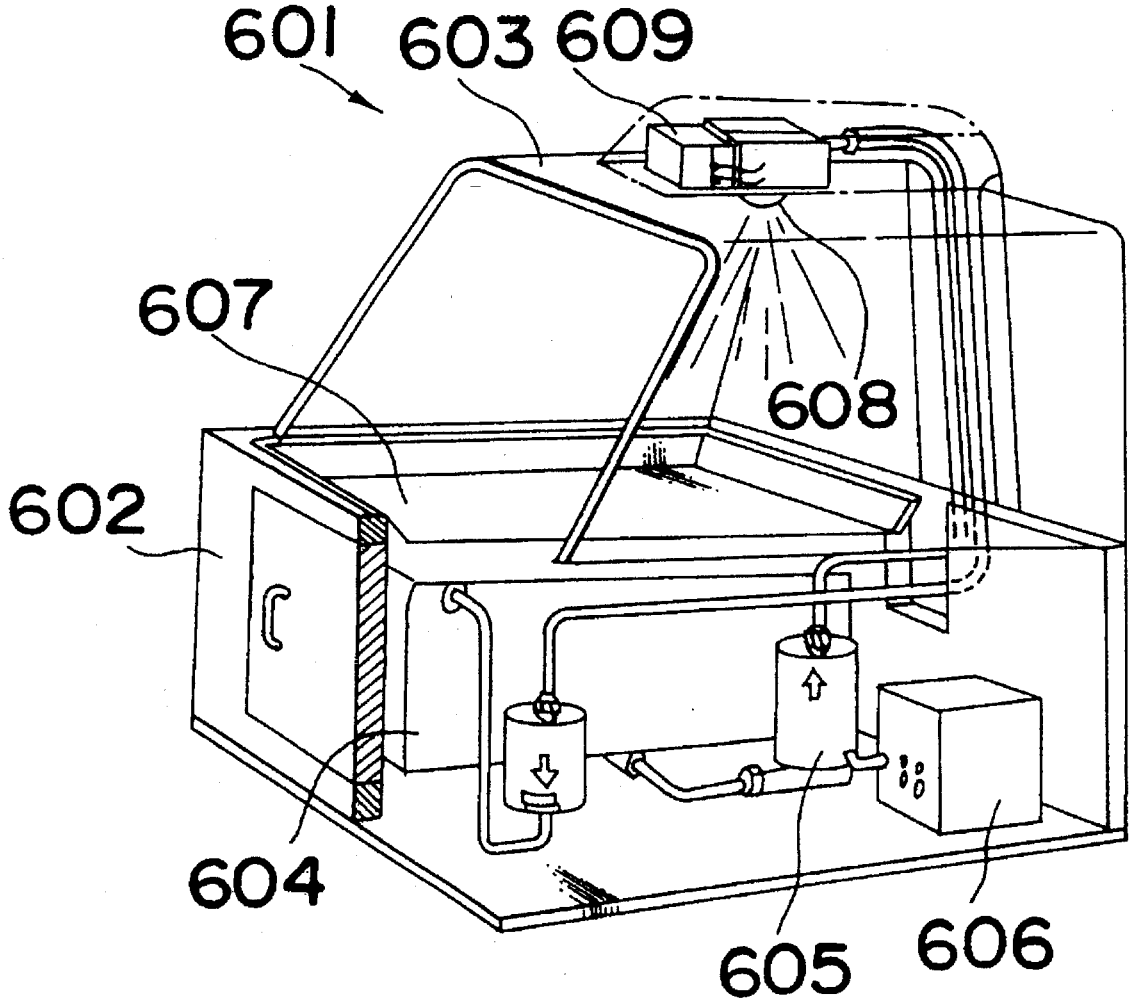
Fig. 49 PRIOR ART
FIG. 49 is a perspective view showing a conventional disinfector.
Figure 50:
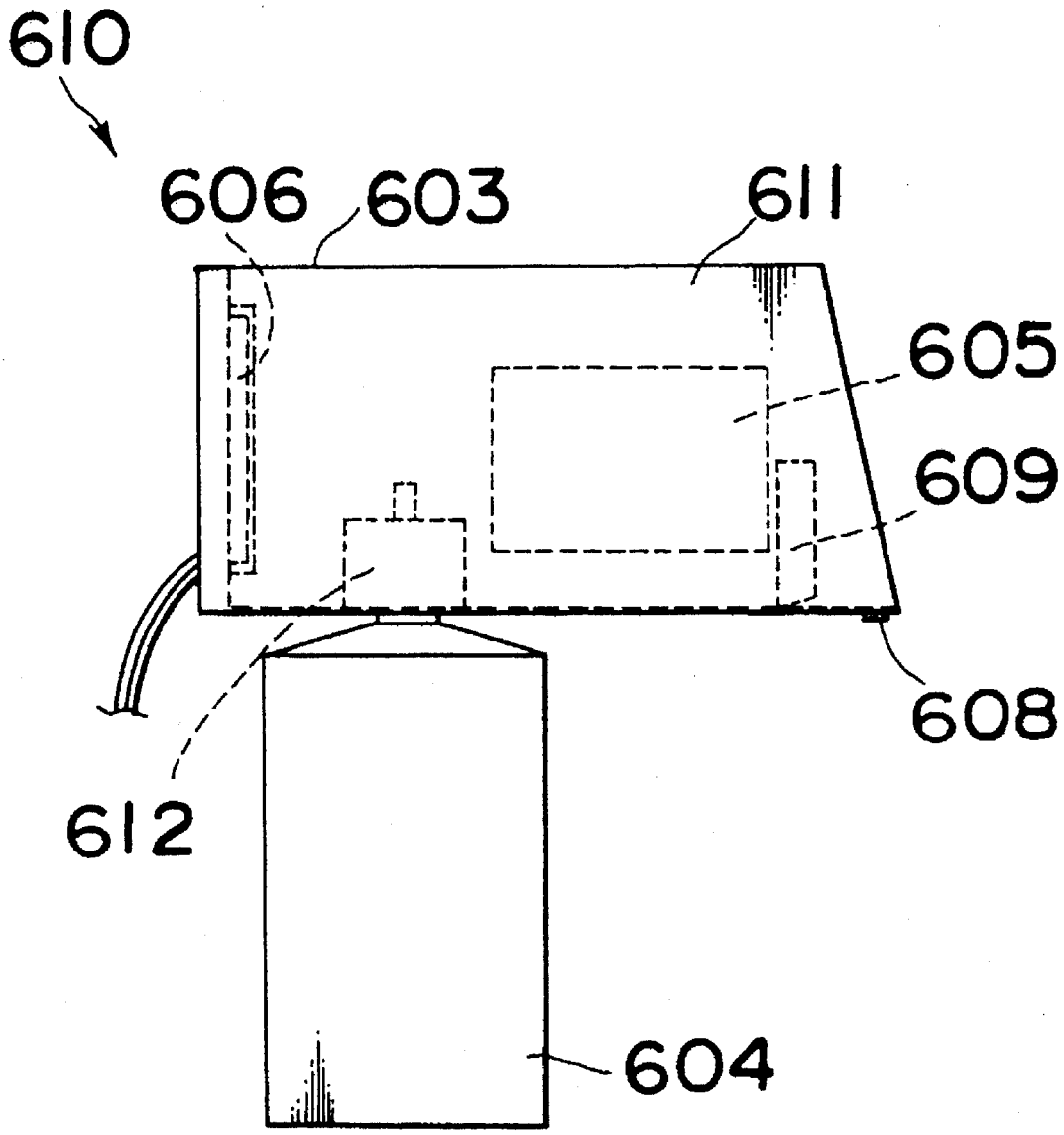
Fig. 50 PRIOR ART
FIG. 50 is a side view showing the conventional disinfector.

Also, as shown in FIG. 47, there provides a light diffusion body such as a cloudy plastic film or a concave lens at the front plane of the projecting light element **549*d* provided with the projecting opening 549*c* of the photoelectric sensor 519 so as to diffuse at broad angles the light beams projected from the projecting light element 549*d* within the internal of the bottom plate 541*b* of an injection casing 541**.

It is noted that it can be used for the light diffusion body D ones which can be diffused transmission light such as a transparent plate provided with lots of small semi-cubic convex or small semi-cubic concave, a ground glass, a cloud glass in addition to the cloudy plastic film or concave lens.

As mentioned above, by diffusing the infrared light beams projected by the projecting element **549*d*, as shown in FIG. 40**, the level of the reflection light from a finger becomes lower, but the level of reflection light from tile inner bottom plane of washing stand becomes further below, and the difference and proportion between the reflection light levels of submitting a finger and not submitting a finger becomes large so that it can be taken an allowance in the case of comparing with the reference level to prevent miss operation at the state of being stabilized the detection of a finger.

Also, since the infrared light beams from the projecting light element **549*d*** is diffused, it can be broadened the detecting range of a finger.

It is noted that the reflection light level having been diffused as mentioned above is varied inversely as square of the distance between an object to be detected and the photoelectric sensor 549, and, as a finger is disposed close to the photoelectric sensor 549 more than the bottom plane of washing stand 512, the reflection light level from the finger becomes larger than that of the bottom plane of washing stand 512 so that the difference and ratio of those reflection light levels become large.

Also, even if it provides an arrangement of inclining the casing of injection portion by means of diffusing the light from the light projecting portion **549*d*, the variation of reflecting light level from the bottom plane of washing stand to be caused by inclining becomes small, and, since there does not exist a bundle of light beams for the light from the light projecting element 549*d*, it could not generate automatically problems of injecting the light bundle of reflection light beams into the light receiving element 549*i*** so that it can be prevented the miss-operation and impossible of detection to be caused by the problems.

In addition, by providing at the light receiving opening **549*t* of the light receiving portion 549*b* the bottom plane 541*b* for passing selectively through the infrared light beams of a constant wavelength, the light projecting element 549*d* is applied to cutoff the light except of the same wavelength of light to that of infrared light beams generated by the light projecting element 549*d*** to lower the light receiving level of external disturbing light, thereby to render to prevent from generating the miss-operation.

In this embodiment of the present invention, the photoelectric sensor 549 of reflection type for use in the finger judging means 590 for detecting the existence or non-existence of a finger disposed above the washing stand 512 is so designed that only the reflection light level of infrared light beams projected from the light projecting portion **549*a* is applied to compare with the reference level, and, especially, by diffusing the infrared light beams projected by the light projecting element 549*d*, the light level of reflection infrared light beams from the bottom plane within the washing stand is forced to be weak to have the detection of finger stable with making an allowance of level comparison large, and, even when the casing of injecting portion is inclined so as to make use easily, it does not to cause problems of being unstable for finger detection or impossible of detection, with broadening the detection range for finger to make it to use easily. Also, at the light receiving opening 549*t* of light receiving portion 549*b* there provides the bottom plate 541*b*** for passing selectively through the infrared light beams of a constant wavelength to make lower the light receiving level of external disturbing light, so that the miss-operation to be caused by the external disturbing light can be prevented.

Although the present invention has been fully described in connection with the preferred embodiments thereof with reference to the accompanying drawings, it is to be noted that various changes ad modifications are apparent to those skilled in the art. Such changes and modifications are to be understood as included within the scope of the present invention as defined by the appended claims unless they depart therefrom.

What is claimed is:

1. A jetting apparatus for jetting liquid toward a hand for disinfection thereof, said jetting apparatus comprising:

a main body;

a liquid storage tank mounted to said main body;

a nozzle fluidically connected to said liquid storage tank for jetting liquid stored in said liquid storage tank in a first given direction;

a hand detecting sensor which emits light in a second given direction for detecting presence of a hand; and wherein said nozzle and said hand detecting sensor are disposed alongside one another and are pivotally mounted to said main body such that the first given direction of the light emitted by the hand detecting sensor coincides with the second given direction of the liquid jetted by said nozzle and such that said nozzle and said hand detecting sensor can be pivoted in unison.

2. A jetting apparatus as recited in claim 1, further comprising a pump for feeding the liquid under pressure from the liquid storage tank to the nozzle;

control means for controlling operation of the pump.

3. A jetting apparatus as recited in claim 1, further comprising liquid level detecting means for detecting that liquid stored in said liquid storage tank has dropped to a reference level.

4. A jetting apparatus as recited in claim 1, further comprising liquid level detecting means for detecting that the level of liquid stored in the liquid storing tank has dropped to a reference level.

5. A jetting apparatus as recited in claim 4, further comprising a supply display lamp, actuated based on an ON signal outputted from said liquid level detecting means, for providing a display indicating a need to replace the liquid in said liquid storage tank.

6. A jetting apparatus as recited in claim 1, wherein said pump includes a rotary shaft and is mounted to said main body such that said rotary shaft extends horizontally.

7. A jetting apparatus as recited in claim 1, wherein said pump includes a drum portion; and an elastic member is installed on said drum portion of said pump.

8. A jetting apparatus as recited in claim 1, wherein said hand detecting sensor comprises a reflection type photoelectric sensor including a light emitting section for emitting the light in the first given direction, and a light receiving section for receiving reflected light from a third given direction;

wherein the third given direction of the light received by said light receiving section is substantially coincident with the first given direction of the light emitted by said light emitting direction of the light receiving section; and said light emitting section is provided with a diffuser, disposed at a light emitting port thereof, for diffusing light emitted by said light emitting section.

9. A jetting apparatus, as recited in claim 1, installed on a washstand provided with a liquid receiving container.

10. A jetting apparatus for jetting liquid toward a hand for disinfection thereof, said jetting apparatus comprising:

a liquid storage tank;

a nozzle, fluidically connected with the liquid storage tank, for jetting liquid stored in the liquid storage tank;

a pump for feeding the liquid under pressure from the liquid storage tank to the nozzle;

liquid level detecting means for detecting that liquid stored in said liquid storage tank has dropped to a reference level;

accumulated flow-out amount detecting means, actuated based on an ON signal outputted from said liquid level detecting means, for detecting an accumulated flow-out amount of the liquid after the level thereof drops below the reference level; and accumulated flow-out amount calculating means for calculating the accumulated flow-out amount of the liquid based on a value detected by the accumulated flow-out amount detecting means, and for causing operation of said pump to be stopped when a value calculated by the accumulated flow-out amount calculating means reaches a predetermined tolerance flow-out amount.

11. A jetting apparatus as recited in claim 10, further comprising a motor for driving said pump; and wherein accumulated flow-out amount detecting means comprises means for detecting the number of rotations of said motor.

12. A jetting apparatus as recited in claim 10, wherein said accumulated flow-out amount detecting means comprises a flow meter for measuring the amount of the liquid fed from said liquid storage tank to said nozzle.

13. A jetting apparatus as recited in claim 10, wherein said accumulated flow-out amount detecting means comprises drive time measuring means for detecting a drive time period of said pump.

* * * * *